US006546212B1

(12) United States Patent
Ogata et al.

(10) Patent No.: US 6,546,212 B1
(45) Date of Patent: Apr. 8, 2003

(54) IMAGE FORMING APPARATUS AND UNIT DETACHABLY ATTACHABLE TO THE SAME IMAGE FORMING APPARATUS AND INFORMATION DISPLAYING SYSTEM RELATED TO UNIT DETACHABLY ATTACHABLE TO THE SAME IMAGE FORMING APPARATUS

(75) Inventors: Hiroaki Ogata, Shizuoka-ken (JP); Hiroshi Sasame, Numazu (JP); Shinya Yamamoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/689,735

(22) Filed: Oct. 13, 2000

(30) Foreign Application Priority Data

Oct. 15, 1999 (JP) ..... 11-294605
Oct. 15, 1999 (JP) ..... 11-294617
Oct. 15, 1999 (JP) ..... 11-294618
Oct. 15, 1999 (JP) ..... 11-294621

(51) Int. Cl.[7] ..... G03G 15/00
(52) U.S. Cl. ..... 399/24; 399/12
(58) Field of Search ..... 399/12, 13, 24, 399/25, 27, 28, 43

(56) References Cited

U.S. PATENT DOCUMENTS 4,961,088 A 10/1990 Gilliland et al. ..... 355/206
5,475,471 A 12/1995 Kisu et al. ..... 355/219
5,534,344 A 7/1996 Kisu et al. ..... 428/323
5,546,167 A 8/1996 Ogata et al. ..... 355/219
5,636,032 A * 6/1997 Springett ..... 39/296
5,678,141 A 10/1997 Asano et al. ..... 399/115
5,835,817 A 11/1998 Bullock et al. ..... 399/25
5,835,818 A 11/1998 Hoshika et al. ..... 399/26
5,943,525 A * 8/1999 Endo et al. ..... 399/27

FOREIGN PATENT DOCUMENTS

EP 0 840 182 A2 5/1998
JP 5-210304 A 8/1993
JP 07-234578 A * 9/1995
JP 10-105021 4/1998

* cited by examiner

*Primary Examiner*—Quana M. Grainger
(74) *Attorney, Agent, or Firm*—Fitzpatrick, Cella, Harper & Scinto

(57) ABSTRACT

The present invention provides an image forming apparatus which has image forming device for forming an image on a recording material, at least one component element of the image forming means being formed in a unit and detachably attachable to a main body of said apparatus, and output device for outputting information of an expiration date of the unit for use.

24 Claims, 23 Drawing Sheets

IMAGE FORMING APPARATUS AND UNIT DETACHABLY ATTACHABLE TO THE SAME IMAGE FORMING APPARATUS AND INFORMATION DISPLAYING SYSTEM RELATED TO UNIT DETACHABLY ATTACHABLE TO THE SAME IMAGE FORMING APPARATUS

BACKGROUND OF THE INVENTION

1. Field of the Invention

The present invention relates to an image forming apparatus and a unit detachably attachable (mountable) to the image forming apparatus, and also relates to an information displaying system related to a "unit detachably attachable to the image forming apparatus".

2. Related Background Art

Conventionally, in an image forming apparatus such as a copier and a laser beam printer, for example, the image forming apparatus of an electrophotography system, an image is formed on a recording medium by a latent image formed by projecting light, which corresponds to an image information, on an electrophotographically photosensitive body, a developer (including a toner) is supplied to the latent image by using developing means for making a visualized image, and the image is transferred from the photosensitive body to the recording medium.

In such image forming apparatus, for the purpose of replacing such consumable items as the electrophotographically photosensitive body and a developer and making maintenance convenient, there is a process-cartridge system, in which the electrophotographically photosensitive body is assembled with developing means, charging (electrifying) means, cleaning means, and also a storage part of the developer and a container of a waste developer, which are processing means acting on the electrophotographically photosensitive body, as a process cartridge to make it detachably attachable to a main body of the image forming apparatus. According to the process cartridge system, maintenance of the apparatus can be carried out by a user himself or herself, and not by a service person to make considerable improvement of operability possible. Therefore, the process cartridge system is widely applied to the electrophotographic image forming apparatus.

Meanwhile, for instance, in a color image forming apparatus having developing means for a plurality of colors, in the case where the degree of consumption of the different developing means differs from each other and in the case where the degree, i.e., life, of consumption of the electrophotographic photosensitive body differs from that of the developing means, the developing means for respective colors or the electrophotographic photosensitive body is allowed individual replacement and maintenance by, for example, individually making a cartridge of a developing cartridge for respective colors, in which the developing means and a developer containing section are assembled as the cartridge, and a photosensitive body drum cartridge, in which the cleaning means and the container of the waste developer and the electrophotographically photosensitive body are assembled integrally to make the cartridge.

In the image forming apparatus of the cartridge detachably attachable system as described above, in the case where the developer is exhausted and the electrophotographic photosensitive body falls down, the user can obtain a good image output again by replacing the cartridge.

Conventionally, such cartridge has an expiration date, within which a high quality image can be obtained, after manufacture of the cartridge. This is because by temporal change since the day of manufacture of the cartridge, deterioration, which is exemplified by a decrease in image density, loss of evenness of a halftone image, and the occurrence of a fog, of the quality of the output image is caused by reasons such as a change of sensitivity of the electrophotographic photosensitive body, a change of the modulus of elasticity of a member made by using an elastic body, and the change of resistance of the developer.

When the cartridge is started to be used, the cartridge is taken out from a sealed packing member and a developer seal, which seals the developer within the storage part of the developer, is removed allowing outer ambient conditions to influence the cartridge, e.g., taking up of moisture by the developer. Therefore, the quality of the removed cartridge is lowered slightly faster than a packed cartridge. Thus, it is preferable that the expiration date before which a high quality image can be obtained after the cartridge has been started to be used, is set separately from the expiration date after manufacture of the cartridge, as described above.

The expiration date after manufacture and the expiration date after start of use of the cartridge are conventionally generally described on the outside of a package of the cartridge or the instructions for use. Reading the description, the user can know information about the expiration date of the cartridge including the expiration date after manufacture of the cartridge or the expiration date after start of use of the cartridge.

However, when the cartridge is taken out from the package and used by mounting on the main body of the image forming apparatus, the user loses information about the expiration date of the cartridge, such as the expiration date after manufacture of the cartridge or the expiration date after start of the use.

In the case where the cartridge is used after the expiration date after manufacture of the cartridge or the expiration date after the start of use, as described above, though it very slowly occurs, deterioration of the output quality occurs, exemplified by a decrease in image density. Therefore, it is preferable that the cartridge is used before the expiration date. However, when the cartridge is used for a long period, the cartridge may be occasionally used after the expiration date after manufacture of the cartridge or the expiration date after the start of use.

In such cases, conventionally, information about the expiration date of the cartridge including the expiration date after manufacture or the expiration date after the start of use of the cartridge becomes difficult, because the manufacture date and the starting date of use of the cartridge are unknown.

In addition, in the image forming apparatus of the cartridge detachably attachable system as described above, in the case where the developer is exhausted and the electrophotographic photosensitive body falls down, the user can obtain a good image output again by replacing the cartridge. However, cartridge replacement should be carried out by the user and therefore, detection of deterioration, which is exemplified by consumption of the developer and removal of the electrophotographic photosensitive body, of the cartridge is performed.

In methods for detection of the degree of deterioration of the cartridge, for example, there are methods of detecting the degree of deterioration of the electrophotographic photosensitive body (the photosensitive body drum) made in a cylindrical shape:

- a method of counting the number of sheets printed,
- a method of counting the rotation of the photosensitive body drum, a method of measuring current running in the photosensitive body drum, and a method of measuring the rotation time of the photosensitive body drum and the application time of an electrification bias to estimate the degree of deterioration of the photosensitive body drum by conversion system.

Further, there are methods of detecting the degree of consumption of the developer:

an image dot count method of counting image dots which make up an image on the electrophotographic photosensitive body and converting the image dot composition to the quantity of the developer used, a torque detection method of detecting the torque of means for agitating the developer in the developer containing section, and a static capacity detection method in which a flat antenna substrate comprising an electrode pattern having a pair of conductive portions, which is formed in parallel with a certain distance from each other, is arranged in a position which is the position of a internal side surface of the developer containing section, contacting with developer, and where an area of contact with the developer, according to a reduction of the quantity of the developer changes and the change of the static capacity detectable by the flat antenna substrate according to reduction of the quantity of the developer, is applied.

Conventionally, on the basis of detection of an output from respective detection means of systems as described above, a percentage of the degree of deterioration of the cartridge in comparison with its unused status or a residual percentage is displayed for the user.

However, in the above described conventional displaying method for the degree of cartridge deterioration, the user can know the percentage of the degree of deterioration of the cartridge in comparison with its unused status or the residual percentage; however, the user cannot know the date of start of the use of the cartridge used at present. Therefore, a problem remains that the duration of usability of the cartridge and the optimal time for replacing the cartridge with a spare cartridge are unknown.

Further, according to the above described image forming apparatus of the cartridge detachably attachable system, in the case where the developer is exhausted and the electrophotographic photosensitive body falls down, the user can obtain a good image output again by replacing the cartridge.

However, when use of the cartridge is started, taking out the cartridge from the package in which the cartridge has been sealed and removing the developer seal, which has sealed the developer inside the developer containing section, allow the cartridge to be subjected to the influence of the outer environment. Thus, in comparison with unused and packed status, if the cartridge is left standing for a long time, according to the environment in which the cartridge is left standing, the following problems may occur:

the developer on a developing sleeve projected from the developing apparatus takes up moisture or dries to cause a decrease in image density and uneven image density, by leaving standing a cleaning blade in a pressurized contacting status to the photosensitive body drum, a transverse stripe (streak) image of a rotation cycle of the photosensitive body drum occurs, and the transverse stripe image of a rotation cycle of an electrified roller is caused by deformation of the pressurized contacting part of the electrified roller.

In contrast, in resetting after leaving the cartridge standing, the image forming apparatus operates resetting actions such as idle rotation of the photosensitive body drum and the developing sleeve, developing the developer of a certain quantity, and rotating the electrified roller in a current passing status for a certain time.

However, conventionally, because the duration time of leaving the cartridge standing is unknown, even if necessary or not, resetting actions are carried out in every case, e.g. a power supply of the image forming apparatus being ON and opening and closing of a door which is a port for inserting the cartridge, in which the cartridge, which is installed in the main body of the image forming apparatus, might be left standing.

In addition, the magnitude of resetting actions should be enough to be effective for a certain duration of leaving the cartridge standing. Therefore, in the case where number of sheets, on which images are formed in a day is small and the power supply is turned on and off frequently, there is a problem that the proportion of resetting actions becomes higher than that of a real image forming action to be at the end of its life of the cartridge sooner than that expected by the user.

Further, as described in Japanese Patent Application Laid-Open No. 10-105021, there is a method in which individual cartridges are distinguished by using information stored in a memory of the cartridge to simplify, for example, any action of the image forming apparatus.

In other words, conventionally, in the above described image forming apparatus of the cartridge detachably attachable system, in every installation of the cartridge in the main body of the image forming apparatus, there is a method in which by adjusting such variables as adjusting the developing bias inherent in an individual cartridge, correction is carried out to yield an optimal image density by executing a predetermined image adjusting process. For instance, in the case where for jam processing and the like the cartridge is removed once from the image forming apparatus and installed again, variables for image density adjusting are almost the same and thus, the image adjusting process is not necessary. If the process is executed, the time until image forming becomes possible is prolonged, for execution of such a process and thus, power consumption is wasted. Then, in the art disclosed in the above described Japanese Patent Application Laid-Open No. 10-105021, an identification number (ID) is stored in the memory of the cartridge as distinguishing information to distinguish individuals of the cartridge (cartridge distinguishing information) to decide whether the cartridge installed in the main body of the image forming apparatus is a newly installed one or not. If it is decided that the cartridge is once installed, the image adjusting process is omitted.

Further, a method has been proposed to store the manufacture date of the cartridge in the memory of the cartridge and then, display the expiration date of the cartridge by using the manufacture date information in the main body of the image forming apparatus side.

Furthermore, for instance, a method in which such data as the pixel count of the image formed and a used amount (for example, a printed sheet number) is counted in the main body of the image forming apparatus and is stored in the memory of the cartridge as the data showing the time amount of the cartridge use. Exemplified by this, methods having various functions to improve a user's convenience by using the memory mounted on the cartridge have been proposed. For example, by holding information about the cartridge use amount by the cartridge itself, even in the case where a plurality of cartridges is used by replacement, display of the cartridge use amount, which reflects information about the cartridge use amount in the main body of the image forming apparatus side, can be continually performed.

However, in the above described image forming apparatus, it is possible to install the cartridge having a memory, in which the cartridge-distinguishing information has been stored, conventionally, and a serial number of the cartridge at the time of manufacture is stored in the memory to distinguish individual cartridges from the serial number only.

As described above, when individual cartridges are distinguished by using only the serial number of the cartridge at the time of manufacture, if the manufactured quantity of the cartridge increases, the memory area for the cartridge distinguishing information should be kept more in the memory.

Also as described above, in the case where the manufacture date of the cartridge is stored in the memory of the cartridge to decide the expiration date of the cartridge in the main body of the image forming apparatus side, in addition to the serial number of the cartridge at the time of manufacture, the manufacture date of the cartridge is stored. However, when the serial number of the cartridge at the time of manufacture and the manufacture date of the cartridge is stored in the memory as independent data respectively, the problem occurs that the amount of data to be stored in the memory increases to make effective use of a small memory capacity impossible.

Particularly, as described above, exemplified by storing information about the cartridge use amount in the memory of the cartridge, in the case where information for achieving various functions to improve the user's convenience is written in the memory of the cartridge, it is required that the small memory capacity is effectively used.

SUMMARY OF THE INVENTION

The present invention has been achieved in consideration of the above described problems and an object thereof is to provide an image forming apparatus by which the expiration date of the unit can be accurately calculated and a unit detachably attachable to the image forming apparatus.

Another object of the present invention is to provide an image forming apparatus by which the expiration date of the unit can be accurately indicated and a unit detachably attachable to the image forming apparatus, and an information display system related to "the unit detachably attachable to the image forming apparatus".

A further object of the present invention is to provide an image forming apparatus capable of understandably indicating information about the expiration date of the unit and a unit detachably attachable to the image forming apparatus, and the information display system related to "the unit detachably attachable to the image forming apparatus".

A still further object of the present invention is to provide an image forming apparatus capable of accurate calculation of information about a situation of use of the unit and "the unit detachably attachable to the image forming apparatus".

A still further object of the present invention is to provide an image forming apparatus capable of understandably indicating information about the situation of use of the unit and a unit detachably attachable to the image forming apparatus, and the information display system related to "the unit detachably attachable to the image forming apparatus".

A still further object of the present invention is to provide an image forming apparatus capable of accurate calculation of information about a date of replacement of the unit and a unit detachably attachable to the image forming apparatus.

A still further object of the present invention is to provide an image forming apparatus capable of understandably indicating information about the date of replacement of the unit and a unit detachably attachable to the image forming apparatus, and the information display system related to "the unit detachably attachable to the image forming apparatus".

A still further object of the present invention is to provide an image forming apparatus capable of accurate calculation of information about an unused period of the unit and a unit detachably attachable to the image forming apparatus.

A still further object of the present invention is to provide an image forming apparatus capable of preventing reduction of the life of the unit and a unit detachably attachable to the image forming apparatus.

A still further object of the present invention is to provide an image forming apparatus capable of performing a suitable returning (resetting) action after the unit is left standing and a unit detachably attachable to the image forming apparatus.

A still further object of the present invention is to provide an image forming apparatus capable of effective use of the memory capacity mounted on the unit and a unit detachably attachable to the image forming apparatus.

A still further object of the present invention is to provide an image forming apparatus, comprising:

image forming means for forming an image on a recording material, at least one component element of the image forming means being formed in a unit and detachably attachable to a main body of said apparatus; and output means for outputting information of an expiration date of the unit for use.

A still further object of the present invention is to provide a unit detachably attachable to an image forming apparatus having image forming means for forming an image on a recording material, comprising:

at least one component element of the image forming means; and a memory, wherein the memory stores a date, which is the reference of the unit.

A still further object of the present invention is to provide a unit detachably attachable to an image forming apparatus having image forming means for forming an image on a recording material, comprising:

at least one component element of the image forming means; and a memory, wherein the memory stores a manufacturing date of the unit and a date of starting use of the unit.

A still further object of the present invention is to provide a unit detachably attachable to an image forming apparatus having image forming means for forming an image on a recording material, comprising:

at least one component element of the image forming means;

a memory, wherein the memory stores the expiration date of the unit.

A still further object of the present invention is to provide an image forming apparatus, comprising:

image forming means for forming an image on a recording material, at least one component element of the image forming means being formed in a unit and detachably attachable to the main body of said apparatus; and calculating means for calculating a rate of use of the unit per unit day according to a date of starting use of the unit, the present date, and information of a used amount of the unit.

A still further object of the present invention is to provide an image forming apparatus, comprising:

image forming means for forming an image on a recording material, at least one component element of the image forming means being formed in a unit and detachably attachable to said main body of the apparatus; and calculating means for calculating a number of days per the unit rate of use of the unit according to a date of starting use of the unit, a present date, and information of a used amount of the unit.

A still further object of the present invention is to provide an image forming apparatus, comprising:

image forming means for forming an image on a recording material, at least one component element of the image forming means is formed in a unit and detachably attachable to the main body of said apparatus; and calculating means for calculating the number of days remaining until the end of life of the unit according to a date of starting use of the unit, a present date, and information of the used amount of the unit.

A still further object of the present invention is to provide an image forming apparatus, comprising:

image forming means for forming an image on a recording material, at least one component element of the image forming means being formed in a unit and detachably attachable to the main body of said apparatus; and calculating means for calculating the number of days remaining until a warning date before the end of life of the unit according to a date of starting use of the unit, a present date, and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a date predicted to reach the end of life of the unit according to a date of starting use of the unit, a present date, and information of the used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a predetermined warning date before the end of life of the unit according to a date of starting use of the unit, a present date, and information of the used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a plurality of values concerning the unit according to a date of starting use of the unit, a present date, and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a rate of use of the unit per unit day according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days per the unit rate of use of the unit according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days remaining until the end of life of the unit according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days remaining until a warning date before the end of life of the unit according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a date planned to reach the end of life of the unit according to a date of starting use, a last date of use of the unit, and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a date planned to warn the user before the end of life of the unit according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a plurality of values concerning the unit according to a date of starting use and a last date of use of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a rate of use of the unit per unit day according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days per unit rate of use of the unit according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days remaining until the end of life of the unit according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating the number of days remaining until the warning date before the end of life of the unit according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a date planned to reach the end of life of the unit according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a date planned to warn the user before the end of life of the unit according to a last date of use and the number of using days of the unit and information of a used amount of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating a plurality of values concerning the unit according to a last date of use and the number of using days of the unit and information of a used amount of the unit.

A still further object of the present invention is to provide a unit detachably attachable to an image forming apparatus having image forming means for forming an image on a recording material, comprising:

at least one component element of the image forming means; and a memory, wherein the memory stores a date of starting use and a last date of use of the unit.

A still further object of the present invention is to provide a unit detachably attachable to an image forming apparatus having image forming means for forming an image on a recording material, comprising:

at least one component element of the image forming means; and a memory, wherein the memory stores a last date of use and the number of using days of the unit.

A still further object of the present invention is to provide an information displaying system related to a unit detachably attachable to an image forming apparatus, comprising:

a main assembly of said image forming apparatus;

a unit detachably mountable on the main assembly; and a display, wherein the display displays a rate of use of the unit per unit day.

A still further object of the present invention is to provide an information displaying system related to a unit detachably attachable to an image forming apparatus, comprising:

a main assembly of said image forming apparatus;

a unit detachably mountable on the main assembly; and a display, wherein the display displays a date planned to reach the end of life of the unit.

A still further object of the present invention is to provide an information displaying system related to a unit detachably attachable to an image forming apparatus, comprising:

a main assembly of the image forming apparatus;

a unit detachably mountable on the main assembly; and a display, wherein the display displays an uptime days of the unit.

A still further object of the present invention is to provide an information displaying system related to a unit detachably attachable to an image forming apparatus, comprising:

a main assembly of the image forming apparatus;

a unit detachably mountable on the main assembly; and a display, wherein the display displays a recommended date of preparation of the unit to be replaced to the unit.

A still further object of the present invention is to provide an information displaying system related to a unit detachably attachable to an image forming apparatus, comprising:

a main assembly of the image forming apparatus;

a unit detachably mountable on the main assembly; and a display, wherein the display displays a message containing a plurality of values related to the unit.

A still further object of the present invention is to provide an image forming apparatus, comprising:

image forming means for forming an image on a recording material, at least one component element of the image forming means being formed in a unit and detachably attachable to the main body of said apparatus; and calculating means for calculating an unused period of the unit.

A still further object of the present invention is to provide an image forming apparatus, comprising:

image forming means for forming an image on a recording material, at least one component element of the image forming means being formed in a unit and detachably attachable to the main body of the apparatus; and calculating means for calculating an unused period of the image forming means mounted on the unit.

A still further object of the present invention is to provide a unit detachably attachable to an image forming apparatus having image forming means for forming an image on a recording material, comprising:

at least one component element of the image forming means; and a memory, wherein the memory stores a last date of use of the unit.

A still further object of the present invention is to provide a unit detachably attachable to an image forming apparatus having image forming means for forming an image on a recording material, comprising:

at least two component elements of the image forming means; and a memory, wherein the memory stores a last working date of respective at least two component elements mounted on the unit.

A still further object of the present invention is to provide a unit detachably attachable to an image forming apparatus having image forming means for forming an image on a recording material, comprising:

at least one component element of the image forming means; and a memory, wherein the memory stores a manufacturing date and a serial number.

DETAILED DESCRIPTION OF THE PREFERRED EMBODIMENTS

As follows, an image forming apparatus related to the present invention, a cartridge detachably-attachable to this image forming apparatus and a displaying system for displaying a time limit for use of a cartridge will be described in further detail with reference to drawings.

Embodiment 1

Figure 1:
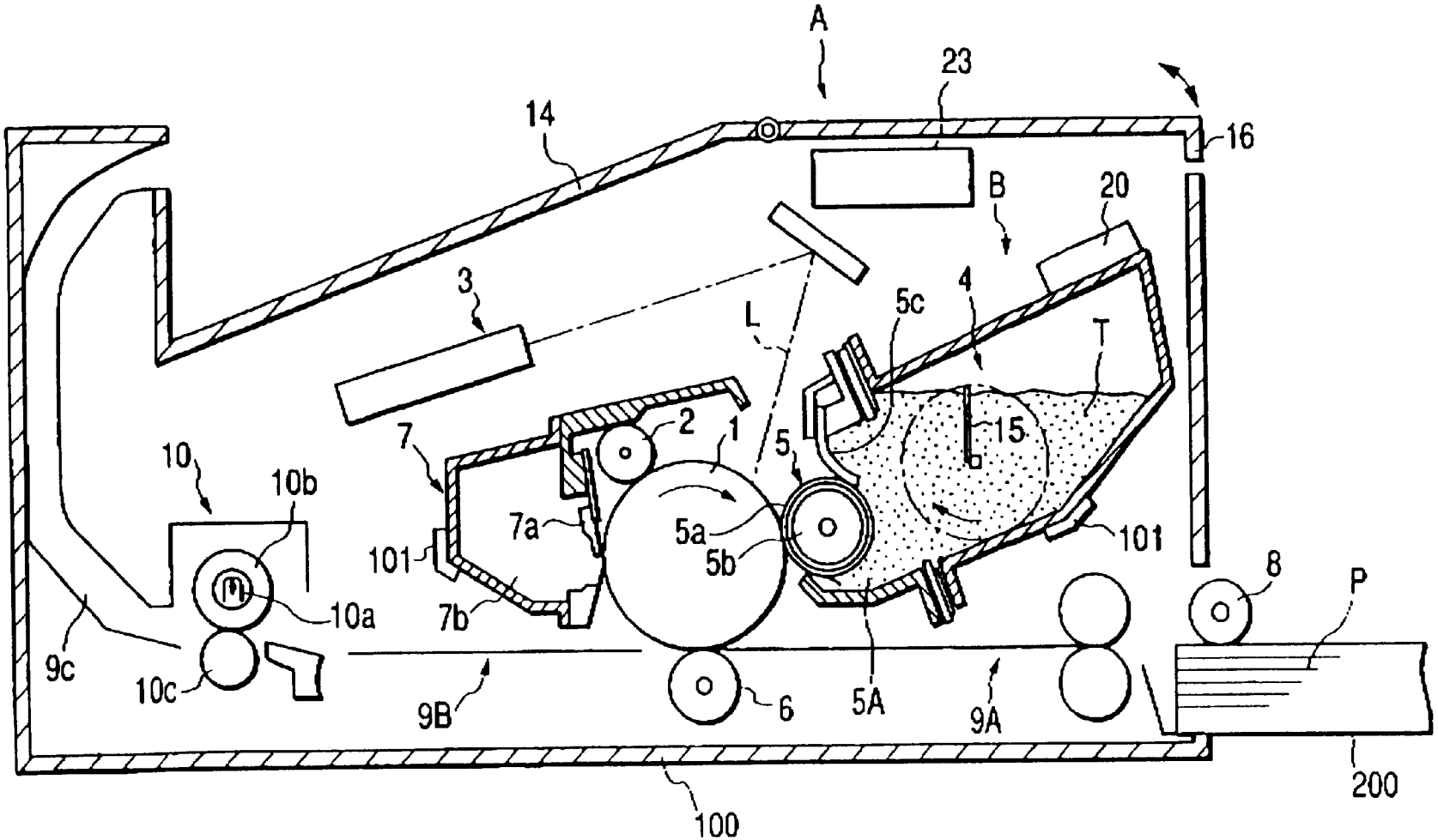
FIG. 1 is a sectional view of one embodiment of a process cartridge and an image forming apparatus according to the present invention.

Firstly, with reference to FIG. 1 and FIG. 2, an example of an electrophotographic image forming apparatus onto which a process cartridge in embodiments 1 to 7 of the present invention is mountable will be described. In the present embodiment, a laser beam printer A of an electrophotographic system is employed as an electrophotographic image forming apparatus and is the one that receives image information from a host computer and forms an image onto recording media such as a recording sheet, OHP sheet and cloth, etc., in an electrophotographic image forming process.

The laser beam printer A has a drum-shaped electrophotographic photosensitive body, that is, a photosensitive drum 1. The photosensitive drum 1 is charged with a charging roller 2 being charging means, and subsequently, receives radiation of a laser beam L corresponding to image information from a laser scanner 3 so that a latent image corresponding with the image information is formed onto the photosensitive drum 1. This latent image undergoes development with developing means 5 to be caused to become a visible image, that is, a toner image.

That is, developing means 5 have a developing chamber 5A which comprises a developing roller 5A as a developer carrier, and a developer T inside a developer containing container 4 as a developer containing portion formed adjacent to the developing chamber 5A is supplied to the developing roller 5*a* of the developing chamber 5A. Agitation means 15 to rotate in the arrowed direction in FIG. 1 are provided inside the developer containing container 4, and these agitation means 15 rotate so that the developer T is supplied to the developing roller 5*a* while it is undergoing relaxation. In the present embodiment, as developer T, an insulated magnetic mono-component toner is used. In addition, the developing roller 5*a* has a fixed magnet 5*b* built-in, and the developing roller 5*a* is caused to rotate so that the developer is conveyed, given a frictional charged charge with a developing blade 5*c* being a developer layer thickness controlling member to be caused to be a developer layer with a predetermined thickness and is supplied to a developing region of the photosensitive drum 1. The developer, that has been supplied to this developing region, is transferred to a latent image on the photosensitive drum 1 to form a toner image. The developing roller 5*a* is brought into connection with a developing bias circuit, and normally a developing bias voltage configured with a direct voltage overlapped onto an alternate voltage is applied thereto.

On the other hand, in synchronization with forming of a toner image, recording media P that are disposed in sheet feeding cassette 200 are conveyed to a transfer position via a pick-up roller 8 and conveying means 9A. In the transfer position, a transferring roller 6 as transfer means is disposed so that application of a voltage transfers a toner image on the photosensitive drum 1 onto the recording media P.

The recording media P having undergone transfer of a toner image is conveyed to fixing means 10 with conveying means 9B. The fixing means 10 comprise a fixing roller 10*b* with a heater 10*a* built-in therein as well as a driving roller 10*c*, and applies heat as well as pressure onto passing recording media P to fix the transferred toner image onto the recording media P.

The recording media P are moved to an emission tray 14 with the conveying means 9C. This emission tray 14 is provided on an upper surface of a main body of the apparatus 100 of a laser beam printer A.

The photosensitive drum 1, after a toner image is transferred onto recording media P with the transfer roller 6, removes residual developer left on the photosensitive drum 1 with cleaning means 7, and thereafter is ready for the next image forming process.

The cleaning means 7 scrapes (scratch) off residual developer on the photosensitive drum 1 with elastic cleaning blade 7*a* provided to get in contact with the photosensitive drum 1 to collect it into a waste developer container 7*b*.

Figure 2:
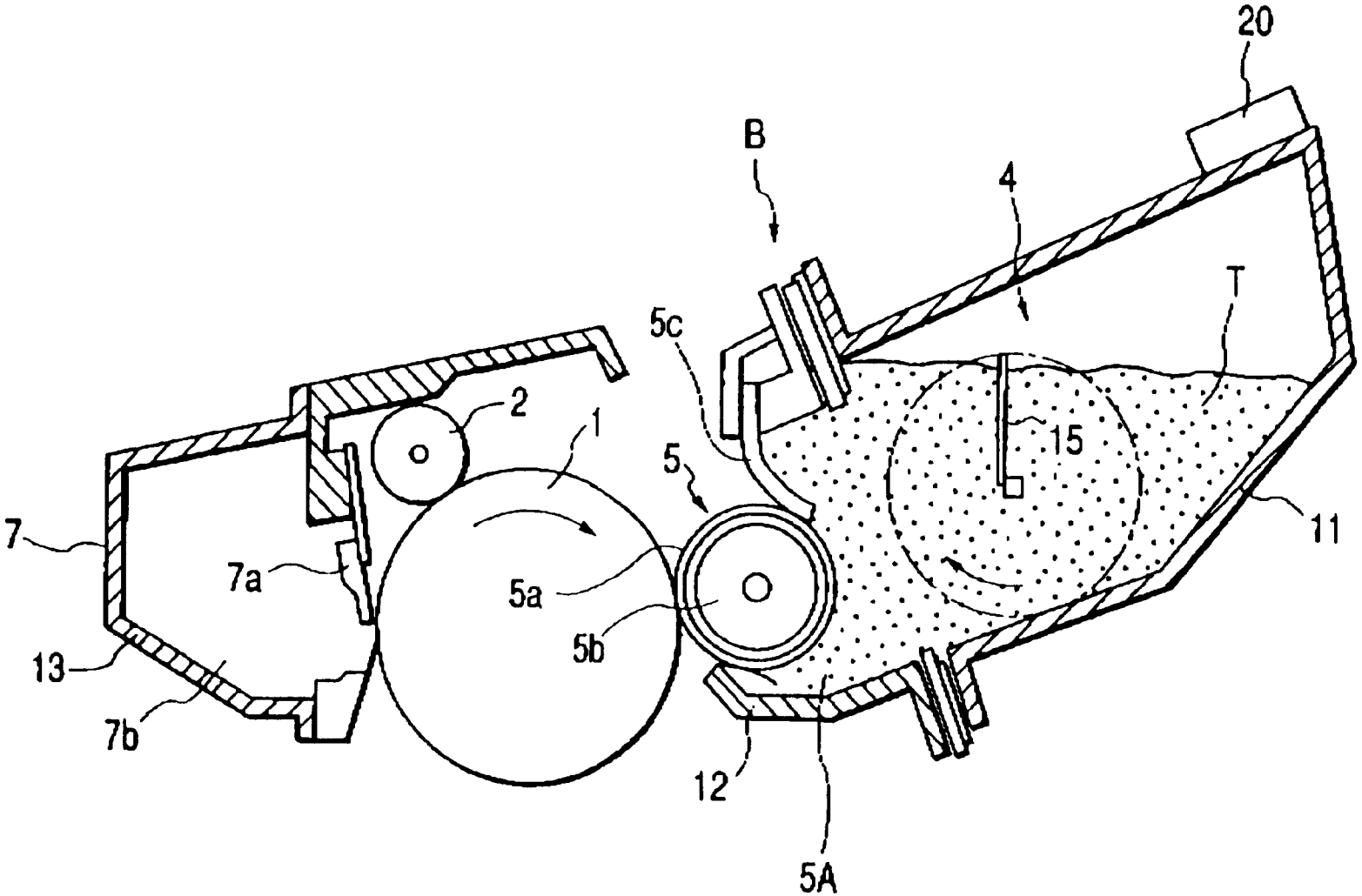
FIG. 2 is an enlarged sectional view of the process cartridge in FIG. 1.

On the other hand, in the present embodiment, the process cartridge B has, as shown FIG. 2, a developing unit which is integrally formed by a developer frame 11 having a developer containing container (developer containing portion) 4 to contain developer as well as agitating means 15 and a developing frame body 12 to hold developing means 5, such as a developing roller 5*a*, as well as a developing blade 5*c*, etc. undergoing welding, and moreover this developing unit is brought into coupling with a cleaning frame body 13 comprising a photosensitive drum 1, cleaning means 7, such as a cleaning blade 7*a*, as well as a waste developer container 7*b*, etc. and a charging roller 2 integrally to form a cartridge.

This process cartridge B is detachably attached to cartridge mounting means 101 (in FIG. 1) provided in a main body of the image forming apparatus 100 by a user.

Figure 3:
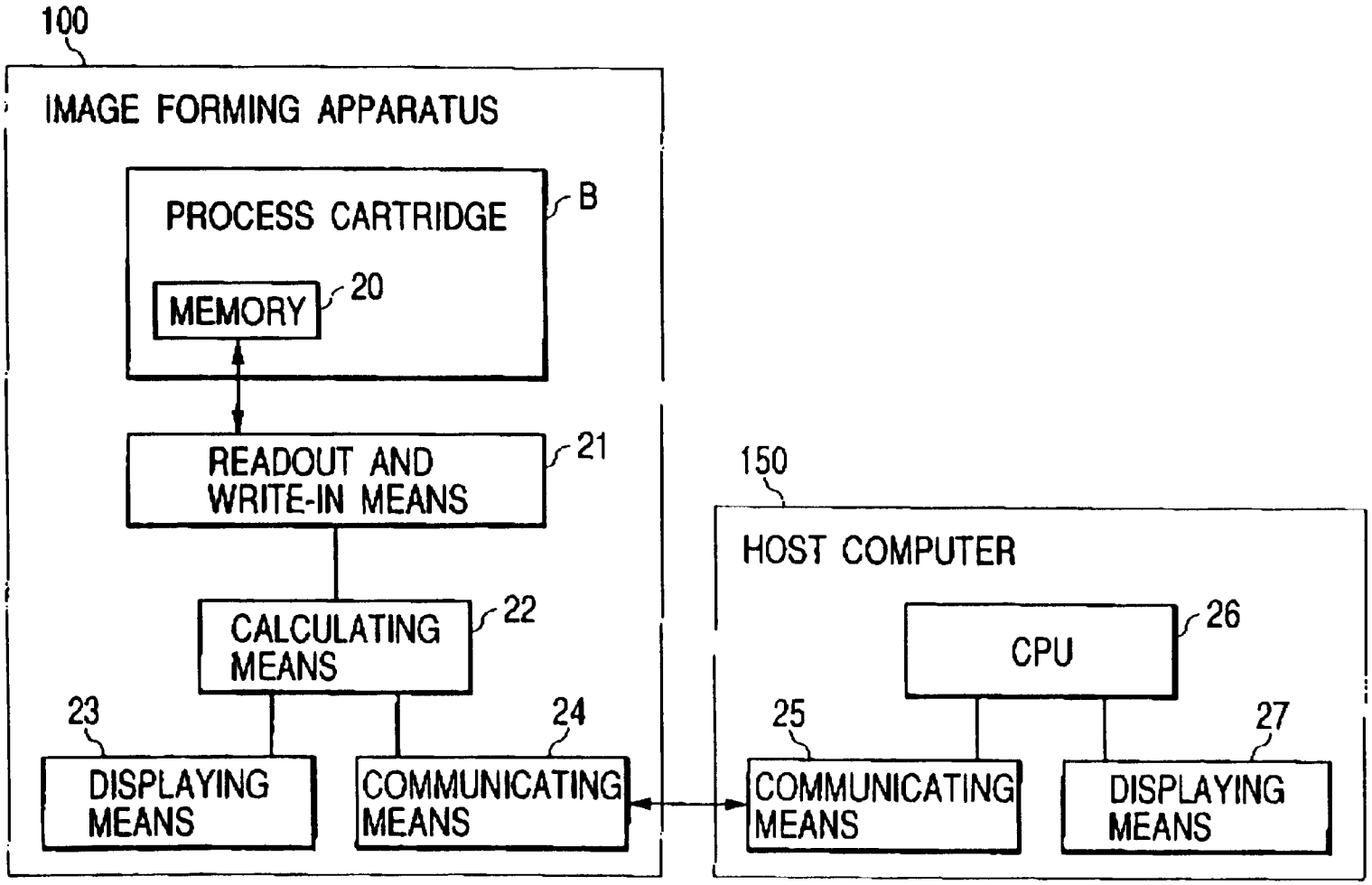
FIG. 3 is a view of an outlined relation of the process cartridge and the image forming apparatus according to the present invention.

Next, with reference to FIG. 3, a method to notify a user with information on the time limit for use of a process cartridge B will be described in accordance with the present invention. FIG. 3 shows the relationship between storing means provided in the process cartridge B of the present embodiment and the main body of the image forming apparatus 100, and moreover a host computer 150 brought into communicable connection with the main body of the image forming apparatus 100. According to the present invention, with the memorizing means installed in the cartridge, a display system displaying the time limit for use of cartridge that can notify a user of information on the time limit for use of cartridge is comprised.

According to the present invention, the process cartridge B comprises a ferroelectricity nonvolatile memory (hereinafter to be referred to as "FeRAM") 20 as the memorizing means. In addition, a side of the main body of the image forming apparatus 100 is provided with a reader-writer 21 being read-out and write-in means, and this reader-writer 21 implements read-out and write-in of information from and toward the FeRAM 20.

For further description, in the present embodiment, the FeRAM 20 being a non-contact type nonvolatile memory having a resonance circuit comprising an antenna and a capacitor is incorporated in the side of the process cartridge B so that electromagnetic waves transmitted from the reader-writer 21 of the side of the main body of the image forming apparatus 100 generate driving power source to enable read-out and write-in from and into FeRAM 20. Accordingly, the side of the process cartridge B does not need any power source and can communicate with the main body of the image forming apparatus 100 without any contact.

In the present embodiment, the FeRAM 20 is arranged to be capable of storing a date when the process cartridge B was manufactured, this date being a standard day to set the time limit for use of the process cartridge B, and stores the date when that process cartridge B was manufactured during a manufacturing step.

In addition, under a state where the process cartridge B is attached to the side of the main body of the image forming apparatus 100, the reader-writer 21 provided in the main body of the image forming apparatus 100 reads out a manufacturing date which is stored in the FeRAM 20 to transmit it to calculating means 22. Utilizing a date when the process cartridge B was manufactured, which is read out from the FeRAM 20, and a time limit from the time when the process cartridge B was manufactured that is stored in a memory portion (not shown) inside the main body of the image forming apparatus 100 in advance, that is, information on the period during which high quality image forming is feasible, calculating means 22 calculates out a date to become a time limit for use of the process cartridge B currently attached in the main body of the image forming apparatus 100. In addition, utilizing a date to become this time limit for use and current date information from a calendar in a controlling portion to control and regulate performance of the image forming apparatus A, a number of days up to the time limit for use of the currently attached process cartridge B is calculated out, and moreover whether or not the currently attached process cartridge B is on duty in excess of its time limit for use from manufacturing date is judged.

Thus calculated, a date to become a time limit for use on the process cartridge B, the number of days up to the time limit for use and moreover in some cases a signal showing that the time limit for use is past is transmitted to displaying means 23 provided in the main body of the image forming apparatus 100 and respective information is communicated to a user. In addition, in the present embodiment, signals on a time limit for use of the process cartridge B from the calculating means 22 are simultaneously inputted into the host computer 150, which is brought into communicable connection with the main body of the image forming apparatus 100 via the communicating means 24 at the side of the main body of the image forming apparatus 100 as well as the communicating means 25 at the side of the host computer 150. Thereafter, CPU (Central Processing Unit) 26 of the host computer 150 causes the displaying means 27 on the host computer 150 to display respective information based on these signals to notify a user of it.

Figure 4:
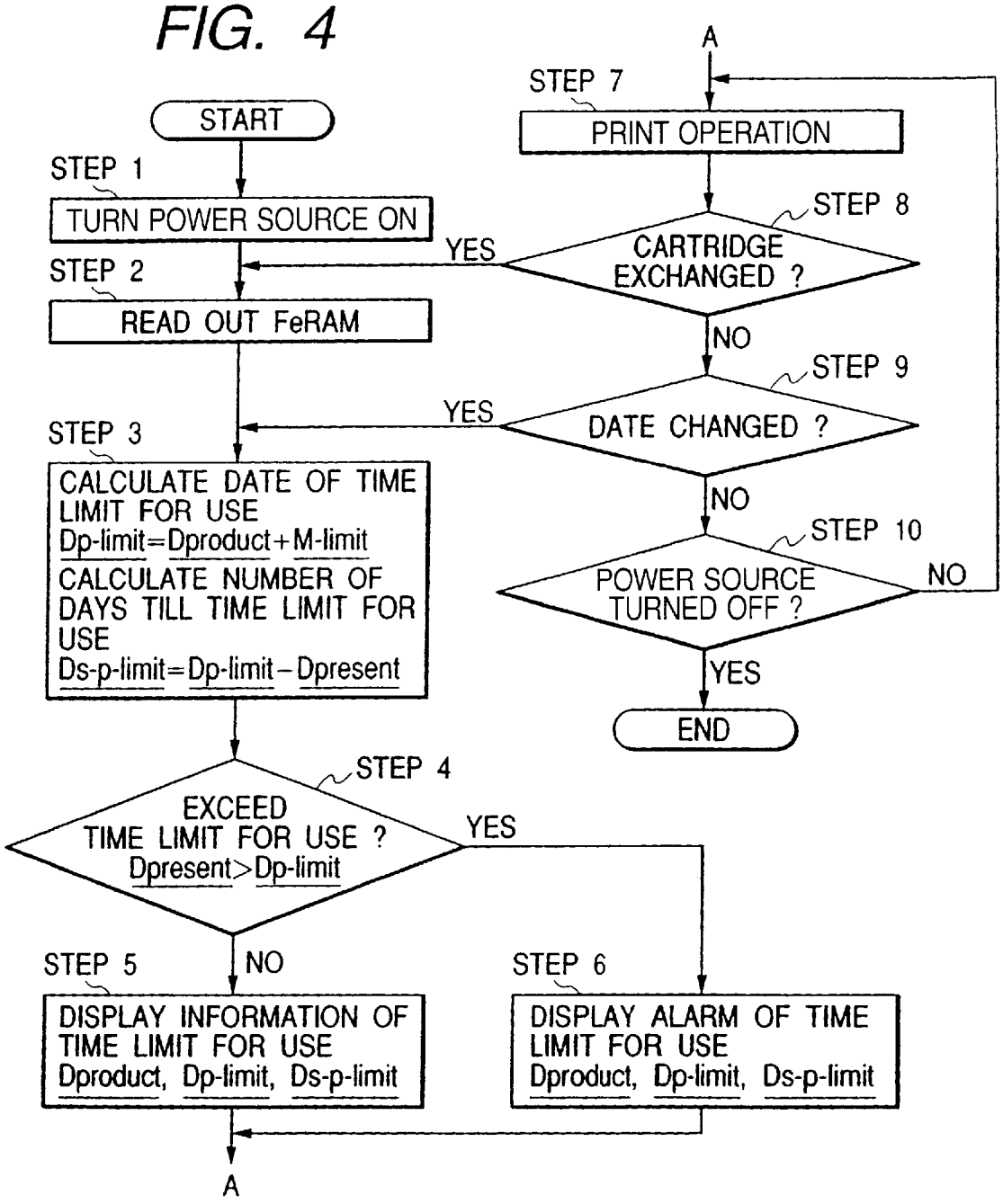
FIG. 4 is a flow chart for explaining the displaying action of a cartridge expiration date of an embodiment 1 according to the present invention.

Next, moreover, with reference to FIG. 4 as well, motion on display of the time limit for use from the time when the process cartridge B is manufactured in use of FeRAM 20 will be described. FIG. 4 shows the above described processing with a flow chart.

According to the present embodiment, when a user turns on the power source of the image forming apparatus A to which the process cartridge B is attached (step 1) or, as described later, the user takes out a new process cartridge B and attaches it to the main body of the image forming apparatus 100 (step 8) under the state where the power source remains on, the image forming apparatus A reads out the information stored in the FeRAM 20 of the process cartridge B with the reader-writer 21 (step 2). In the present embodiment, inside the FeRAM 20, a date when process cartridge B is manufactured (Dproduct) is written in.

Thus, the FeRAM 20 is caused to store the date when the process cartridge B is manufactured so that the main body of the image forming apparatus 100 utilizes the information on the date when that process cartridge B is manufactured and will become able to automatically judge a time limit for use from the time when the process cartridge B is manufactured.

Thereafter, the information read out by the reader-writer 21 is transmitted to the calculating means 22 provided in the main body of the image forming apparatus 100, and from a date when the process cartridge B was manufactured (Dproduct) and a time limit for use from the time when the process cartridge B was manufactured that is stored in a memory portion inside the main body of the image forming apparatus 100 in advance, that is, information on the period during which high quality image forming is feasible, or 30 months in the present embodiment (M-limit), the calculating means 22 calculates a date to become a time limit for use of that process cartridge B (Dp-limit) with the following equation:

$$Dp\text{-limit}=D\text{product}+M\text{-limit}$$

and from the calculated date to become a time limit for use of the process cartridge B (Dp-limit) and the present date (Dpresent) calculates the number of days up to the time limit for use of the process cartridge B (Ds-p-limit) with the following equation:

$$Ds\text{-}p\text{-limit}=Dp\text{-limit}-D\text{present} \quad \text{(step 3)}$$

Subsequently, the calculating means 22 compare the present date (Dpresent) with the date to become a time limit for use from the time when the process cartridge B is manufactured (Dp-limit) to judge whether the time limit period for use is expired (step 4).

In a judgment in step 3, in the case where the time limit period for use is not expired, a signal showing the calculated date to become a time limit for use of the process cartridge B (Dp-limit) and the number of days up to the time limit for use thereof (Ds-p-limit) is transmitted to displaying means 23 of the main body of the image forming apparatus 100 so that a message having a meaning to notify a user of information on a time limit for use of the process cartridge B currently attached to the main body of the image forming apparatus 100 for example "The time limit for use of the cartridge is X (month), Y (Date), Z (Year). It is XX days ahead up to the time limit for use. If you desire a quality output, use within the time limit for use is recommended," etc. is displayed (step 5). At this time, the date when the process cartridge B was manufactured (Dproduct) may be displayed.

In addition, in the judgment of step 3, in the case where the time limit for use is expired, a signal showing information thereof will be sent to displaying means 23 of the main body of the image forming apparatus 100, and a message indicating that the process cartridge B currently attached to the image forming apparatus has past its time limit for use from the time when it was manufactured and suggesting exchange of the process cartridge B or temporary exchange in the case where a high quality image is necessary, saying, for example, "this cartridge has past 30 months since it was manufactured. If you desire a quality output, exchange with a new cartridge is recommended," etc. is displayed (step 6). Thereafter, the image forming apparatus will enter a state of standby (step 7).

Moreover, in the present embodiment, the information as described above is displayed onto displaying means 23 provided in the main body of the image forming apparatus 100, and concurrently, in step 5, a signal showing the date to become a time limit for use of the process cartridge B (Dp-limit) as well as a number of days up to the time limit for use thereof (Ds-p-limit) and, in step 6, a signal showing that the time limit for use of the process cartridge B has past is respectively sent from communicating means 24 at the side of the main body of the image forming apparatus 100 to communicating means 25 of the host computer 150 so that information on a time limit for use of the process cartridge B as that to be displayed onto displaying means 23 of the main body 100 of the image forming apparatus and indicating that the time limit for use has expired are respectively displayed onto displaying means 27 of the host computer 150 via the CPU 26 of the host computer 150. Thus, there is an advantage that display is implemented onto a displaying portion 27 of equipment such as the host computer 150 brought into communicable connection with the image forming apparatus A, etc., so that a time limit for use of the process cartridge B can be grasped while that equipment is being operated.

These operations are implemented at the time when the power source is turned on, the process cartridge is exchanged, and the date is updated. That is, the image forming apparatus A of the present embodiment observes respectively whether the process cartridge B has been exchanged or not (step 8), and whether the date has been changed or not (step 9), under the state where the power source is on, and operations similar to those described above are implemented from the information read-out step (step 2) inside the FeRAM 20 in the case where the process cartridge B has been exchanged or from the calculating step (step 3) of the calculating means 22 using the present date in the case when the date has been changed, so that display in the displaying means 23 and 27 are updated. In addition, whether or not the power source is turned off is judged (step 10), and in the case where the power source has been turned off, display of a time limit for use of the process cartridge B comes to an end. Incidentally, in step 8, whether or not the process cartridge B has been exchanged can be judged by, for example, perceiving an opening/a closing of a door 16 of the main body of the image forming apparatus 100 being an inserting orifice of the process cartridge B.

The user watches the message as described above that is displayed in the displaying means 23 and 27, and thereby can always and easily know a time limit for use from the time when the process cartridge B was manufactured. Therefore, for example, measures as follows will be able to be adopted:

(1) a process cartridge for an exchange is prepared in advance;

(2) in the case where a plurality of laser beam printers A is in use, a process cartridge whose time limit is approaching is reloaded to a printer whose use frequency is more intensive; and (3) when an image which is required for high image quality such as a photographic image, etc. is required, and the like, the process cartridge is exchanged to comply with this necessity.

Thus, according to the present invention, the problem can be prevented that, when a high image quality output is necessary, since a process cartridge B attached into a main body of an image forming apparatus 100 has past a time limit for use from the time when it was manufactured, and a process cartridge B for exchange is not yet ready, the user is informed that image forming with sufficient image quality that a user desires cannot be implemented, so that convenience for users is improved.

Figure 6:
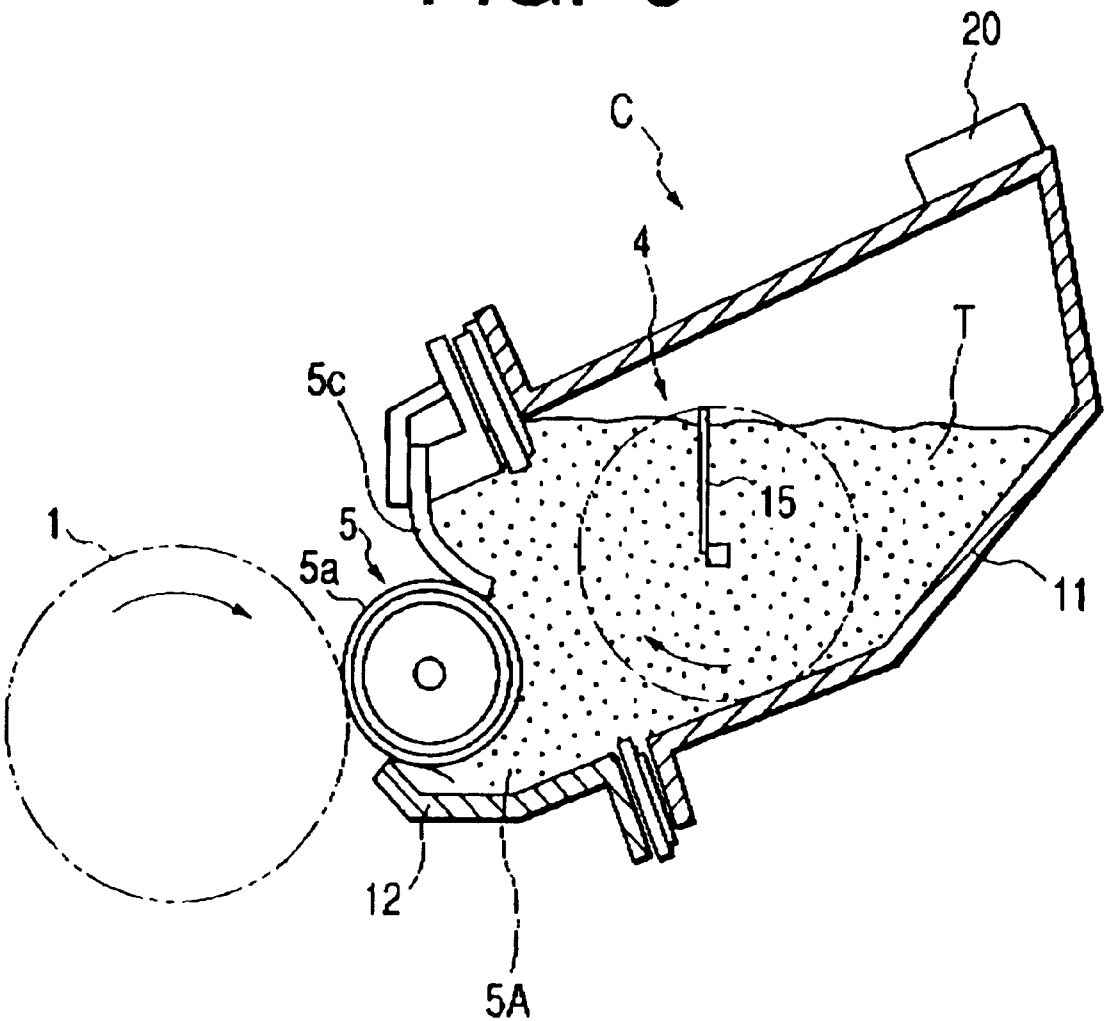
FIG. 6 is a sectional view of an example of a developing cartridge according to the present invention.
Figure 7:
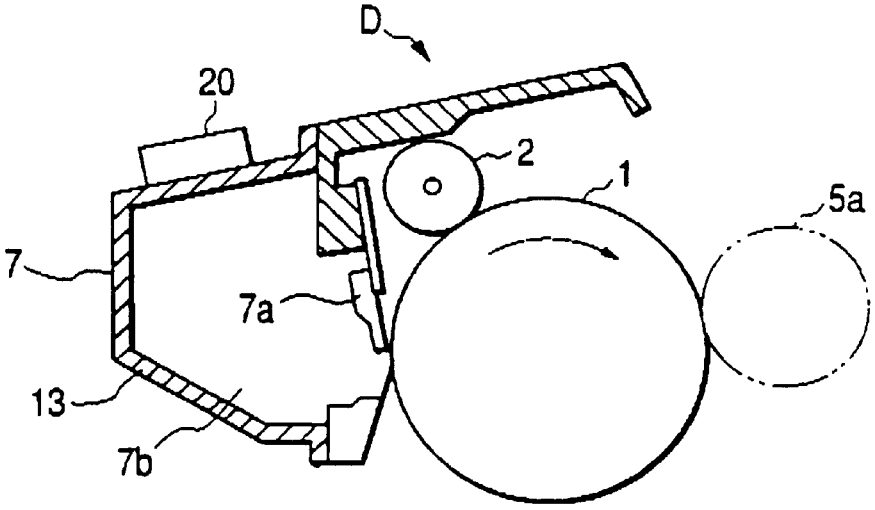
FIG. 7 is a sectional view of an example of a photosensitive body drum cartridge according to the present invention.

In the above described embodiment, the cartridge detachably attachable to the main body of the image forming apparatus 100 has been described to be a process cartridge B which is integrally configured by a photosensitive drum 1, charging means 2 as processing means to act on this photosensitive drum 1, developing means 5 as well as cleaning means 7*a*, and moreover a developer containing container 4 as well as a waste developer container 7*b*, but the cartridge detachably attachable to the main body of the image forming apparatus 100 to which the present invention is applicable will not be limited hereto. FIG. 6 and FIG. 7 respectively show an embodiment of a developing apparatus (developing cartridge) C that was made to be a cartridge being another mode of the present invention as well as a photosensitive drum cartridge D.

That is, similar functions and effects can be attained by providing storage means 20 to a cartridge having a configuration which is detachably attachable to the image forming apparatus and is exchangeable such as, as shown in FIG. 6, a developing cartridge C, which is integrally unitized by a developing chamber 5A comprising a developing roller 5*a* as well as a developing blade 5*c*, etc., developing means, a developer containing container 4 being a developer containing portion with frames 11 and 12 and which is made detachably attachable to the main body of the image forming apparatus 100, and as shown in FIG. 7, a photosensitive drum cartridge D that is integrally unitized by a photosensitive drum 1 and charging means 2, cleaning means 7*a*, and a waste developer container 7*b* and which is made detachably attachable to the main body of the image forming apparatus 100, and similarly applying the present invention described in the above described embodiment.

Next, a variation of the present embodiment will be described. In the above described embodiment, data showing a time limit for use from the time when the process cartridge B is manufactured are configured by calculating a date to become a time limit for use of that process cartridge B (Dp-limit) and a number of a date up to that date (Ds-p-limit) with a date when the process cartridge B was manufactured (Dproduct) that is stored in FeRAM20, which is storing means of the process cartridge B, and a time limit for use thereof from the time when the process cartridge B was manufactured, which information is stored in a storage portion provided in the main body of the image forming apparatus 100 in advance, that is, a period from the time when the process cartridge B was manufactured during which it is usable (M-limit), but as another method, the storage means 20 can be caused to store not only a date when a cartridge was manufactured (Dproduct), but also a time limit for use (M-limit) from the time when the cartridge was manufactured.

By this arrangement, for example in the case where a plurality of kinds of cartridges with different quantities of developer (filling quantity of developer) and different kinds of photosensitive drums 1 are attachable to the main body of the image forming apparatus 100, or in the case where there are respectively different time limits for use from the times when cartridges to be attached to the main body of the image forming apparatus 100 were manufactured, as in the case where a plurality of types of cartridges, such as photosensitive cartridges and developing cartridges, can be separately mounted on a main body of the image forming apparatus 100, the results turn out to be very effective. In this case, the reader-writer 21 at the side of the main body of the image forming apparatus 100 reads out a date when a cartridge was manufactured (Dproduct), as well as a time limit for use from the time when the cartridge was manufactured (M-limit), and notifies users of a date to be a time limit for use (Dp-limit) as in the above described embodiment, the number of dates up to that date (Ds-p-limit), and in some cases the expired time limit for use.

Moreover, storage means of a cartridge can be caused to store a date to become a time limit for use of a cartridge (Dp-limit) itself. In this case, there is an advantage that calculating means are not required, and a date to become a time limit for use can be displayed immediately after the power source is put on. Of course, thereafter, a judgment on the number of dates from the date to become a time limit for use and the present date to the number of dates to reach a time limit for use and whether or not a time limit for use is expired can be implemented with calculating means. Incidentally, in this aspect, it is not always necessary to cause the date when the process cartridge B was manufactured to be stored inside the storage means.

As described so far, according to the present invention, the date to become a time limit for use from the time when a cartridge was manufactured as well as the number of dates up to the time limit for use are calculated and displayed so that the information can be notified to users, and thereby the users can use the cartridge within a time limit for use from the time when it was manufactured, to form a high quality image as much as possible, and also in the case where a time limit for use has expired, the users can adopt such measures as to obtain a high quality image output in accordance with necessity.

Embodiment 2

An image forming apparatus of the present embodiment, which is basically caused to be similar to the image forming apparatus 100 of the embodiment 1, is different from the embodiment 1 in the date to become a reference for a time limit for use of a cartridge. That is, in the embodiment 1, the date to become a reference for a time limit for use of a cartridge was a date when the cartridge was manufactured, but in the present embodiment, it will be a commencement for use of a cartridge. Accordingly, members having the same function as well as the same configuration will be given the same symbol and a description in detail thereof will be omitted.

FIG. 3 shows the relationship between memorizing means provided in the process cartridge B, the main body of the image forming apparatus 100, and moreover a host computer brought into communicable connection with the main body of the image forming apparatus 100, which will be caused to be same as the one described in the embodiment 1.

That is, according to the present embodiment, an FeRAM 20, being storage means to be provided in the process cartridge B, is arranged to be capable of storing a date when use of the process cartridge B starts being a reference date, which is used to set a time limit for use of the process cartridge B, and when the process cartridge B is newly attached to the main body of the image forming apparatus 100, a reader-writer 21 being reading-out/writing-in means at the side of the main body of the image forming apparatus 100 makes the FeRAM 20 store the date when use of the process cartridge B starts.

Thereafter, from the date when use of this process cartridge B starts, and a time limit for use from the time when use of the process cartridge B starts, which is previously stored, for example, in a storing portion inside the main body of the image forming apparatus 100, that is, a period from the date when use starts and during which a high quality image forming operation is feasible, the date to become a time limit for use from the time when use of the process cartridge B starts is calculated, and with the present date the number of days to reach a time limit for use as well as whether or not a time limit for use has expired is judged so that as in the embodiment 1, information on a time limit for use of the process cartridge B, and moreover a warning that it has exceeded the time limit for use is displayed in displaying means 23 of the main body of the image forming apparatus 100 and displaying means 27 of the host computer 150 brought into communicable connection with the main body of the image forming apparatus 100 to notify users thereof.

Figure 5:
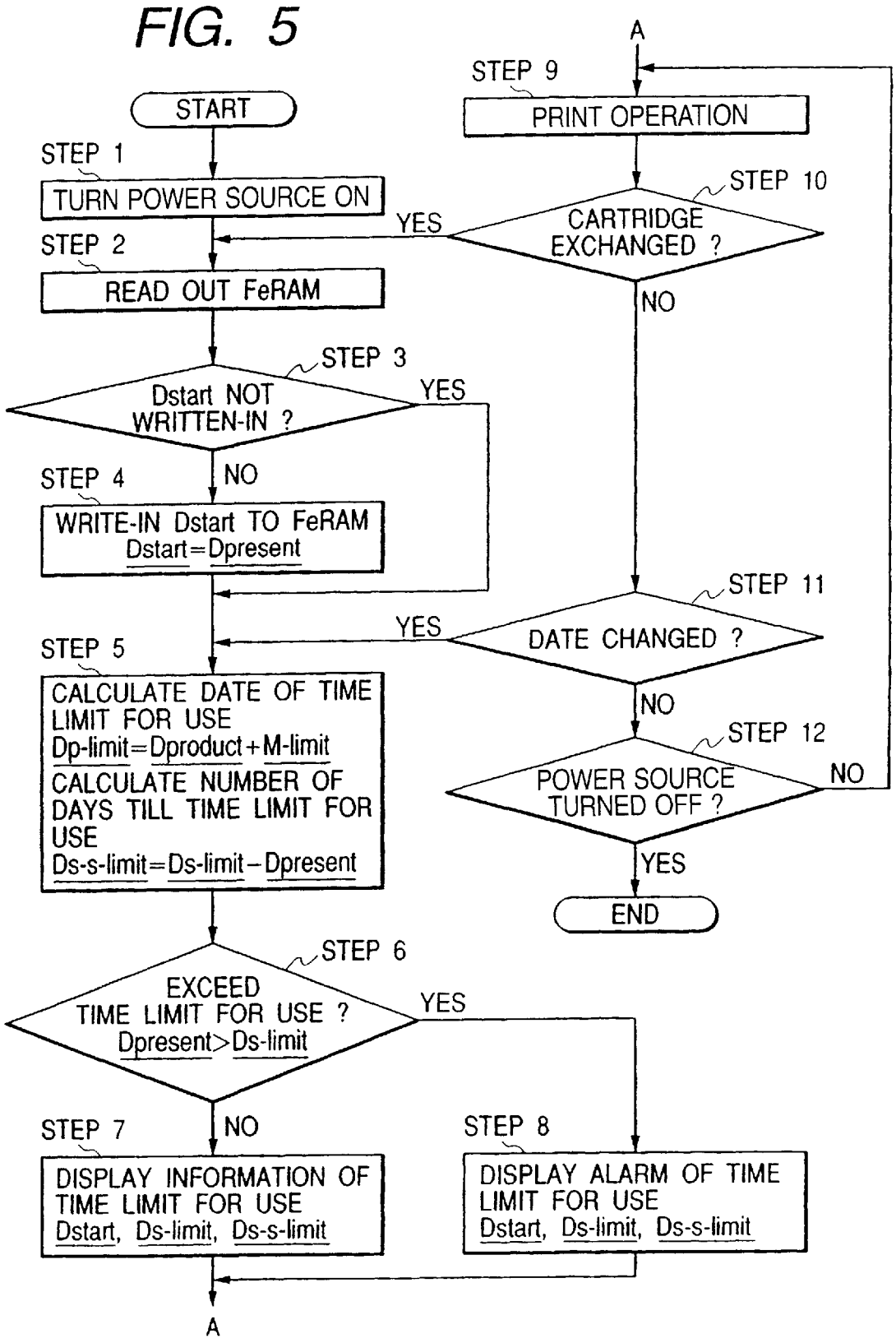
FIG. 5 is the flow chart for explaining the displaying action of a cartridge expiration date of an embodiment 2 according to the present invention.

Next, moreover, with reference to FIG. 5 as well, the display of information on the time limit for use from the time when use of the process cartridge B starts in use of FeRAM 20 will be described.

According to the present embodiment, when a user puts on the power source of the image forming apparatus A to which the process cartridge is attached (step 1) or, as described later, the user takes out a new process cartridge B from a wrapping member and attaches it to the main body of the image forming apparatus 100 (step 10) under the state where the power source remains on, the image forming apparatus A reads out the information stored in the FeRAM 20 of the process cartridge B with the reader-writer 21 (step 2) to judge whether or not the attached process cartridge B is a new one (step 3).

In the present embodiment, when date information (Dstart) is not yet written in the region inside the FeRAM 20 where the date (Dstart) when use of the process cartridge B started, the image forming apparatus 100 will judge that process cartridge B is a new one.

In the step 3, when the process cartridge B attached to the main body of the image forming apparatus 100 is judged to be a new one, the main body of the image forming apparatus 100 will write the present date (Dpresent) into a region inside the FeRAM 20 where the reader-writer 21 stores the date (Dstart) when use of the process cartridge B started (step 4).

In addition, in step 3, in the case where the process cartridge B attached to the main body of the image forming apparatus 100 is judged not to be a new one, the date (Dstart) when use of the process cartridge B started, which is stored inside the FeRAM 20, will be used without any change in accordance with a sequence as follows.

Thus, the storage means 20 of the process cartridge B is caused to store the date (Dstart) when use of the process cartridge started so that, also in the case where the process cartridge B is taken out from the main body of the image forming apparatus 100 in the midst of use of the apparatus and that process cartridge is incorporated into another image forming apparatus, a time limit for use from the time when use of the process cartridge B started will become able to be judged, likewise.

Thereafter, the information read out by the reader-writer 21 is transmitted to the calculating means 22 provided in the main body of the image forming apparatus 100, and from a date when use of the process cartridge B started (Dstart) and a time limit for use from the time when use of the process cartridge B started that is stored in a storing portion inside the main body of the image forming apparatus 100 in advance, that is, information on the period during which a high quality image forming operation is feasible, or is 18 months in the present embodiment (Ms-limit), the calculating means 22 calculates a date to become a time limit for use of that process cartridge B from the time when use thereof started (Ds-limit) with the following equation:

$$Ds\text{-limit}\text{-}Dstart+Ms\text{-limit}$$

and from the calculated date to become a time limit for use of the process cartridge B (Ds-limit) and the present date (Dpresent) calculates a number of days up to the time limit for use of the process cartridge B (Ds-p-limit) with the following equation:

$$Ds\text{-}s\text{-limit}=Ds\text{-limit}\text{-}Dpresent. \text{ (step 5)}$$

Subsequently, the calculating means 22 compares the present date (Dpresent) with the date to become a time limit for use from the time when use of the process cartridge B started (Ds-limit) to judge whether the time limit period for use is expired (step 6).

In a judgment in step 6, in the case where the time limit period for use is not expired, a signal showing the calculated date to become a time limit for use of the process cartridge B (Ds-limit) and a number of days up to the time limit for use thereof (Ds-s-limit) is transmitted to displaying means 23 of the main body of the image forming apparatus 100 so that a message having a meaning to notify a user of information on a time limit for use of the process cartridge B currently attached to the main body of the image forming apparatus 100 for example "The time limit for use of the cartridge is X (Month), Y (Date), Z (Year). It is XX days ahead up to the time limit for use. If you desire a quality output, use within the time limit for use is recommended," etc. is displayed (step 7). At this time, the date when use thereof started (Dstart) may be displayed.

In addition, in the judgment of step 6, in the case where the time limit for use is expired, a signal showing information thereof will be sent to displaying means 23 of the main body of the image forming apparatus 100, and a message indicating that the process cartridge B currently attached to the image forming apparatus has past its time limit for use from the time when use thereof started and suggesting exchange of the process cartridge B or temporary exchange in the case where a high quality image is necessary, saying, for example, "This cartridge has past 18 months since use thereof started. If you desire a quality output, exchange with a new cartridge is recommended," etc. is displayed (step 8). Thereafter, the image forming apparatus will enter a state of standby (step 9).

Moreover, in the present embodiment, the information as described above is displayed onto displaying means 23 provided in the main body of the image forming apparatus 100, and concurrently, in step 7, a signal showing the date to become a time limit for use of the process cartridge B (Ds-limit) as well as a number of days up to the time limit for use thereof (Ds-s-limit) and, in step 8, a signal showing that the time limit for use of the process cartridge B has past is respectively sent from communicating means 24 at the side of the main body of the image forming apparatus 100 to communicating means 25 of the host computer 150 so that information on a time limit for use of the process cartridge B and indicating that the time limit for use has expired, as described above, are respectively displayed onto a displaying portion 27 of the host computer 150 via the CPU 26 of the host computer 150. As in the embodiment 1, there is an advantage that display is performed on a displaying portion 27 of a piece of equipment, such as the host computer 150 brought into communicable connection with the image forming apparatus A, etc., so that a time limit for use of the process cartridge B can be grasped while that equipment is being operated.

These operations are, as in the embodiment 1, implemented at the time when the power source is turned on, the process cartridge is exchanged, and the date is updated. In the present embodiment, operations similar to those described above are implemented from the information read-out step (step 2) inside the FeRAM 20 in the case where the process cartridge B is judged to have been exchanged (step 10) or from the calculating step (step 5) of the calculating means 22 using the present date in the case when the date is judged to have been changed (step 11), so that display in the displaying means 23 and 27 are updated. In addition, whether or not the power source is put off is judged (step 10) , and in the case where the power source has been put off, display of a time limit for use of the process cartridge B comes to an end.

The user watches the message as described above that is displayed in the displaying means 23 and 27, and thereby, for example, various measures such as (1) to (3) described in the embodiment 1 can be adopted.

Thus, according to the present invention, such a problem can be prevented that in spite of the necessity of a high image quality output, since a process cartridge B attached into a main body of an image forming apparatus 100 has past a time limit for use from the time when use thereof started, and a process cartridge B for exchange is not yet ready, image forming with sufficient image quality that a user desires cannot be implemented, so that convenience for users is improved.

Incidentally, as in the embodiment 1, the present invention that was described in the present embodiment can be applied to a developing cartridge C as well as a photosensitive drum cartridge D as respectively shown in FIG. 6 and FIG. 7 and similar functions and effects are obtainable.

In addition, as a judging method for judging whether or not the process cartridge B is a new product, a physical switch, such as existence or non-existence of an interfering member or information for making a judgment on a new product inside storing means of the process cartridge B may be held separately, but, as in the present embodiment, judging with a date when use of the process cartridge B started will be an advantage that it will not be necessary to prepare them separately.

Next, a variation of the present embodiment will be described. In the above described embodiment, data showing a time limit for use from the time when the process cartridge B is manufactured are configured by calculating a date to become a time limit for use of that process cartridge B from the time when use thereof started (Ds-limit) and a number of days up to that date (Ds-s-limit) with a date when use of the process cartridge B started (Dstart) that is stored in FeRAM20, which is storing means of the process cartridge B, and a time limit for use thereof from the time when use of the process cartridge B started, which information is stored in a storage portion provided in the main body of the image forming apparatus 100 in advance, that is, a period from the time when use of the process cartridge B started during which it is usable (Ms-limit). As another method, the storage means can be caused to store not only a date when use of the process cartridge B started, but also a time limit for use (Ms-limit) from the time when use of the process cartridge B started.

By this arrangement, for example, in the case where a plurality of kinds of cartridge with different quantities of developer (filling quantity of developer) and different kinds of photosensitive drums 1 are attachable to the main body of the image forming apparatus 100, or in the case where there are respectively different time limits for use from times when use of cartridges to be attached to the main body of the image forming apparatus 100 started as in the case where a plurality of kinds of cartridges, such as photosensitive cartridges and developing cartridges, can be mounted on the main body of the image forming apparatus 100, the results will be very effective. In this case, the reader-writer 21 at the side of the main body of the image forming apparatus 100 writes to a new cartridge a date when use thereof started (Dstart), or reads in a date when use of a cartridge, which is already in use, started (Dstart), and in addition reads out a time limit for use from the time when use of that cartridge started (Ms-limit) that is stored inside the storage means in advance, and notifies users of the date to be a time limit for use (Ds-limit) as in the above described present embodiment, the number of days up to that date (Ds-s-limit), and moreover in some cases, the expired time limit for use.

Moreover, storage means of a cartridge can be caused to store a date to become a time limit for use of a cartridge (Ds-limit) itself after calculation. By this arrangement, the image forming apparatus calculates the time limit for use of the cartridge from the time when use thereof started (Ds-limit) only once and that will be enough and therefore there is an advantage that a date to become a time limit for use can be displayed without any calculating means immediately after the power source of the image forming apparatus is subsequently turned on. Of course, thereafter, a judgment on the number of days from the date to become a time limit for use and the present date to the number of days to reach a time limit for use and whether or not a time limit for use is expired can be implemented with calculating means. In addition, in this case, it is not always necessary to cause the date when use of the process cartridge B started to be stored inside the storage means.

As described so far, according to the present invention, the date to become a time limit for use from the time when use of a cartridge started as well as the number of days up to the time limit for use are calculated and displayed so that users can be notified of the information, and thereby the users can use the cartridge within a time limit for use from the time when use thereof started and can form a high quality image as much as possible, and also in the case where a time limit for use has expired, the users can adopt such measures as to obtain a high quality image output in accordance with necessity.

Incidentally, in the embodiments 1 and 2, described was the case where systems, to notify users of information on the time limit for use from the time when the cartridge was manufactured and from the time when use thereof started, used storage means provided in the process cartridge B that were respectively provided individually, but a configuration having both of them is feasible. That is, as in the embodiments 1 and 2, 30 months being the time limit for use of the process cartridge B from the time when it was manufactured and 18 months being the time limit for use from the time when use thereof started are set so that the date when the process cartridge B was manufactured is caused to be stored inside the FeRAM 20, being the storage means provided in the process cartridge B during a manufacturing step, and simultaneously a region where the date when use of the process cartridge B started is stored is provided inside this FeRAM 20. In addition, as in the above described embodiments 1 and 2, a date to become a time limit for use from the time when it was manufactured (Dp-limit) and a date to become a time limit for use from the time when use thereof started (Ds-limit) are respectively calculated so that moreover, for example, both dates undergo comparison to give rise to a judgment on the number of days up to the time limit for use, and on whether or not the time limit for use has expired for the date that causes the time limit for use to expire earlier, and that information may well be displayed as information regarding the time limit for use of the cartridge on displaying means as described in the embodiments 1 and 2. Of course, information on both of the time limit for use from the manufacturing date and the time limit for use from the time when use thereof started may be displayed simultaneously. In addition, it is obvious that another embodiment described in the embodiments 1 and 2 can also be brought into combination.

In addition, in the above described respective embodiments, as storage means to store the date when the process cartridge B was manufactured, and the date when use of the process cartridge B started, etc., the FeRAM 20 being a memory of the non-contact type, was used. As a result, the present invention has such an advantage that it is not necessary to provide the side of the process cartridge B with any power source, and in addition, the side of the process cartridge B can read/write information in a non-contact fashion at the side of the main body of the image forming apparatus 100, but will not be limited hereto and with the feasibility of storing information, there will be no particular regulation, and for example, the one in which an EEPROM or a volatile memory and backup battery are combined may well be used.

Moreover, in each of the above described embodiments, display onto the displaying means may be performed by either the displaying means 23 of the main body of the image forming apparatus 100 or the displaying means 27 of the host computer 150. In addition, the displaying method by the displaying means is not limited to the message described above, either, and only dates can be displayed. In addition, such methods that the number of days up to the time limit for use are counted down and displayed, or the remaining number of days up to the time limit for use is displayed by a bar graph, and moreover an alarm provided by turning on an LED provided in the main body of the image forming apparatus, or such method that information on the time limit for use of the cartridge is recorded into recording media to be outputted can be used.

Embodiment 3

Next, an embodiment 3 of the present invention will be described.

Firstly, with reference to FIG. 1 and FIG. 2, an embodiment of an electrophotographic image forming apparatus onto which a process cartridge configured in accordance with the present invention is mountable will be described. In the present embodiment, a laser beam printer A of an electrophotographic system is employed as electrophotographic image forming apparatus and is the one that receives image information from a host computer and forms an image onto recording media such as a recording sheet, a OHP sheet and cloth, etc. in an electrophotographic image forming process.

The laser beam printer A has a drum-shaped electrophotographic photosensitive body, that is, a photosensitive drum 1. The photosensitive drum 1 is charged with a charging roller 2 being charging means, and subsequently, undergoes irradiation from a laser beam L corresponding to image information from a laser scanner 3 so that a latent image corresponding with the image information is formed onto the photosensitive drum 1. This latent image undergoes development with developing means 5 to be caused to become a visible image, that is, a toner image.

That is, developing means 5 have a developing chamber 5A, which comprises a developing roller 5*a* as a developer carrier, and a developer T, inside a developer containing container 4 as a developer containing portion formed adjacent to the developing chamber 5A, is supplied to the developing roller 5*a* of the developing chamber 5A. Agitation means 15 to rotate in the arrowed direction in FIG. 1 are provided inside the developer containing container 4, and these agitation means 15 rotate so that the developer T is supplied to the developing roller 5*a* while it is undergoing rotation. In the present embodiment, as developer T, an insulated magnetic mono-component toner is used. In addition, the developing roller 5*a* has a fixed magnet 5*b* built-in, and the developing roller 5*a* is caused to rotate so that the developer is conveyed, given a frictional charged charge with a developing blade 5*c* being a developer layer thickness controlling member to be caused to be a developer layer with a predetermined thickness and is supplied to a developing region of the photosensitive drum 1. The developer, that has been supplied to this developing region, is transferred to a latent image on the photosensitive drum 1 to form a toner image. The developing roller 5*a* is brought into connection with a developing bias circuit, and normally a developing bias voltage configured with a direct voltage overlapped onto an alternate voltage is applied thereto.

On the other hand, in synchronization with forming of a toner image, recording media P that are disposed in sheet feeding cassette 200 are conveyed to a transfer position via a pick-up roller 8 and conveying means 9A. In the transfer position, a transferring roller 6 as transfer means is disposed so that application of a voltage transfers a toner image on the photosensitive drum 1 onto the recording media P.

The recording media P having undergone transfer of a toner image is conveyed to fixing means 10 with conveying means 9B. The fixing means 10, which comprise a fixing roller 10*b* with a heater 10*a* built-in therein as well as a driving roller 10*c*, applies heat as well as pressure onto passing recording media P to fix the transferred toner image onto the recording media P.

The recording media P are ejected to an emission tray 14 with the conveying means 9C. This emission tray 14 is provided on an upper surface of a main body of the apparatus 100 of a laser beam printer A.

The photosensitive drum 1 after a toner image is transferred onto recording media P with the transfer roller 6 removes a residual developer left on the photosensitive drum 1 with cleaning means 7, and thereafter is ready for a next image forming process. The cleaning means 7 scratch off residual developer on the photosensitive drum 1 with an elastic cleaning blade 7*a* provided to come in contact with the photosensitive drum 1 to collect it into a waste developer container 7*b*.

On the other hand, in the present embodiment, the process cartridge B has, as shown FIG. 2, a developing unit, which is integrally formed by a developer frame 11 having a developer containing container (developer containing portion) 4 to contain developer as well as agitating means 15 and a developing frame body 12 to hold developing means 5, such as a developing roller 5*a* as well as a developing blade 5*c*, etc. undergoing sealing, and moreover this developing unit is brought into coupling with a cleaning frame body 13 comprising a photosensitive drum 1, cleaning means 7 such as a cleaning blade 7*a*, as well as a waste developer container 7*b*, etc., and a charging roller 2 integrally to form a cartridge.

This process cartridge B is detachably attached to cartridge mounting means 101 (in FIG. 1) provided in a main body of the image forming apparatus 100 by a user.

According to the present invention, the image forming apparatus has a cartridge using amount detecting device to detect the using amount of the cartridge.

Figure 8:
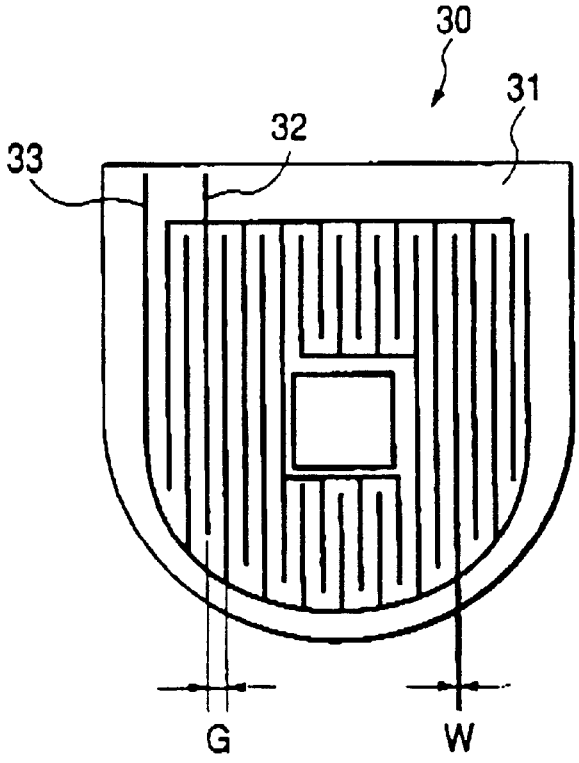
FIG. 8 is a view showing means for detecting a developer quantity usable according to the present invention.

According to the present embodiment, the image forming apparatus A has as a cartridge using amount detecting device a developer amount detecting device comprising a developer residual amount perceiving means 30 that can detect that residual amount successively in accordance with the consumption of the developer T inside the developer containing container 4. In the present embodiment, on a side wall inside a surface of the developer containing container 4, a planar antenna 30, being developer residual amount detecting means, as shown in FIG. 8, is disposed.

The planar antenna 30 is the one in which a conductive pattern comprising a pair of electrodes 32 and 33 is formed on a widely used print substrate 31 by etching or printing, etc. In addition, in order to protect this circuit figure, a protecting film (now shown) is formed on the conductive pattern. The conductive pattern may be set appropriately, and in the present embodiment, respective widths (W) of the pair of electrodes 32 and 33 of this planer antenna 30 have been made narrow to reach 300 $\mu$m and the gap (G) of the both electrodes 32 and 33 to reach around 300 $\mu$m.

In the planar antenna 30 of the present embodiment, when 200 Vpp, 2000 Hz was applied as an alternate bias between the pair of electrodes 32 and 33 configuring the conductive pattern, different capacitances were observed, that is, 30 pF when the developer was not brought into contact with the planar antenna 30, and 60 pF when the developer was brought into contact with the planar antenna 30 all over. Disposition of this planar antenna 30 on the side wall of the inner surface of the developer containing container 4 gives rise to a reduction of contact area between the developer T and the planar antenna 30 in accordance with reduction of the developer T inside the developer containing container 4, and observation of the capacitance between both electrodes 32 and 33 of the planar antenna 30 enables the amount of developer T inside the developer containing container 4 to be measured at any time. In addition, for example, with a conversion table obtained in advance that is stored inside storage means provided in a process cartridge B to be described in detail later or storage means that the main body of the image forming apparatus 100 has, a developer amount detecting portion (not shown) provided in the main body of the image forming apparatus 100 successively detects the using amount percentage of the developer Rt (%), that is, what percent was used compared with the case when use of the developer did not take place.

Figure 9:
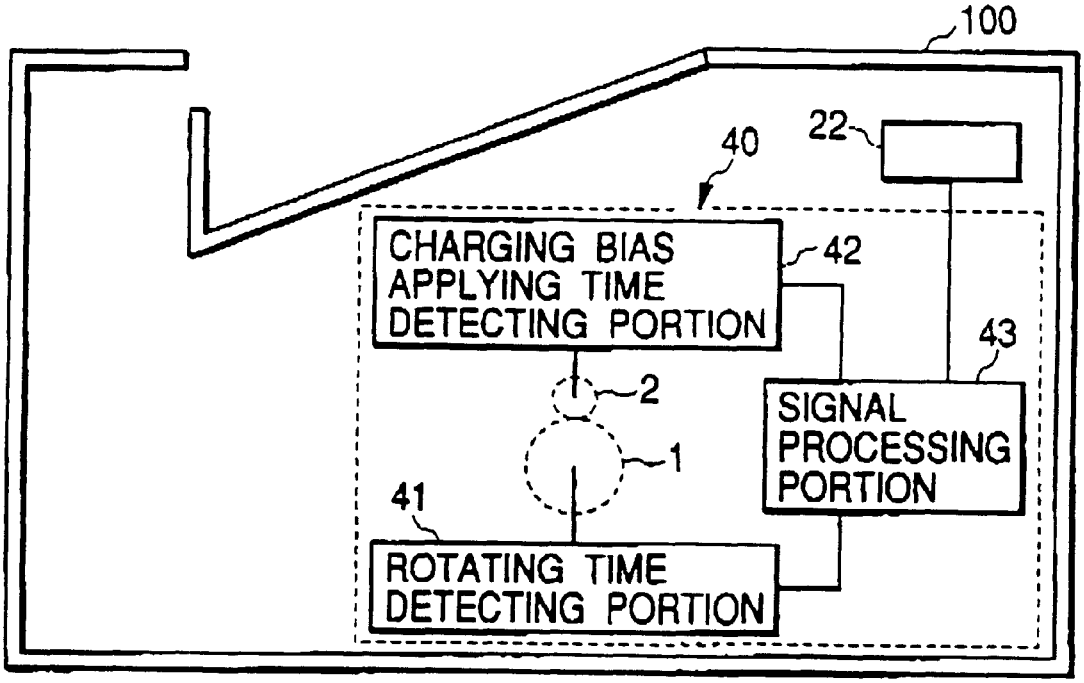
FIG. 9 is an outlined schematic diagram for explaining an apparatus to detect a used amount of the photosensitive body drum usable for embodiments 3 to 5 according to the present invention.

Moreover, according to the present embodiment, the image forming apparatus A has a photosensitive drum using amount detecting device that can detect the using amount of the photosensitive drum 1 as a cartridge using amount detecting device. In the present embodiment, the photosensitive drum using amount detecting device has, as shown in FIG. 9, a rotating time detecting portion 41 to detect the rotating time of the photosensitive drum 1 in a rotation supporting portion of the photosensitive drum 1, a charging bias applying time detecting portion to detect the time when a charging bias was applied to a photosensitive drum 1 from a charging roller 2, and a signal processing portion 43, wherein the signal processing portion 43 carries out an operation by the following converting equation involving an integrated value (Tdr) on rotating time data of the photosensitive drum 1 from a rotation supporting portion of the photosensitive drum 1, integrated results (Tbias) on the charging roller bias applying time data from the charging bias applying time detecting portion and a predetermined weighing coefficient a:

$$S=T\text{bias}+Tdr\times a$$

to obtain the using amount (S) of the photosensitive drum 1. In addition, thereafter, for example, bringing the results into comparison with a predetermined life value (Send) of the photosensitive drum 1 that is stored in storage means 20 provided in the process cartridge B to be described in detail later or a storage portion (not shown) of the main body of the image forming apparatus 100, a percentage Rd % of the using amount of the photosensitive drum 1, that is, what percent was consumed, compared with the case when use of the photosensitive drum 1 did not take place, is detected successively.

Figure 10:
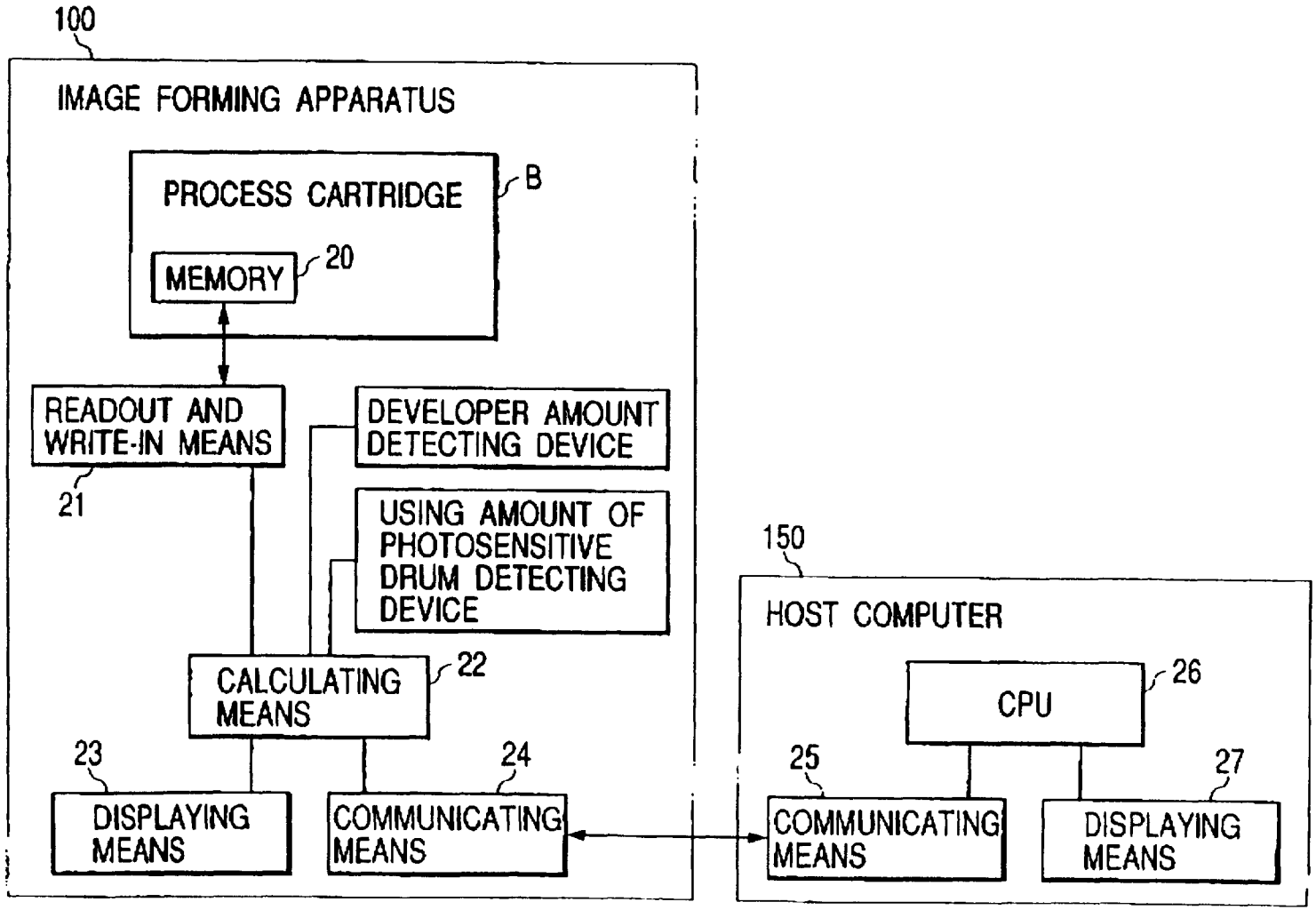
FIG. 10 is a view of the outlined relation of the process cartridge and the image forming apparatus according to the embodiments 3 to 5 of the present invention.

Next, with reference to FIG. 10, according to the present invention, a method to display using amount information characteristic for a user will be described. According to the present invention, a cartridge using an amount displaying system that can notify a user of information on the cartridge using amount characteristic for a user is configured with storage means that the cartridge comprises. FIG. 10 shows the relationship between memorizing means provided in the process cartridge B of the present embodiment and the main body of the image forming apparatus 100, and moreover a host computer 150 brought into communicable connection with the main body of the image forming apparatus 100.

According to the present invention, the process cartridge B comprises a ferroelectricity nonvolatile memory (hereinafter to be referred to as "FeRAM") 20 as memorizing means. In addition, a side of the main body of the image forming apparatus 100 is provided with a reader-writer 21 being read-out and write-in means, and this reader-writer 21 implements read-out and write-in on information toward the FeRAM 20.

For a further description, in the present embodiment, the FeRAM 20, being a non-contact type nonvolatile memory having a resonance circuit comprising an antenna and a capacitor, is incorporated in the side of the process cartridge B so that electromagnetic waves, transmitted from the reader-writer 21 of the side of the main body of the image forming apparatus 100, generate a driving power source to enable read-out from and write-in into FeRAM 20. Accordingly, the side of the process cartridge B does not need any power source and can communicate with the main body of the image forming apparatus 100 without any contact.

In the present embodiment, an FeRAM 20 is arranged to be capable of storing a date when use of the process cartridge B starts, and when the process cartridge B is newly attached to the main body of the image forming apparatus 100, a reader-writer 21 of the main body of the image forming apparatus 100 writes onto the FeRAM 20 the date when use of the process cartridge B started via the resonance circuit 20*a* of the side of the process cartridge B. In addition, the reader/writer 21 reads out the date when use of the process cartridge B started that was stored inside the FeRAM 20, and sends it to calculating means 22 that is brought into electrical connection with the reader/writer 21 inside the main body of the image forming apparatus 100.

In addition, the calculating means 22 is brought into electrical connection with the above described developer amount detecting means being the cartridge using amount detecting device as well as the photosensitive drum using amount detecting device, and respectively the developer using amount percentage Rt (%) detected by the developer using amount detecting device as well as photosensitive using amount percentage Rd (%) detected by the using amount detecting device for the photosensitive drum 1 is inputted thereto.

The calculating means 22, thus, utilizes the date when use of the process cartridge B started that was read out from the FeRAM 20 and the developer using amount percentage Rt (%) as well as the using amount percentage Rd (%) for the photosensitive drum 1 inputted from the developer amount detecting device as well as the photosensitive drum using amount detecting device to calculate information on the using amount of the process cartridge B characteristic for a user, as described in detail later, as each value of a process cartridge using rate per unit number of days, the number of days per unit process cartridge using rate, the remaining number of using days up to the end of life or an alarm point of the life of the process cartridge, and a date of the end of life or an alarm point of life of the process cartridge.

Each of the thus calculated signals showing the using amount of the process cartridge B are sent to displaying means 23 provided in the main body of the image forming apparatus 100 and each information is notified to the user. In addition, in the present embodiment, signals on the using amount of the process cartridge B from the calculating means 22 are simultaneously inputted to a host computer 150 brought into communicable connection with the main body of the image forming apparatus 100 via communicating means 24 at the side of the main body of the image forming apparatus 100, as well as the communicating means 25 at the side of the host computer 150. Thereafter, CPU (Central Processing Unit) 26 of the host computer 150 causes the displaying means 27 on the host computer 150 to display respective information based on these signals to notify the user of this information.

Figure 11:
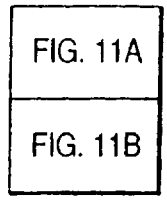
FIG. 11 comprises FIGS. 11A and 11B showing a flow chart for explaining the displaying action of the used quantity of the cartridge of the embodiment 3 according to the present invention.
Figure 11A:
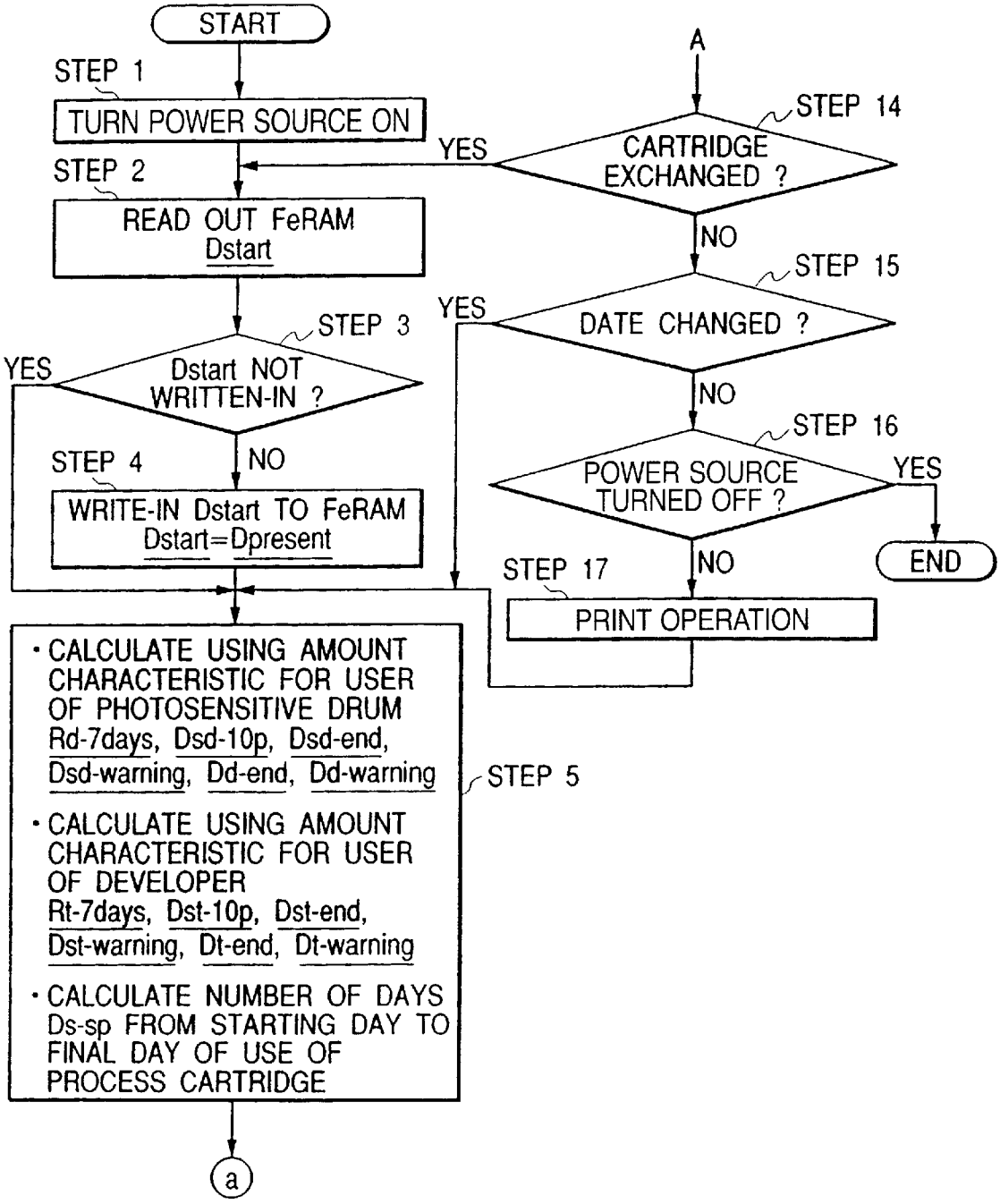
Figure 11B:
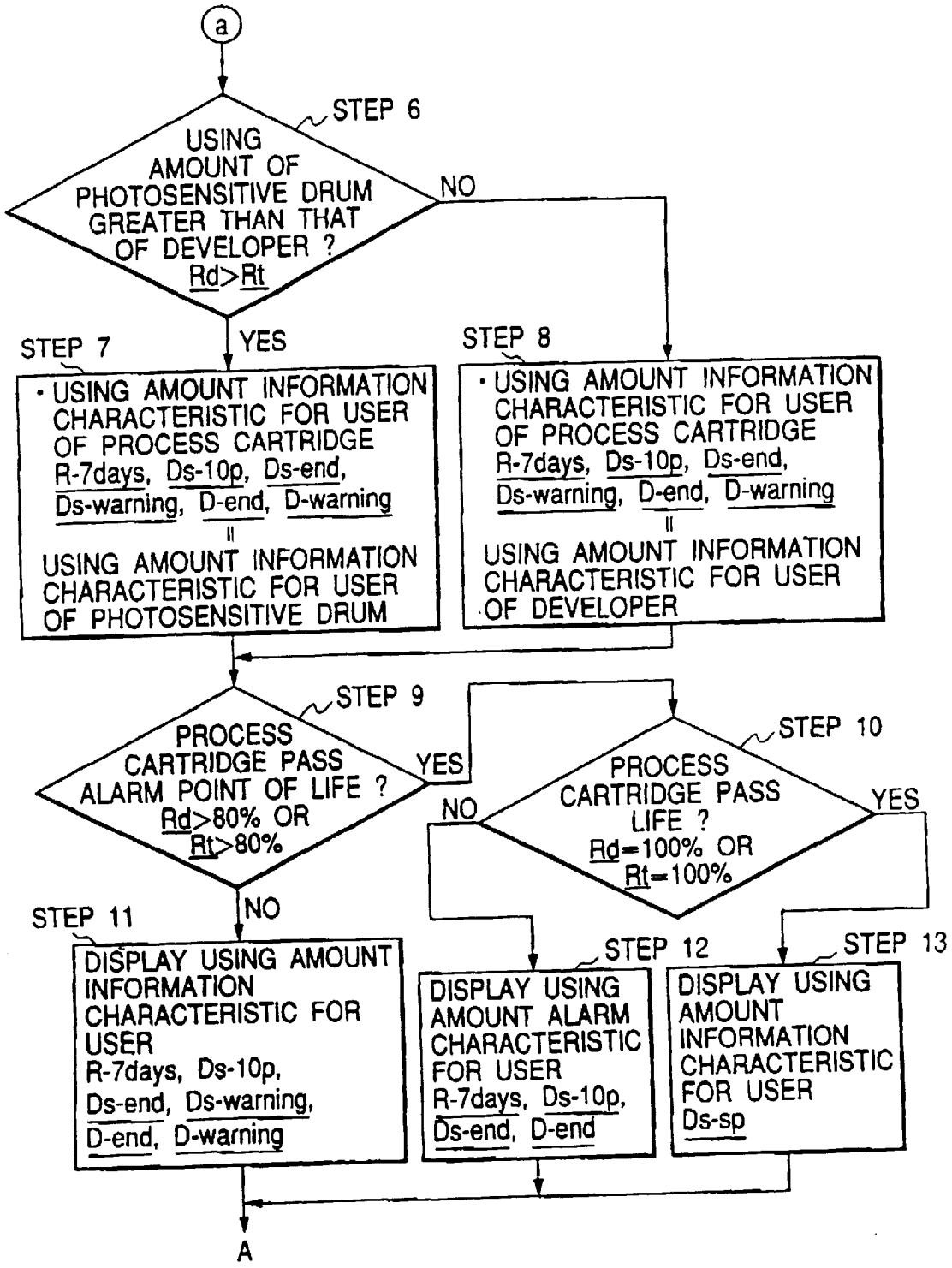

Next, moreover, with reference to FIGS. 11A and 11B as well, the operation of the display of the using amount characteristic for a user of the process cartridge B using the storage means (FeRAM) 20 will be described. FIGS. 11A and 11B show the above described processing with a flow chart.

According to the present embodiment, when a user turns on the power source of the image forming apparatus A to which the process cartridge B is attached (step 1) or, as described later, the user takes out a new process cartridge B from a wrapping member and attaches it to the image forming apparatus (step 14) under the state where the power source remains on, the image forming apparatus A reads out the information stored in the FeRAM 20 of the process cartridge B with the reader-writer 21 (step 2) to judge whether or not the attached process cartridge B is a new one (step 3).

In the present embodiment, when date information (Dstart) is not yet written in the region inside the FeRAM 20 where the date (Dstart) when use of the process cartridge B started, the image forming apparatus 100 will judge that process cartridge B is a new one.

In the step 3, when the process cartridge B attached to the main body of the image forming apparatus 100 is judged to be a new one, the main body of the image forming apparatus 100 will write the present date (Dpresent), that is obtained from a calendar controlling portion (not shown) to supervise/control the operation of the image forming apparatus A, into a region inside the FeRAM 20 where the reader-writer 21 stores the date (Dstart) when use of the process cartridge B started (step 4). In addition, in step 3, in the case where the process cartridge B attached to the main body of the image forming apparatus 100 is judged not to be a new one, the date (Dstart) when use of the process cartridge B started which is stored inside the FeRAM 20 will be used without any change in accordance with a sequence as follows.

Thus, the storage means 20 of the process cartridge B is caused to store the date (Dstart) when use of the process cartridge B started so that, also in the case where the process cartridge B is taken out from the main body of the image forming apparatus 100 in the midst of use and that process cartridge is incorporated into another image forming apparatus, a date (Dstart) when use of the process cartridge B started will become able to be identified likewise.

Thereafter, the information read out by the reader-writer 21 is transmitted to the calculating means 22 provided in the main body of the image forming apparatus 100, and based on a date when use of the process cartridge B started (Dstart) stored in FeRAM 20 and a consumption level of the process cartridge B obtained with a developer amount detecting device as well as a photosensitive drum using amount detecting device, the calculating means 22 calculates the using amount information characteristic for a user of the process cartridge B (step 5).

In the present embodiment, calculated as using amount information characteristic for user is:

(A) a process cartridge using rate per unit number of days (R-7 days (%));

(B) the number of days per unit process cartridge using rate (Ds-10p (%));

(C) the number of remaining using days (Ds-end) up to the end of life or a number of remaining using days (Ds-warning) up to an alarm point of the life of the process cartridge; and (D) the date of the end of life (D-end) or an alarm point of life (D-warning) of the process cartridge.

Here, in the present embodiment, for calculating the using amount information characteristic for a user of the process cartridge B, at first both of a using amount percentage Rt (%) of the developer and a using amount percentage Rd (%) of the photosensitive drum 1, respectively, individually undergo calculation on the using amount information of the developer and the using amount information of the photosensitive drum 1. Thereafter, both percentages undergo comparison to determine the element that has undergone more consumption, that is, comes up with the largest using amount, as the using amount information of the entire process cartridge B. However, since that calculating method is almost the same for the using amount of the developer and of the using amount of the photosensitive drum 1, here, described will be calculations using the using amount percentage of the photosensitive drum 1 Rd (%), that is:

(a1) the photosensitive drum using rate per unit number of days (Rd-7 days (%));

(b1) the number of days per unit photosensitive drum using rate (Dsd-10p (%));

(c1) the number of remaining using days (Dsd-end) up to the end of life or the number of remaining using days (Dsd-warming) up to an alarm point of the life of the photosensitive drum; and (d1) the date of the end of life (Dd-end) or an alarm point of the life (Dd-warming) of the photosensitive drum.

At first, the using amount information of the photosensitive drum 1 (a1) "a photosensitive drum using rate per unit number of days (Rd-7 days (%))," in order to obtain the above described information (A), is determined by calculating the number of days from the time when use of the process cartridge B started to the present time from the date when use of the process cartridge B started (Dstart) and the present date (Dpresent), dividing the using amount percentage Rd(%) of the photosensitive drum 1 with that number of days, and multiplying the unit number of days. In the present embodiment, 7 days were set as the unit number of days. Incidentally, it is preferable that the unit number of days is appropriately set depending on the kind of cartridge or image forming apparatus, for example, that a longer unit number of days is taken for a process cartridge with a long enduring life. That is, the above described information (a1) is calculated by the following equation:

$$Rd\text{-}7\ \text{days}\ (\%)=Rd/(D\text{present-}D\text{start})\times 7\ (\%).$$

Next, the using amount information of the photosensitive drum 1 (b1) "a number of days per unit photosensitive drum using rate (Dsd-10p (%))," in order to obtain the above described information (B), that has a reciprocal meaning of the above described information (a1) ((Rd-7 days (%)), is given by independently calculating the number of days from the time when use started to the present time as in the case of the above described information (a1), dividing the using amount percentage Rd(%) of the photosensitive drum 1 with that number of days, and multiplying the unit using the percentage. In the present embodiment, 10% was set as the unit using percentage. Incidentally, the unit using percentage can be appropriately selected, and, for example, setting with 100% may be regarded as a number of days to use up one process cartridge B. That is, the above described information (b1) is calculated by the following equation:

$$Dsd\text{-}10p(\%)=(D\text{present-}D\text{start})/\text{Rd}\times 10.$$

In addition, the using amount information of the photosensitive drum 1 (c1) "a number of remaining using days (Dsd-end) up to the end of life or the number of remaining using days (Dsd-warming) up to an alarm point of the life of the photosensitive drum," in order to obtain the above described information (C), is determined by calculating, in the present embodiment, the using amount percentage Rd(%) of the photosensitive drum 1 with a time point when the using amount percentage reaches 100% being set as the end of the cartridge's life and a time point when the using amount percentage reaches 80% as an alarm point and with subtraction of the present using amount percentage Rd(%) of the photosensitive drum 1 from the respective percentage (100% or 80%), dividing the above unit using percentage (10% in the present embodiment), and moreover multiplying the number of days per unit photosensitive drum using rate (Dsd-10p (%)) given as the above-described information (b1). That is, the above-described information (c1) is calculated by the following equation:

$$Dsd\text{-end}=(100\text{-}Rd)/10\times Dsd\text{-}10p$$

$$Dsd\text{-warning}=(80\text{-}Rd)/10\times Dsd\text{-}10p.$$

Moreover, the using amount information of the photosensitive drum 1 (d12) "a date of the end of life (Dd-end) or an alarm point of life (Dd-warning) of the photosensitive drum," in order to obtain the above described information (D), is determined by adding the number of remaining using days (Dsd-end) up to the end of the cartridge's life or a number of remaining using days (Dsd-warming) up to an alarm point of the life of the photosensitive drum obtained as the abovedescribed information (c1) to the present date (Dpresent). That is, the above described information (d1) is calculated by the following equation:

$$Dd\text{-end-}D\text{present}+Dsd\text{-end}$$

$$Dd\text{-warning}=D\text{present}+Dsd\text{-warning}.$$

With a calculation similar to the above-described one, for the using amount percentage of the developer Rt (%), calculated is the developer using amount information as follows in order to obtain the above described information (A) to (D):

(a2) the developer using rate per unit number of days (Rt-7 days (%))[.];

(b2) [a] the number of days per unit developer using rate (Dst-10p (%))[.];

(c2) [a] the number of remaining using days (Dst-end) up to the time when no developer is left or [a] the number of remaining using days (Dst-warning) up to an alarm point for warning that no developer is left[.]; and (d2) [a] the date when no developer is left (Dt-end) or [a] the date of an alarm point when no developer is left (Dt-warning).

Next, the calculated using amount information of the photosensitive drum 1 and the developer undergoes comparison (step 6) to [regard information of] determine the [party that has shown] larger using amount, [that is, passes] which determines the cartridge element that will end its life earlier, and selects the larger amount as the using amount information characteristic for user of the process cartridge B shown in the above described (A) to (D) (step 7 and step 8).

In addition, in the present embodiment, in step 5, [a] the number of days from the day when use of the process cartridge started to the present time (Ds-sp) is separately calculated by the following equation:

$$Ds\text{-}sp = D\text{present} - D\text{start}.$$

Thereafter, for describing the case where, for example, with judgment in step 6 it was judged that the using amount information of the photosensitive drum 1 (a1) to (d1) is treated as cartridge using amount information characteristic for a user (A) to (D), it is judged whether or not the using amount percentage of the photosensitive drum 1 Rd (%) passes an alarm point of life, that is, 80% in the present embodiment (step 9).

In a judgment in step 9, in the case where an alarm point of the life of the process cartridge B currently attached to the main body of the image forming apparatus 100 [is] has not [passed] ended, a signal selected in step 7 and showing the cartridge using amount information characteristic for user (A) to (D) at the present time point is transmitted to displaying means 23 of the main body of the image forming apparatus 100. And then, the [above described] above-described information (A) to (D) is respectively displayed and a message having a meaning to notify a user of the cartridge using amount information characteristic for a user, for example, such as "You are using the process cartridge 'R-7 days' (%) a week. If you continue using it at this pace, the life thereof will come to an end around 'D-end'. It is recommended that a spare cartridge will be ready by around 'D-warning'," etc., is displayed (step 11).

In addition, in a judgment in step 9, in the case where an alarm point of the life of the cartridge is passed, a judgment is made on whether or not the using amount percentage Rd(%) of the photosensitive drum 1 indicates that the drum has reached the end of [the] its life (100%) (step 10), and in the case where it has not [past the] ended its life, as in the [above described] above-described step 11, the cartridge using amount information characteristic for user the (A) to (D) at the present time point (but except the number of days up to the alarm point and the date of the alarm point,) is displayed on the displaying means 23 of the main body of the image forming apparatus 100, and a message having a meaning to notify the cartridge using amount information characteristic for a user, and [suggest to] suggesting that the user make a new process cartridge B ready for example, such as "If you continue using the cartridge at this pace, the life thereof will come to an end in 'Ds-end' days. Please make a spare cartridge at your earliest convenience," etc., is displayed.

In addition, in a judgment in step 10, in the case where the process cartridge B is judged to have [past] ended its life, it is displayed that the process cartridge B has reached the end of its life and a message having a meaning to notify a user of the cartridge using amount information characteristic for a user, for example, such as "the process cartridge has reached the end of its life. You used up this cartridge in 'Ds-sp' days," etc., is displayed.

Moreover, the image forming apparatus A in the present embodiment displays the information as described above onto displaying means 23 provided in the main body of the image forming apparatus 100, and concurrently transmits the cartridge using amount information characteristic for a user from communicating means 24 of the main body of the image forming apparatus 100 to communicating means 25 of the host computer 150 so as to display the contents as described above onto displaying means 27 of the host computer 150 via the CPU 26 of the host computer 150. Thus, there is an advantage that display is implemented onto displaying means of an equipment such as the host computer 150 brought into communicable connection with the image forming apparatus A, etc., so that the using amount of the process cartridge B can be grasped while that equipment is being operated.

These motions are implemented at the time when the power source is [put] turned on, the process cartridge B is exchanged, and the date is updated. That is, the image forming apparatus A of the present embodiment observes respectively whether the process cartridge B has been exchanged or not (step 14), and whether the date has been changed or not (step 15), under the state where the power source is [put] turned on. Therefore, [motions] operations similar to those described above are implemented from the readout step (step 2) of information stored inside the FeRAM 20 in the case where the process cartridge B has been exchanged or from the calculating step (step 5) of the calculating means 22 using the present date (Dpresent) for calculation in the case when the date has been changed, so that display in the displaying means 23 and 27 are updated. In addition, the image forming apparatus A judges whether or not the power source is [put] turned off (step 16), and in the case where the power source has not been [put] turned off, the cartridge will enter a state of standby of image forming [motions] operations (step 17). And in the case where the power source has been [put] turned off, display of a time limit for use of the process cartridge B comes to an end. Incidentally, in step 14, whether or not the process cartridge B has been exchanged can be judged by, for example, detecting an opening/a closing of a door 16 of the main body of the image forming apparatus 100 being an inserting orifice of the process cartridge B.

The user watches the message as described above that is displayed in the displaying means 23 and 27, and thereby can know [a] the level of frequency in use of the process cartridge B by the user himself/herself or the user group and will become capable of judging:

concretely for about how many days the present cartridge can be kept in use[.];

approximately when a spare cartridge should be ready[.]; and not only how much of the process cartridge B is consumed, but also how much cost is incurred within a constant period.

This will enable a user to get an appropriate number of spare cartridges at an appropriate timing. Therefore, according to the present invention, such an event that images [cannot help being] are discontinued [outputting] from being output due to lack of spare cartridges, in spite [that] of the cartridge [has reached its] reaching the end of its life, can be prevented from taking place.

Incidentally, inside the storage means provided in the cartridge, not only the date when use of the process cartridge started, but also, for example[;], using amount information of the developer or a photosensitive drum may be stored and information on a new product of cartridge, etc. may be stored.

There is such an advantage that, by storing using amount information of a developer or a photosensitive drum into the storage means of the cartridge, for example, by using information inside the storage means of the cartridge in the case where immediately after the power source of the image forming apparatus is [put] turned on[,] and a using amount of developer (%)[,] and a using amount of the photosensitive drum (%) cannot be perceived, [that is,] by using a developer using amount (%) and the using amount of photosensitive drum (%), etc. at the [of] final use of the image forming apparatus stored inside the storage means of the cartridge to calculate the cartridge using amount information characteristic for a user as in the [above described] abovedescribed [the] present embodiment, quickly after the power source of the image forming apparatus is [put] turned on, they can be displayed.

In addition, as a judging method for determining whether or not the process cartridge B is a new product, a physical switch [such as] operating by determining the existence or non-existence of an interfering member or information for making a judgment on a new product inside storing means of the process cartridge B may be held separately, but, as in the present embodiment, judging with a date when use of the process cartridge B started will [served to] be [an advantage] advantageous in that it will not be necessary to prepare them separately.

Embodiment 4

Next, another embodiment of the present invention will be described. An image forming apparatus of the present embodiment shall basically be similar to the image forming apparatus in the embodiment 3, but information to be stored in storage means provided in a cartridge is different. That is, in the embodiment 1, the storage means of the cartridge is caused to store a date when use of the cartridge B started, but in the present embodiment, in addition to the date when use of the cartridge started, a final date when the cartridge was used, is caused to be stored.

The present embodiment, which will be described in conformity with the image forming apparatus A as well as the process cartridge B shown in FIG. 1 and FIG. 2, comprises FeRAM 20 being storage means provided in the process cartridge B that is arranged to be able to store the date when use of the process cartridge B started, and the final date when the process cartridge B was used, that is, the date when the final image output took place.

In addition, in the present embodiment, the date when use of the process cartridge B started, the final date when the process cartridge B was used and developer using amount percentage Rt (%) [perceived] detected by the developer amount detecting device, as well as photosensitive drum using amount percentage Rd (%) [perceived] detected by the photosensitive amount detecting device are utilized to calculate and display information on the using amount of the process cartridge B characteristic for a user, as described in detail later, as each value of a process cartridge using rate per unit number of days, [a] the number of days per unit process cartridge using rate, [a] the remaining number of using days up to the end of life or an alarm point of the life of the process cartridge, and [a] the date of the end of life or an alarm point of the life of the process cartridge.

Figure 12:
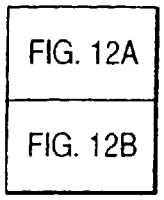
FIG. 12 comprises FIGS. 12A and 12B showing a flow chart for explaining the displaying action of the used quantity of the cartridge of the embodiment 4 according to the present invention.
Figure 12A:
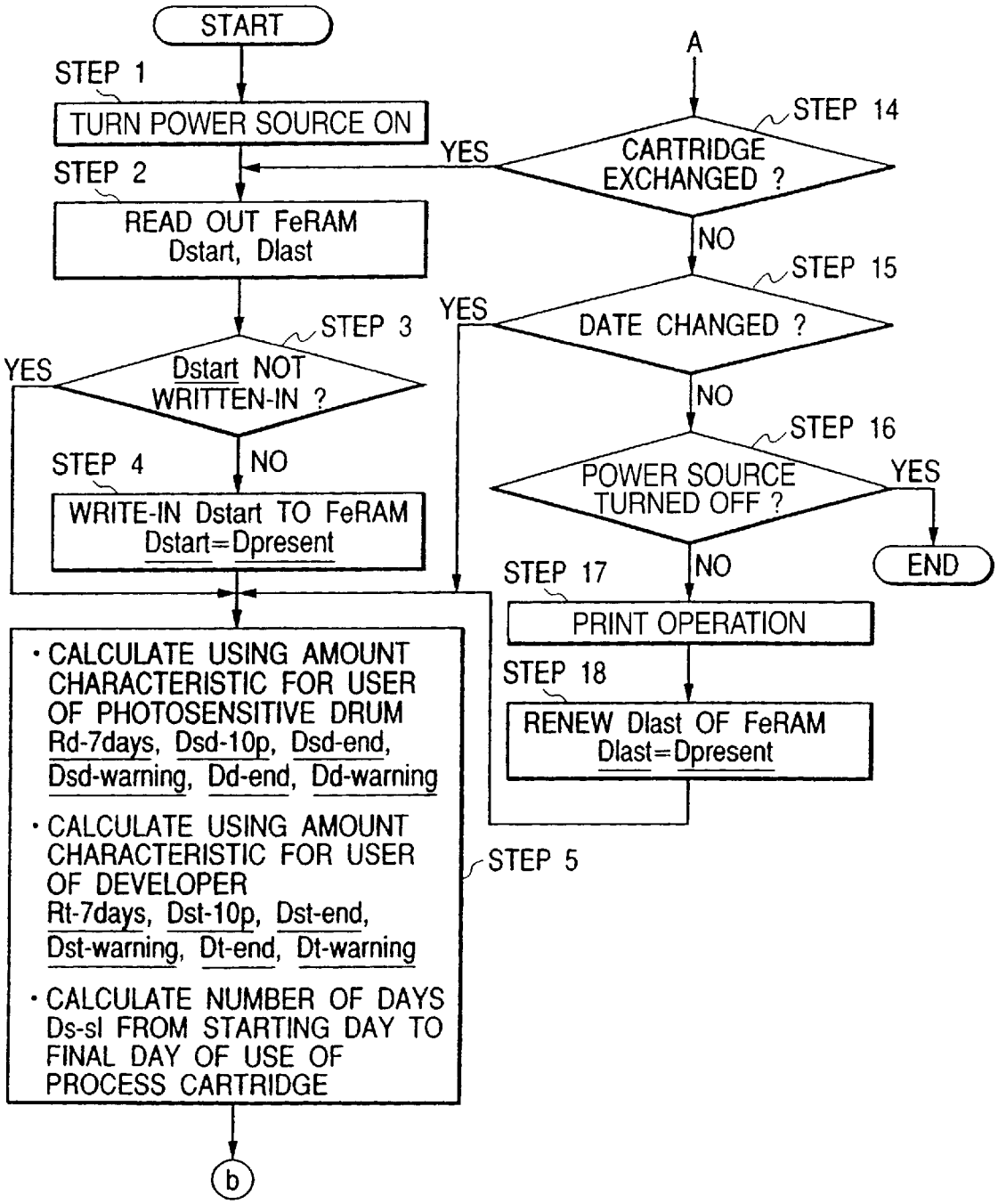
Figure 12B:
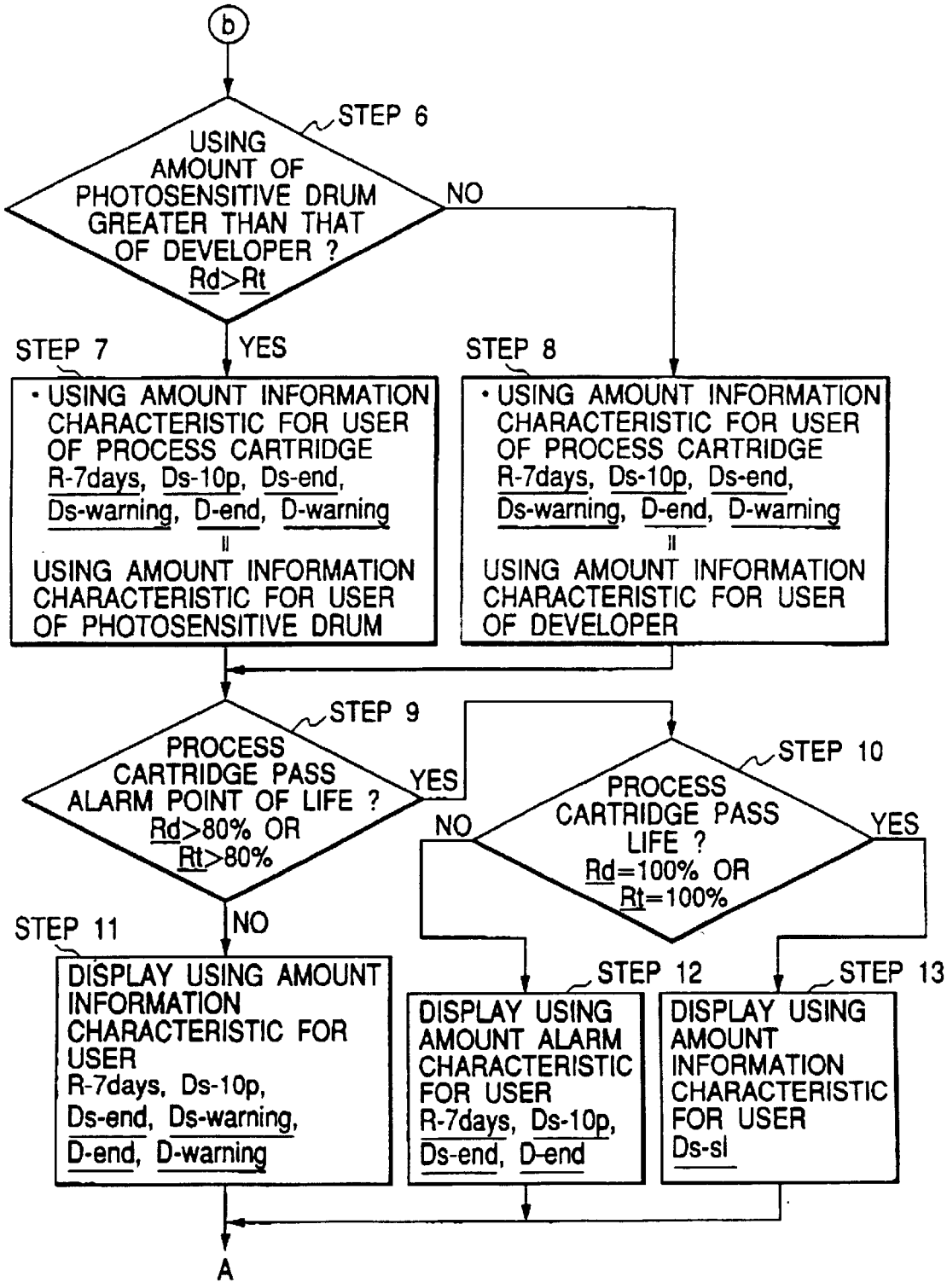

With reference to FIGS. 12A and 12B, [motions] operations related to the display of a using amount characteristic for a user of the process cartridge B according to the present invention will be described further in detail. FIGS. 12A and 12B show a displaying process of a using amount of the process cartridge B in the present embodiment in a flow chart. As [understandable] will be understood with reference to FIGS. 12A and 12B, a displaying process of the using amount of the process cartridge B according to the present embodiment shall be generally similar to the one described in the embodiment 3.

According to the present embodiment, when a user [puts] turns on the power source of the image forming apparatus A to which the process cartridge B is attached (step 1) or, as described later, the user takes out a new process cartridge B from a wrapping member and attaches it to the main body of the image forming apparatus 100 (step 14) under the state where the power source remains put on, the image forming apparatus reads out the information stored in the FeRAM 20 of the process cartridge B with the reader-writer 21 (step 2) to judge whether or not the attached process cartridge B is a new one (step 3).

As in the present embodiment 3, when date information (Dstart) is not yet written in [in] the region inside the FeRAM 20 where the date (Dstart) when use of the process cartridge B started, the image forming apparatus 100 will judge that that process cartridge B is a new one.

In the step 3, when the process cartridge B attached to the main body of the image forming apparatus 100 is judged to be a new one, the main body of the image forming apparatus 100 will write the present date (Dpresent) into a region inside the FeRAM 20 where the reader-writer 21 stores the date (Dstart) when use of the process cartridge B started (step 4). In addition, in step 3, in the case where the process cartridge B attached to the main body of the image forming apparatus 100 is judged not to be a new one, the date (Dstart) when use of the process cartridge B started together with the date (Dlast) when the process cartridge B was used for the last time which is stored inside the FeRAM 20 will be read out and used without any change in accordance with a sequence as follows.

Thus, the storage means 20 of the process cartridge B is caused to store the date (Dstart) when use of the process cartridge B started as well as the date (Dlast) when the process cartridge was used for the last time so that, also in the case where the process cartridge B is taken out from the main body of the image forming apparatus 100 in the midst of use of the apparatus and that process cartridge is incorporated into another image forming apparatus, a date (Dstart) when use of the process cartridge B started as well as a date (Dlast) when the process cartridge B was used for the last time will become able to be identified likewise.

Thereafter, the information read out by the reader-writer 21 is transmitted to the calculating means 22 provided in the main body of the image forming apparatus 100, and, based on a date when use of the process cartridge B started (Dstart), stored in FeRAM 20, [a] the date when the process cartridge B was used for the last time (Dlast) and [a] the consumption level of the process cartridge B obtained with a developer amount detecting device, as well as a photosensitive drum using amount detecting device, the calculating means 22 calculates the using amount information characteristic for user of the process cartridge B (step 5).

In the present embodiment, as in the present embodiment 3, calculated as using amount information characteristic for the user is:

(A) [a] the process cartridge using rate per unit number of days (R-7 days (%))[.];

(B) [a] the number of days per unit process cartridge using rate (Ds-10p (%))[.];

(C) [a] the number of remaining using days (Ds-end) up to the end of the cartridge's life or [a] the number of remaining using days (Ds-warning) up to an alarm point of the life of the process cartridge[.]; and (D) [a] the date of the end of the cartridge's life (D-end) or an alarm point of the life (D-warning) of the process cartridge.

Here, in the present embodiment, for calculating the using amount information characteristic for a user of the process cartridge B, at first both [of] the using amount percentage Rt (%) of the developer and the using amount percentage Rd (%) of the photosensitive drum 1 respectively and individually undergo calculation on the using amount information of the developer and the using amount information of the photosensitive drum 1. Thereafter, [the] both [parties] values undergo comparison to [regard] determine the [party] element that has undergone more consumption, that is, comes up with the largest using amount, as the using amount information of the entire process cartridge B. However, since that calculating method is almost same in [the] both [parties of] the using amount of the developer and [of] the using amount of the developer, here, described will be a calculation using the using amount percentage of the developer Rt (%), that is:

(a1) [a] the developer using rate per unit number of days (Rt-7 days (%))[.];

(b1) [a] the number of days per unit developer using rate (Dst-10p (%))[.];

(c1) [a] the number of remaining using days (Dst-end) up to the time when no developer is left or [a] the number of remaining using days (Dst-warming) up to an alarm point for warning that no developer is left[.]; and (d1) [a] the date when no developer is left (Dt-end) or a date of an alarm point when no developer is left (Dt-warning).

At first, the using amount information of the developer (a1) "a developer using rate per unit number of days (Rt-7 days (%))," in order to obtain the above described information (A), is given by calculating the number of days from the time when use of the process cartridge B started to the date when it was used for the last time from the date when use of the process cartridge B started (Dstart) and the date (Dlast) when the process cartridge B was used for the last time, dividing the using amount percentage Rt(%) of the developer with that number of days, and multiplying the unit number of days. In the present embodiment, 7 days [were] was set as the unit number of days. Incidentally, it is preferable that the unit number of days is appropriately set depending on the kind of cartridge or image forming apparatus, so that for example, [that] a longer unit number of days is taken for a process cartridge with a long enduring life. That is, the above described information (a1) is calculated by the following equation:

$$Rt\text{-}7\ \text{days}\ (\%)=Rt/(D\text{last-}D\text{start})\times 7(\%).$$

Next, the using amount information of the developer (b1) "a number of days per unit developer using rate (Dst-10p (%))," in order to obtain the above described information (B), that has a reciprocal meaning of the [above described] above-described information (a1) ((Rt-7 days (%)), is given by independently calculating the number of days from the time when use started to the last using date as in the case of the above described information (a1), dividing the using amount percentage Rt(%) of the developer with that number of days, and multiplying the unit using percentage. In the present embodiment, 10% was set as the unit using percentage. Incidentally, the unit using percentage can be appropriately selected, and, for example, setting with 100% may be regarded as [a] the number of days to use up one process cartridge B. That is, the [above described] above-described information (b1) is calculated by the following equation:

$$Dst\text{-}10p(\%)=(D\text{last-}D\text{start})/Rt\times 10.$$

In addition, the using amount information of the developer (c1) "a number of remaining using days (Dst-end) up to the time when no developer is left or a number of remaining using days (Dst-warning) up to an alarm point of time when no developer is left," in order to obtain the above described information (C), is given by calculating, in the present embodiment, a time point when the using amount percentage Rt (%) reaches 100%, this percentage being set as the time when no developer is left and [a] the time point when the using amount percentage Rt (%) reaches 80% as an alarm point for an [even] event that no developer is left, and with subtraction of the present using amount percentage Rt (%) of the developer from the respective percentage (100% or 80%), dividing the above unit using percentage (10% in the present embodiment), and moreover multiplying the number of days per unit developer using rate (Dst-10p (%)) given as the above described information (b1). That is, the above described information (c1) is calculated by the following equation:

$$Dst\text{-end}=(100\text{-}Rt)/10\times Dst\text{-}10p$$

$$Dst\text{-warning}=(80\text{-}Rt)/10\times Dst\text{-}10p.$$

Moreover, the using amount information of the developer (d1) "a date when no developer is left (Dt-end) or an alarm point of the date when no developer is left (Dt-warning)," in order to obtain the [above described] above-described information (D), is given by adding the number of remaining using days (Dst-end) up to the time when no developer is left or [a] the number of remaining using days (Dst-warming) up to an alarm point of time when no developer is left, obtained as the [above described] above-described information (c1) to the present date (Dpresent). That is, the above described information (d1) is calculated by the following equation:

$$Dt\text{-end}=D\text{present}+Dst\text{-end}$$

$$Dt\text{-warming}=D\text{present}+Dst\text{-warning}.$$

With calculation similar to the [above described] above-described one, with the using amount percentage of the photosensitive drum 1 Rd (%), calculated is using amount information of the photosensitive drum 1 in order to obtain the above described information (A) to (D), that is:

(a2) [a] the photosensitive drum using rate per unit number of days (Rd-7 days (%))[.];

(b2) [a] the number of days per unit photosensitive drum using rate (Dsd-10p (%))[.];

(c2) [a] the number of remaining using days (Dsd-end) up to the end of the drum's life or [a] the number of remaining using days (Dsd-warning) up to an alarm point of the life of the photosensitive drum[.]; and (d2) [a] the date of the end of the drum's life (Dd-end) or an alarm point of the life (Dd-warning) of the photosensitive drum.

Next, the calculated information on the using amount of the developer and the using amount of the photosensitive drum 1 undergoes comparison (step 6) to regard information of the [party] value that has shown to be the larger[,] using amount, that is, passes the end of its life earlier, as the using amount information characteristic for the user of the process cartridge B shown in the above described (A) to (D) (step 7 and step 8).

In addition, in the present embodiment, in step 5[, a] the number of days from the day when use of the process cartridge started to the last day when the process cartridge was used (Ds-sl) is separately calculated by the following equation:

*Ds-sl-D*last-*D*start.

Thereafter, for describing the case where, for example, with judgment in step 6 it was judged that the using amount information of the developer (a1) to (d1) is treated as cartridge using amount information characteristic for a user (A) to (D), it is judged whether or not the using amount percentage of the developer Rt (%) passes an alarm point of the cartridge's life, that is, 80% in the present embodiment (step 9).

In a judgment in step 9, in the case where an alarm point of the life of the process cartridge B currently attached to the main body of the image forming apparatus 100 is not passed, a signal selected in step 7 and showing the cartridge using amount information characteristic for user (A) to (D) at the present time point is transmitted to displaying means 23 of the main body of the image forming apparatus 100. And then, the [above described] above-described information (A) to (D) is respectively displayed and a message having a meaning to notify a user of the cartridge using amount information characteristic for a user, for example, such as "You are using the process cartridge 'R-7 days' (%) a week. If you continue using it at this pace, the life thereof will come to an end around 'D-end'. It is recommended that a spare cartridge will be ready by around 'D-warning'," etc., is displayed (step 11).

In addition, in a judgment in step 9, in the case where an alarm point of the cartridge's life is passed, a judgment is made on whether or not the using amount percentage Rt (%) of the developer has reached 100% (step 10) , and in the case where it has not [past the] ended its life, as in the above described step 11, the cartridge using amount information characteristic for a user (A) to (D) at the present time point (but except the number of days up to the alarm point and the date of the alarm point,) is displayed on the displaying means 23 of the main body of the image forming apparatus 100, and a message having a meaning to notify the cartridge using amount information characteristic for a user, and [suggest to] suggesting that the user make a new process cartridge B ready for example, such as "If you continue using the cartridge at this pace, the life thereof will come to an end in 'Ds-end' days. Please make a spare cartridge at your earliest convenience," etc., is displayed (step 12).

In addition, in a judgment in step 10, in the case where the process cartridge is judged to have [past] ended its life, it is displayed that the process cartridge B has reached the end of its life and a message having a meaning to notify a user of the cartridge using amount information characteristic for a user, for example, such as "[the] The process cartridge has reached the end of its life. You used up this cartridge in 'Ds-sl' days," etc., is displayed.

Moreover, the image forming apparatus A in the present embodiment displays the information as described above onto displaying means 23 provided in the main body of the image forming apparatus 100, and concurrently transmits the cartridge using amount information characteristic for a user from communicating means 24 of the main body of the image forming apparatus 100 to communicating means 25 of the host computer 150 so as to display the contents as described above onto displaying means 27 of the host computer 150 via the CPU 26 of the host computer 150. Thus, there is an advantage that display is implemented onto displaying means of [an] a piece of equipment such as the host computer 150 brought into communicable connection with the image forming apparatus A, etc. so that the using amount of the process cartridge B can be grasped while that equipment is being operated.

These [motions] operations are implemented at the time when the power source is [put] turned on, the process cartridge B is exchanged, and the date is updated. That is, the image forming apparatus A of the present embodiment observes respectively whether the process cartridge B has been exchanged or not (step 14), and whether the date has been changed or not (step 15), under the state where the power source is [put] turned on. Therefore, [motions] operations similar to those described above are implemented from the readout step (step 2) of information stored inside the FeRAM 20 in the case where the process cartridge B has been exchanged or from the calculating step (step 5) of the calculating means 22 using the present date (Dpresent) for calculation in the case when the date has been changed, so that display in the displaying means 23 and 27 are updated. In addition, the image forming apparatus A judges whether or not the power source is [put] turned off (step 16), and in the case where the power source has not been [put] turned off, it will enter a state of standby of image forming [motions] operations (step 17). And in the case where the power source has been [put] turned off, display of a time limit for use of the process cartridge B comes to an end.

In addition, when a printing [motion] operation is implemented by an order from a user (step 17), the image forming apparatus A of the present embodiment writes the present date (Dpresent) into the information on the date when the process cartridge B was used for the last time inside the FeRAM 20 of the process cartridge B and updates information on the date (Dlast) when the process cartridge was used for the last time (step 17).

The user watches the message as described above that is displayed in the displaying means 23 and 27, and thereby can know [a] the level of frequency in use of the process cartridge B by the user himself/herself or the user group and will become capable of judging:

- concretely for about how many days the present cartridge can be kept in use[.];
- approximately when a spare cartridge should be ready[.]; and
- not only how much process cartridge B is consumed, but also how much cost is incurred within a constant period.

Similarly as in the embodiment 3, this will enable a user to get an appropriate number of spare cartridges at an appropriate timing. Therefore, according to the present invention, such an event that images [cannot help being] are discontinued [outputting] from being outputted due to lack of spare cartridges in spite that the cartridge [has] having reached [its end] the end of its life can be prevented from taking place.

Moreover, as in the present embodiment, the configuration that permits the date (Dlast) when the cartridge is used for the last time [is] to be stored in the storage means 20 of the cartridge is advantageous as described below in the case of discriminating the cartridge using amount characteristic for a user after collecting the used cartridge.

That is, retailers, etc., of cartridges [collects] collect used cartridges from users for recycling, etc., of cartridges. After collecting cartridges, the retailers read out information in the FeRAM 20 provided in the cartridges with a specialized reading repair tool, etc. With the thus read-out dates (Dstart) when use of cartridges started, as well as the dates (Dlast) when cartridges were used for the last time, [a] the number of days (Ds-sl) from the dates when use of the cartridges started to the last dates of uses can be calculated by the following equation:

$$Ds\text{-}sl = Dlast - Dstart$$

[Thereby] As a result, retailers can acknowledge how many days a user spent to use up that cartridge so that the retailers can advise the user when to make a spare cartridge ready or of preparatory amounts, or in the case where there exists a maintenance agreement and the like, retailers will become capable of providing diligent services, such as delivering cartridges to the user at appropriate [timing,] times etc.

Incidentally, the above described description is [preconditioned by] contingent upon the user's replacing cartridges at the point of time when [it reaches] they reach the end of their life, but otherwise, for example, such a case where the user replaces this cartridge before it reaches the end of life can be considered. Accordingly, moreover, the storage means 20 that the cartridge comprises may be configured to store using amount percentages (Rd % and Rt %) respectively as using amount information on a photosensitive drum or developer and the like. [Thereby] As a result, retailers, etc., read out this using amount information from the storage means 20 and implement calculation as in step 5 in the present embodiment described above so as to calculate how much the cartridge has been consumed in how may days in view of the using level characteristic for a user, and thus appropriate services as described above can be provided.

Thus, inside the storage means provided in the cartridge, not only the date when use of the cartridge started as well as the date when the cartridge was used for the last time, but also, for example, using amount information of developer or a photosensitive drum may be stored and information on a new product [of] cartridge, etc., may be stored. Moreover, storing the using amount of developer or a photosensitive drum [into] in the storage means of the cartridge is, as having been described in the embodiment 3, also advantageous in the case where, immediately after the power source of the image forming apparatus is [put] turned on, a using amount % of developer and the photosensitive drum cannot be [perceived] detected.

In addition, as a judging method for determining whether or not the process cartridge B is a new product, a physical switch such as the existence or non-existence of an interfering member or information for making a judgment on a new product inside storing means of the process cartridge B may be held separately, but, likewise the embodiment 3, as in the present embodiment, judging with a date when use of the process cartridge B started will [served to] be [an advantage] advantageous that it will not be necessary to prepare them separately.

Embodiment 5

Next, still another embodiment of the present invention will be described. An image forming apparatus of the present embodiment shall basically be similar to the image forming apparatus in the embodiments 3 and 4, but, in a cartridge using amount displaying system that the image forming apparatus comprises[,] information to be stored in storage means provided in a cartridge is different. That is, in the present embodiment, the storage means of the cartridge is caused to store a final date when the cartridge was used as well as [a] the number of using days of the cartridge.

The present embodiment, which will be described in conformity with the image forming apparatus A as well as the process cartridge B shown in FIG. 1 and FIG. 2, comprises FeRAM 20 being storage means provided in the process cartridge B that is arranged to be able to store the final date when the process cartridge B was used, that is, the date when the final image output took place, and [a] the number of using days of the process cartridge B. Incidentally, in the present embodiment, [a] the number of using times of a process cartridge B [is], as [being] will be described in detail later, [referred] refers to [a] the number of actual working days of the process cartridge B, that is, [a] the number of days when the image forming apparatus A was used to actually implement image forming.

In the present embodiment, the final date when the process cartridge B was used, [a] the number of using days of the process cartridge B and the developer using amount percentage Rt (%) [perceived] detected by the developer amount detecting device, as well as the photosensitive drum using amount percentage Rd (%) [perceived] detected by the photosensitive amount detecting device are utilized to calculate and display information on the using amount of the process cartridge B that is characteristic for a user, as described in detail later, as each value of [a] the process cartridge using rate per unit number of days, [a] the number of days per unit process cartridge using rate, [a] the remaining number of using days up to the end of the cartridge's life or an alarm point of the life of the process cartridge, and [a] the date of the end of the life or an alarm point of the life of the process cartridge.

Figure 13:
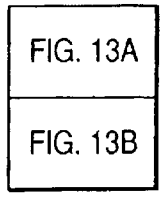
FIG. 13 comprises FIGS. 13A and 13B showing a flow chart for explaining the displaying action of the used quantity of the cartridge of the embodiment 5 according to the present invention.
Figure 13A:
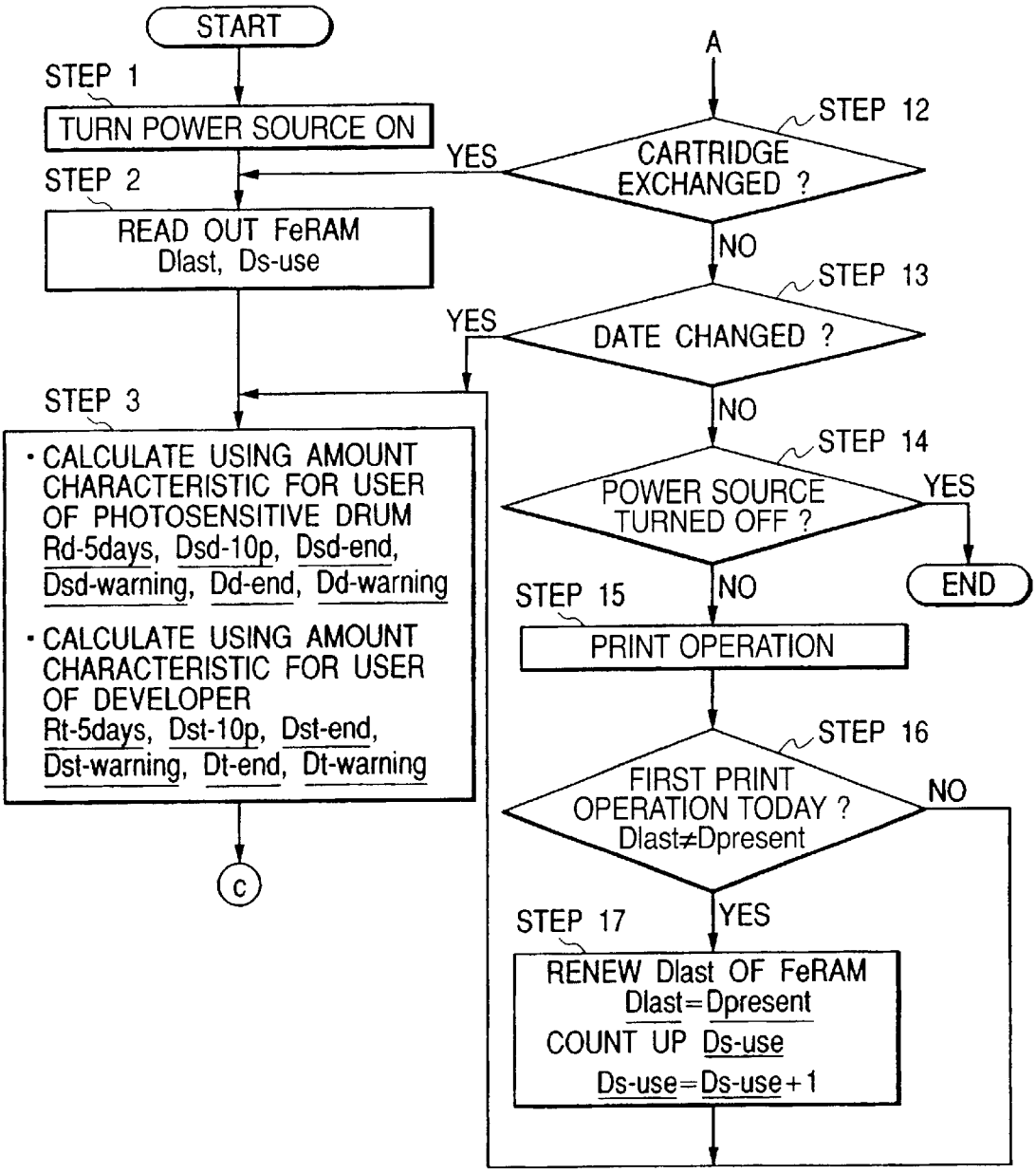
Figure 13B:
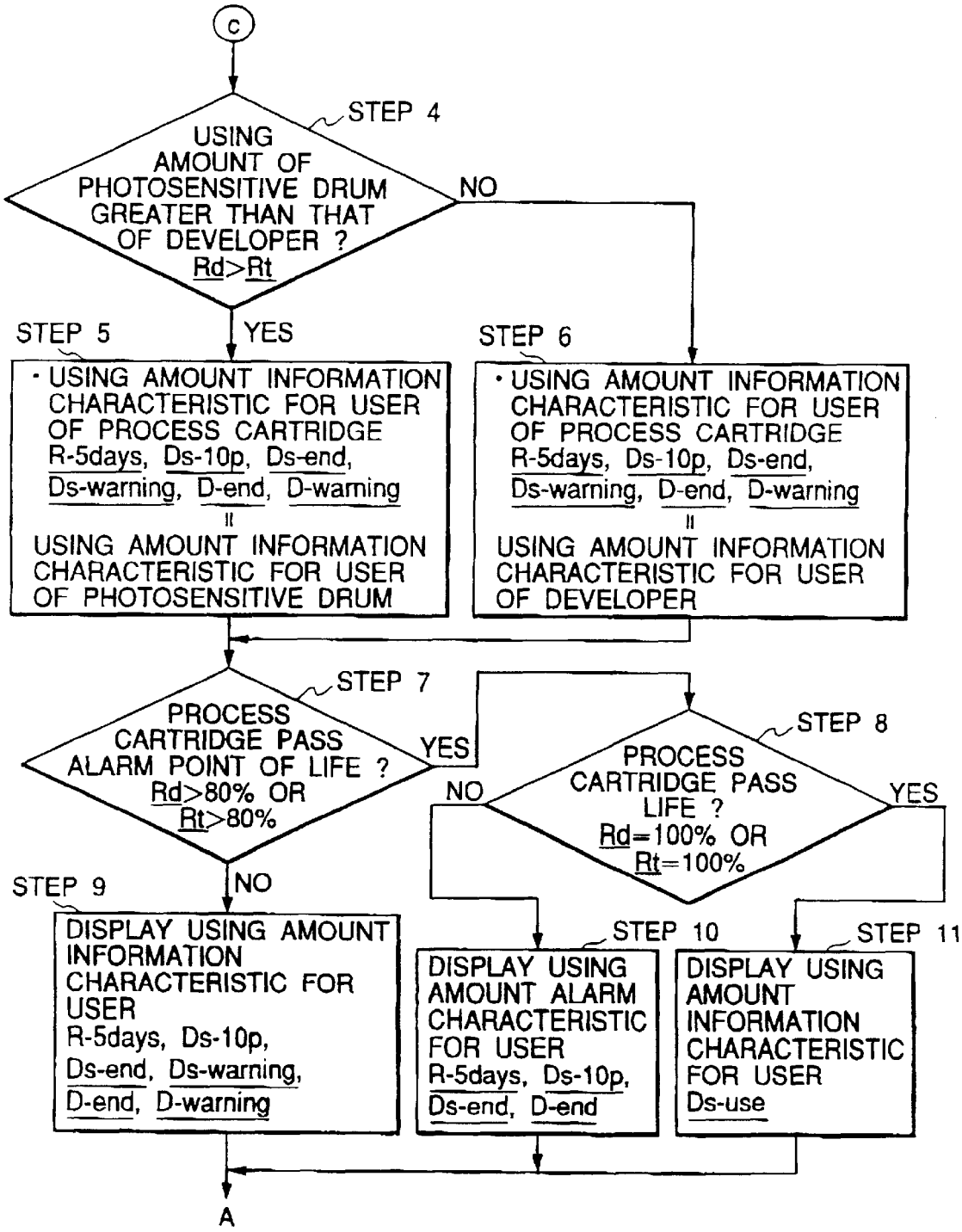

With reference to FIGS. 13A and 13B, [motions] operations related to the display of a using amount characteristic for a user of the process cartridge B according to the present invention will be described further in detail. FIGS. 13A and 13B show a displaying process of a using amount of the process cartridge B in the present embodiment in a flow chart.

According to the present embodiment, when a user [puts] turns on the power source of the image forming apparatus A to which the process cartridge B is attached (step 1) or, as described later, when the user takes out a new process cartridge B from a wrapping member and attaches it to the main body of the image forming apparatus 100 (step 12) under the state where the power source remains [put] turned on, the image forming apparatus reads out the information stored in the FeRAM 20 of the process cartridge B, that is, in the present embodiment, the date (Dlast) when the process cartridge B was used for the last time and [a] the number of days (Ds-use) when the process cartridge B was used, with the reader-writer 21 (step 2). Thus, the storage means 20 of the process cartridge B is caused to store the date (Dlast) when the process cartridge was used for the last time, as well as [a] the number of days (Ds-use) when the process cartridge B was used so that, also in the case where the process cartridge B is taken out from the main body of the image forming apparatus 100 in the midst of use of the apparatus and that process cartridge is incorporated into another image forming apparatus, [a] the date (Dlast) when the process cartridge B was used for the last time as well as a number of days (Ds-use) when the process cartridge B was used will become able to be identified likewise.

Thereafter, the information read out by the reader-writer 21 is transmitted to the calculating means 22 provided in the main body of the image forming apparatus 100, and based on [a] the date (Dlast) when the process cartridge B was used for the last time stored in FeRAM 20 and [a] the number of days (Ds-use) when the process cartridge B was used and [a] the consumption level of the process cartridge B obtained with a developer amount detecting device, as well as a photosensitive drum using amount detecting device, the calculating means 22 calculates the using amount information characteristic for a user of the process cartridge B (step 3).

In the present embodiment, calculated as using amount information characteristic for user is:

(A) [a] the process cartridge using rate per unit number of days (R-5 days (%))[.];

(B) [a] the number of days per unit process cartridge using rate (Ds-10p (%))[.];

(C) [a] the number of remaining using days (Ds-end) up to the end of life or [a] the number of remaining using days (Ds-warming) up to an alarm point of the life of the process cartridge[.], and (D) [a] the date of the end of life (D-end) or an alarm point of the life (D-warning) of the process cartridge.

Here, in the present embodiment, for calculating the using amount information characteristic for a user of the process cartridge B, at first both [of] the using amount percentage Rt (%) of the developer and the using amount percentage Rd (%) of the photosensitive drum 1 respectively and individually undergo calculation on the using amount information of the developer and the using amount information of the photosensitive drum 1. Thereafter, [the] both [parties] values undergo comparison to [regard] determine the [party] element that has undergone more consumption, that is, comes up with the largest using amount, as the using amount information of the entire process cartridge B. However, since that calculating method [is] yields almost the same [in the] results for both [parties of the] using [amount] amounts of the developer, [and of] the using amount [of the developer,] information of the entire process cartridge here [,] will be calculated by using the using amount percentage of the developer Rt (%), that is:

(a1) [a] the developer using rate per unit number of days (Rt-5 days (%))[.];

(b1) [a] the number of days per unit developer using rate (Dst-10p (%))[.];

(c1) [a] the number of remaining using days (Dst-end) up to the time when no developer is left or [a] the number of remaining using days (Dst-warming) up to an alarm point for warning that no developer is left[.]; and (d1) [a] the date when no developer is left (Dt-end) or a date of an alarm point when no developer is left (Dt-warning).

At first, the using amount information of the developer (a1) "a developer using rate per unit number of days (Rt-5 days (%))," in order to obtain the [above described] above-described information (A), is [given] determined by dividing the using amount percentage Rt(%) of the developer with [a] the number of days (Ds-use) when the process cartridge B was used, and multiplying the unit number of days. In the present embodiment, 5 days were set as the unit number of days, this number being [a] the number of actual working days during a week. Incidentally, it is preferable that the unit number of days is appropriately set depending on kind of cartridge or image forming apparatus, for example, that a longer unit number of days is taken for a process cartridge with a long enduring life. That is, the [above described] above-described information (a1) is calculated by the following equation:

$$Rt\text{-5 days }(\%)=Rt/Ds\text{-use}\times 5(\%).$$

Next, the using amount information of the developer (b1) "[a] the number of days per unit developer using rate (Dst-10p (%))," in order to obtain the above described information (B), that has a reciprocal meaning of the [above described] above-described information (a1) ((Rt-5 days (%)), is given by independently as in the case of the [above described] above-described information (a1), dividing [a] the number of days (Ds-use) when the process cartridge B was used with the using amount percentage Rt(%) of the developer, and multiplying the unit using the percentage. In the present embodiment, 10% was set as the unit using percentage. Incidentally, the unit using percentage can be appropriately selected, and, for example, setting with 100% may be regarded as [a] the number of days to use up one process cartridge B. That is, the above described information (b1) is calculated by the following equation:

$$Dst\text{-}10p(\%)=Ds\text{-use}/Rt\times 10.$$

In addition, the using amount information of the developer (c1) "[a] the number of remaining using days (Dst-end) up to the time when no developer is left or [a] the number of remaining using days (Dst-warming) up to an alarm point of time when no developer is left," in order to obtain the [above described] above-described information (C), is [given] determined by calculating, in the present embodiment, a time point when the using amount percentage Rt (%) reaches 100%, which is [being] set as the time when no developer is left and a time point when the using amount percentage Rt (%) reaches 80% is set as the alarm point for [an even] the event that no developer is left, and with subtraction of the present using amount percentage Rt (%) of the developer from the respective percentage (100% or 80%), dividing the above unit using percentage (10% in the present embodiment), and moreover multiplying the number of days per unit developer using rate (Dst-10p (%)) given as the above described information (b1). That is, the above described information (c1) is calculated by the following equation:

$$Dst\text{-end}=(100-Rt)/10\times Dst\text{-}10p$$

$$Dst\text{-warning}=(80-Rt)/10\times Dst\text{-}10p.$$

Moreover, the using amount information of the developer (d1) "a date when no developer is left (Dt-end) or an alarm point of the date when no developer is left (Dt-warning)," in order to obtain the [above described] above-described information (D), is given by adding the number of remaining using days (Dst-end) up to the time when no developer is left or [a] the number of remaining using days (Dst-warming) up to an alarm point of time when no developer is left and [a] the number of days (αend, αwarning) when the image forming apparatus is not operated while this number of remaining using days is counted, which is obtained as the [above described] above-described information (c1) to the present date (Dpresent). Here, as a method to obtain [a] the number of days (αend, αwarning) when the image forming apparatus A is not operated during the number of remaining using days up to the life of the process cartridge or [an] the alarm point (Dst-end or Dst-warning), there is a method to obtain it from [a] the percentage of [a] the number of using days (a number of working days ) of the process cartridge B (Ds-use) toward [a] the number of days from the time when use of the process cartridge B started to the present time and a method to extract [a] the number of day-offs based on calendar information, etc. and the like. That is, the [above described] above-described information (d1) is calculated by the following equation:

$$Dt\text{-end}=D\text{present}+Dst\text{-end}+\alpha\text{end}$$

$$Dt\text{-warning}=D\text{present}+Dst\text{-warning}+\alpha\text{warning}.$$

With a calculation similar to the [above described] above-described one, with the using amount percentage of the photosensitive drum 1 Rd (%), calculated is the using amount information of the photosensitive drum 1 in order to obtain the [above described] abovedescribed information (A) to (D), that is:

(a2) [a] the photosensitive drum using rate per unit number of days (Rd-5 days (%))[.];

(b2) [a] the number of days per unit photosensitive drum using rate (Dsd-10p (%))[.];

(c2) [a] the number of remaining using days (Dsd-end) up to the end of life or [a] the number of remaining using days (Dsd-warming) up to an alarm point of the life of the photosensitive drum[.]; and (d2) [a] the date of the end of life (Dd-end) or an alarm point of life (Dd-warning) of the photosensitive drum.

Next, the calculated information on the using amount of the developer and the using amount of the photosensitive drum 1 undergoes comparison (step 4) to [regard] determine information of the [party] element that has shown a larger using amount, that is, [passes] ends its life earlier, as the using amount information characteristic for a user of the process cartridge B shown in the [above described] above-described (A) to (D) (step 5 and step 6).

Thereafter, for describing the case where, for example, with a judgment in step 4 it was judged that the using amount information of the developer (a1) to (d19) is treated as the cartridge using amount information characteristic for a user (A) to (D), it is judged whether or not the using amount percentage of the developer Rt (%) passes an alarm point of the cartridge's life, that is, 80% in the present embodiment (step 7).

In a judgment in step 7, in the case where an alarm point of life of the process cartridge B currently attached to the main body of the image forming apparatus 100 is not passed, a signal selected in step 4 and showing the cartridge using amount information characteristic for a user (A) to (D) at the present time point is transmitted to displaying means 23 of the main body of the image forming apparatus 100. And then, the [above described] above-described information (A) to (D) is respectively displayed and a message having a meaning to notify a user of the cartridge using amount information characteristic for a user, for example, such as "You are using the process cartridge 'R-5 days' (%) in 5 days of use. If you continue using it at this pace, the life thereof will come to an end around 'D-end'. It is recommended that a spare cartridge [will] be ready by around 'D-warming'," etc. is displayed (step 9).

In addition, in a judgment in step 9, in the case where an alarm point of life is passed, a judgment is made on whether or not the using amount percentage Rt (%) of the developer has reached 100% (step 8), and in the case where it has not past the life, as in the [above described] above-described step 9, the cartridge using amount information characteristic for user (A) to (D) at the present time point (but except the number of days up to the alarm point and the date of the alarm point,) is displayed on the displaying means 23 of the main body of the image forming apparatus 100, and a message having a meaning to notify the user of the cartridge using amount information characteristic for a user, and [suggest] suggesting to the user to make a new process cartridge B ready for example, such as "If you continue using the cartridge at this pace, the life thereof will come to an end in 'Ds-end' days. Please make a spare cartridge ready at your earliest convenience," etc. is displayed (step 10).

In addition, in a judgment in step 8, in the case where the process cartridge B is judged to have past its life, it is displayed that the process cartridge has reached the end of its life and a message having a meaning to notify a user of the cartridge using amount information characteristic for a user, for example, such as "[the] The process cartridge has reached the end of its life. You used up this cartridge in 'Ds-use' days," etc. is displayed.

Further, the image forming apparatus A according to the present embodiment displays the [above described] above-described information on the displaying means 23 provided in the image forming apparatus main body 100, and simultaneously transmits cartridge using amount information characteristic of the user to the communicating means 25 of a host computer 150 from the communicating means 24 of the image forming apparatus main body 100 and displays the same contents as described above on the displaying means 27 of the host computer 150 through the CPU 26 of the host computer 150. In such a manner, the information is displayed on the displaying means of an apparatus such as the host computer 150 connected to the image forming apparatus A so as to be capable of communicating therewith, so that the using amount of a process cartridge B can be advantageously grasped while operating the apparatus.

These operations are carried out upon turning on a power source, [exchange] exchanging of the process cartridge B and [renew] renewing of the date. Specifically, the image forming apparatus A according to the present embodiment monitors respectively whether or not the process cartridge B is replaced by a new one (step 12) while the power is turned on, and whether or not the date is changed (step 13). Therefore, in the case where the process cartridge B is replaced by another cartridge, the same operations as described above are performed to update the displays on the displaying means 23 and 27 from the step 2 for reading the information stored in the FeRAM 20. Further, in the case where the date is changed, the same operations as described above are carried out to update the displays on the displaying means 23 and 27 from the step 3 for performing a calculation by the use of the present date by the calculating means 22. Further, the image forming apparatus A decides whether or not the power is turned on (step 14). When the power is not turned on, the image forming operation is brought to a stand-by state (step 15). Then, when the power is turned off, the display of the time limit for use of the process cartridge B is finished.

Still further, when a printing operation is executed in accordance with an instruction from the user (step 15), the image forming apparatus A according to the present embodiment compares the last date (Dlast) of use of the process cartridge B stored in the FeRAM 20 of the process cartridge B with the present date (Dpresent) (step 16). When the last date is different from the present date, the present date (Dpresent) is written in the area of the FeRAM 20 for storing the last date (Dlast) of use of the process cartridge B to update the information of the last date (Dlast) on which the process cartridge B is employed (step 17). At the same time, the number of days of use (Ds-use) of the process cartridge B is counted up, in other words, 1 is added thereto to update the information of the number of days of use (Ds-use) of the process cartridge B. Thus, the actual number of days of use of the image forming apparatus can be assuredly counted and stored [irrespective of the] even if the user takes a holiday [of the user]. Therefore, this can be reflected in the using amount information of the process cartridge B characteristic of the user.

The user views such messages as mentioned above displayed on the displaying means 23 and 27, and hence the user can know the degree of use of the process cartridge B by the user himself or a user group, and can specifically decide how many days the current cartridge can be continuously used, and hence, when a preliminary cartridge is to be prepared, the use can know what amount of the process cartridge B is consumed within a prescribed period and what degree of expenses is necessary.

Thus, the user can prepare [the] a suitable number of preliminary cartridges at a suitable timing similarly to the third and fourth embodiments. Therefore, according to the present invention, there can be prevented a situation that a preliminary cartridge cannot be prepared irrespective of a fact that the cartridge reaches the end of its life so that the output of an image has to be forcedly interrupted.

Further, as in the present embodiment, since the number of days of use (Ds-use) of the cartridge is stored in the storing means 20 of the cartridge, the cartridge using amount characteristic of the user may be advantageously discriminated after the recovery of the used cartridge like in the embodiment 2.

In other [word] words, the seller of the cartridge recovers used cartridges from users for the purpose of [recycle] recycling of the cartridges. After the recovery of [the] a cartridge, the seller reads out the actual number of days of use (Ds-use) of the cartridge stored in the FeRAM 20 provided in the cartridge by an exclusively used reading jig or the like. In such a manner, the seller knows the actual number of days of use (Ds-use) of the cartridge, so that the seller can know how many days are required for the user to completely use the cartridge in its actual operation. Therefore, in the case where the seller gives [an] advice [of] on the preparation time or the amount of preparation of preliminary cartridges to the user, or in the case where a maintenance contract is established between the seller and the user, the seller can provide a tender service to the user, such as sending a cartridge to the user at an appropriate timing.

In the above explanation, although it is assumed that the user replaces the cartridge by another cartridge when the cartridge reaches the end of its life, it should be noted that there may be considered a case other than the above, for instance, a case in which the user changes the cartridge before the cartridge reaches the end of its life. Accordingly, the using amount percentage (Rd %, Rt %) of the photosensitive drum or the developer may be respectively stored in the storing means 20 provided in the cartridge as the using amount information of the photosensitive drum or the developer. Thus, the seller may read out the using amount information from the storing means 20 to carry out the same calculations as those in step 3 of the present embodiment, so that he can consider the degree of use characteristic of the user and calculate how many days the cartridge is actually operated and how the cartridge is exhausted so as to provide a proper service as mentioned above.

In such a way, not only the last date of use of the cartridge and the actual number of days of use of the process cartridge B, but also the using amount information of, for example, the developer or the photosensitive drum may be stored in the storing means provided in the cartridge. Further, [the] information [of] on the date on which the use of the cartridge is started may be stored in the storing means like in the third and fourth embodiments 3, 4. Further, it is advantageous to store the using amount of the developer or the photosensitive drum in the storing means of the cartridge also in the case where the using amount % of the developer or the photosensitive drum cannot be detected immediately after the power of the image forming apparatus is turned on, as mentioned in the first embodiment 1.

In the description of the above respective embodiments, although the cartridge attachable to and detachable from the image forming apparatus 100 is the process cartridge B integrated with the photosensitive drum 1, the charging means 2 as the process means acting on the photosensitive drum 1, the developing means 5, the cleaning means 7*a*, the developer housing vessel 4 and the waste developer vessel 7*b*, it should be noted that the cartridge detachably attachable to the image forming apparatus main body 100 to which the present invention is applicable is not limited thereto and the present invention may be applied to the developing apparatus (developing cartridge) C and the photosensitive drum cartridge D formed as a cartridge as shown in FIGS. 6 and 7.

In this case, the using amount individually calculated for, for instance, the developer or the photosensitive drum 1 may be separately displayed as the using information amount characteristic of the user of each cartridge as it is.

Further, in the respective embodiments, as the storing means for storing the starting date of use of the process cartridge B, the final date of use of the process cartridge B, the number of days of use of the process cartridge, etc., the FeRAM 20 as a non-contact type memory is employed. Accordingly, the power source does not need to be provided in the process cartridge B side so that the information can be read and written under a non-contact state in the image forming apparatus main body 100 side. However, according to the present invention, the storing means is not limited to the above and a limitation is not particularly applied to any storing means capable of storing information. Therefore, for example, a combination of EEPROM or a volatile memory with a backup power may be employed.

Still further, in the above respective embodiments, the information may be displayed on either the displaying means 23 of the image forming apparatus main body 100 or the displaying means 27 of the host computer 150. A method for displaying the information by the displaying means may not be limited to the above mentioned messages and only a date may be displayed. Additionally, the number of days may be counted down and displayed, the remaining number of days may be displayed by a bar graph, an alarm may be generated by lighting an LED provided in the image forming apparatus main body or the information concerning the using amount of the cartridge peculiar to the user may be recorded on a recording medium and outputted.

For calculation of the using amount information of the cartridge peculiar to the user, since the number of days of use utilized in calculation, that is to say, Ds-sp, Ds-sl and Ds-use (actual number of days of use) in each embodiment is small in the relatively initial stage of use of the cartridge, it is possible to estimate that the deviation of the calculated result is slightly increased. In such a case, the using amount information peculiar to the user concerning the cartridge before its exchange may be stored in the image forming apparatus main body, [the] and the activity ratio of the present cartridge and the last cartridge may be wholly calculated while taking the information into account to some extent. Then, as described in each of the embodiments, the remaining number of days of use to the end of the life of the cartridge or the life alarm point of the cartridge, or the date of the end of the cartridge's life or life alarm point of the cartridge, etc., may be calculated to suppress the deviation of the calculated result of the using amount information of the cartridge.

Still further, it should be noted that the method for obtaining the using amount percentage Rd (%) of the photosensitive drum and the using amount percentage Rt % of the developer is not limited to the method described in each of the embodiments. As for the exhausted state of the electrophotographic photosensitive body, there may be employed any method for detecting the exhausted state of the electrophotographic photosensitive body, such as a method for counting the number of print sheets, a method for counting the rotating speed of the photosensitive drum, a method for measuring an electric current passing through the photosensitive drum, or the like. Still further, as for the consumed amount of the developer, there may be employed any method for successively detecting the remaining amount of the developer, such as an image dot counting system for counting the number of dots of an image formed on the photosensitive body to convert the configuration of the image dots into the using amount of the developer, a torque detecting method for detecting the torque of means for agitating the developer in the developer housing part, or the like.

Embodiment 6

Now, an embodiment 6 of the present invention will be described below.

Initially, referring to FIGS. 1 and 2, the embodiment 6 of an electrophotographic image forming apparatus to which a process cartridge configured according to the present invention is detachably attachable will be described below. In the embodiment 6, the electrophotographic image forming apparatus is specified as an electrophotographic laser beam printer A and is adapted to receive image information from a host computer and form an image on a recording medium, such as a recording sheet, an OHP sheet, a cloth, etc., in accordance with electrophotographic image forming processes.

The laser printer A has a drum shaped electrophotographic photosensitive body, in other words, a photosensitive drum 1. The photosensitive drum 1 is charged by a charging roller 2 as charging means, and then[,] irradiated with a laser beam L corresponding to image information from a laser scanner 3 so that a latent image corresponding to the image information is formed on the photosensitive drum 1. The latent image is developed by developing means 5 to obtain a visible image, namely, a toner image.

The developing means 5 has a developing chamber 5A provided with a developing roller 5*a* serving as a developer carrier. A developer T in a developer housing vessel 4 formed as a developer housing part adjacent to the developing chamber 5A is supplied to the developing roller 5*a* of the developing chamber 5A. In the developer housing vessel 4, is provided agitating means 15 rotating in the direction shown by an arrow mark in FIG. 1. The agitating means 15 rotates so that the developer T is supplied to the developing roller 5*a* while the developer T is loosened. In the embodiment 6, as the developer T, toner including an insulating magnetic component is employed. The developing roller 5*a* is integrated with a fixed magnet 5*b*. The developing roller 5*a* is rotated to carry the developer. Thus, a frictionally charged electric charge is applied to the developing roller by a developing blade 5*c* as a developer layer thickness regulating member so that the developing layer with prescribed thickness is formed thereon and is supplied to the developing area of the photosensitive drum 1. The developer supplied to the developing area is transferred to the latent image on the photosensitive drum 1 to form a toner image. The developing roller 5*a* is connected to a developing bias circuit and a developing bias voltage with a dc voltage superimposed on an ac voltage is usually applied to the developing roller.

A recording medium P set on a sheet feeding cassette 200 is conveyed to a transferring position through a pick-up roller 8 and conveying means 9A in synchronization with the formation of the toner image.

At the transferring position, a transferring roller 6 as transferring means is arranged to apply voltage to the recording medium to transfer the toner image on the photosensitive drum 1 to the recording medium P.

The recording medium P to which the toner image is transferred is conveyed to fixing means 10 by conveying means 9B. The fixing means 10 is provided with a fixing roller 10*b* integrated with a heater 10*a* and a driving roller 10*c* to apply heat and pressure to the recording medium P passing therethrough and fix the transferred toner image onto the recording medium P.

The recording medium P is discharged to a discharging tray 14 by conveying means 9C. The discharging tray 14 is provided on the upper surface of the image forming apparatus main body 100 of the laser printer A.

The photosensitive drum 1, after the toner image is transferred to the recording medium P by the transferring roller 6, is employed for a next image forming process, after the developer remaining on the photosensitive drum 1 is removed by cleaning means 7. The cleaning means 7 scrapes out the residual developer on the photosensitive drum 1 by an elastic cleaning blade 7*a* abutting [on] the photosensitive drum 1 and collects the residual developer to a waste developer vessel 7*b*.

On the other hand, according to the embodiment 6, a process cartridge B comprises, as shown in FIG. 2, a developing frame body 11 having the developer containing (housing) vessel (developer housing part) 4 for housing the developer and the agitating means 15 and a developing frame body 12 for holding the developing means 5 such as the developing roller 5*a* and the developing blade 5*c* or the like, which are integrally welded to form a developing unit. Further, to the developing unit, is integrally connected a cleaning frame body 13 to which the photosensitive drum 1, the cleaning means 7 such as the cleaning blade 7*a* and the waste developer vessel 7*b* and the charging roller 2 are attached to constitute a cartridge.

This process cartridge B is detachably attached to cartridge mounting means 101 (see FIG. 1) provided in the image forming apparatus main body 100.

Figure 14:
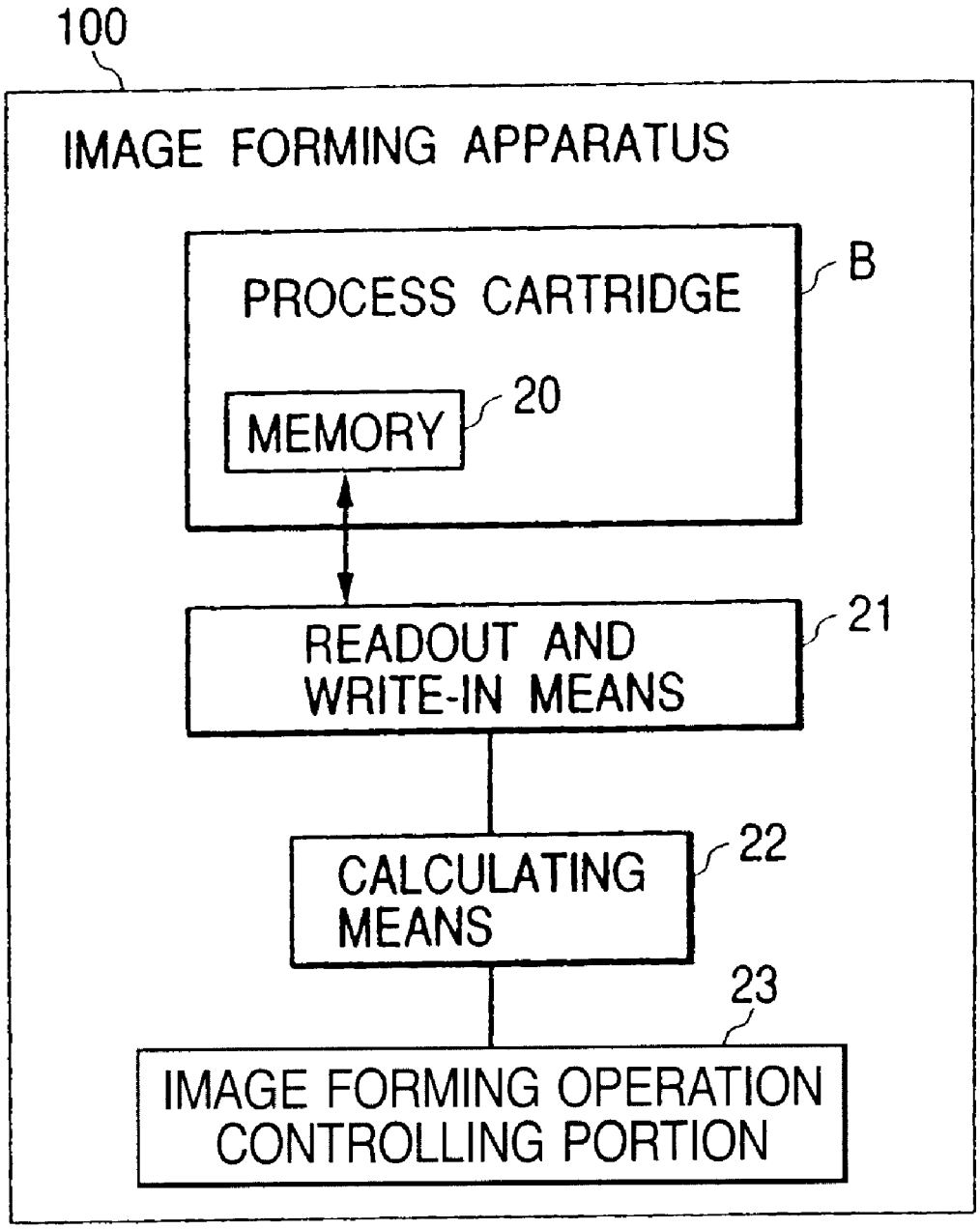
FIG. 14 is a view of an outlined relation of the process cartridge and the image forming apparatus of embodiments 6 and 7 according to the present invention.

Now, referring to FIG. 14, a method for discriminating the leaving period of the process cartridge B in accordance with the present invention will be described below. FIG. 14 shows the relation between storing means provided in the process cartridge B and the image forming apparatus main body 100 according to the embodiment 6 of the invention. According to the present invention, there is configured a [cartridge leaving period] cartridge-leaving-period discriminating system for discriminating the leaving period of the cartridge by employing the storing means provided in the cartridge.

According to the embodiment 6, the process cartridge B is provided with a ferroelectric non-volatile memory (called it "FeRAM," hereinafter) 20 as the storing means. Further, in the image forming apparatus main body 100 side, a reader/writer 21 as reading and writing means 21 is provided. Information is read from and written in the FeRAM 20 by the reader/writer 21.

Further, according to the embodiment 6 of the present invention, [is] incorporated in the process cartridge B side is an FeRAM 20 as a non-contact type non-volatile memory having a resonance circuit comprising an antenna and a capacitor. An operating power source is generated from an electromagnetic wave transmitted from the reader/writer 21 of the image forming apparatus main body 100 so as to read and write information relative to the FeRAM 20. Thus, the power source is not required in the process cartridge B side and a communication with the image forming apparatus main body 100 can be performed [under] in a non-contact state.

In the embodiment 6, the final date on which the process cartridge B is used can be stored in the FeRAM 20. As described above, the final date of use of the process cartridge B is stored in the storing means 20. Accordingly, even when the process cartridge B is taken out from the image forming apparatus main body 100 during its use and the cartridge B is incorporated in another image forming apparatus, the final date of use of the process cartridge B can be equally identified.

Then, while the process cartridge B is mounted on the image forming apparatus main body 100 side, the final date of use of the process cartridge B stored in the FeRAM 20 is read out by the reader/writer 21 provided in the image forming apparatus main body 100 and sent to calculating means 22. The calculating means 22 calculates the leaving or neglected period of the process cartridge B by utilizing the final date of use of the process cartridge read from the FeRAM 20 and current date information from a calendar provided in an image forming motion controlling portion (called [it] simply a "control portion," hereinafter) 23 for controlling the operation of the image forming apparatus A. After that, when the control portion 23 receives a request for forming an image from the user, the control portion 23 selects a reset operation after the cartridge is neglected on the basis of the leaving period information of the process cartridge B, which is calculated as mentioned above.

Figures 15, 15A:
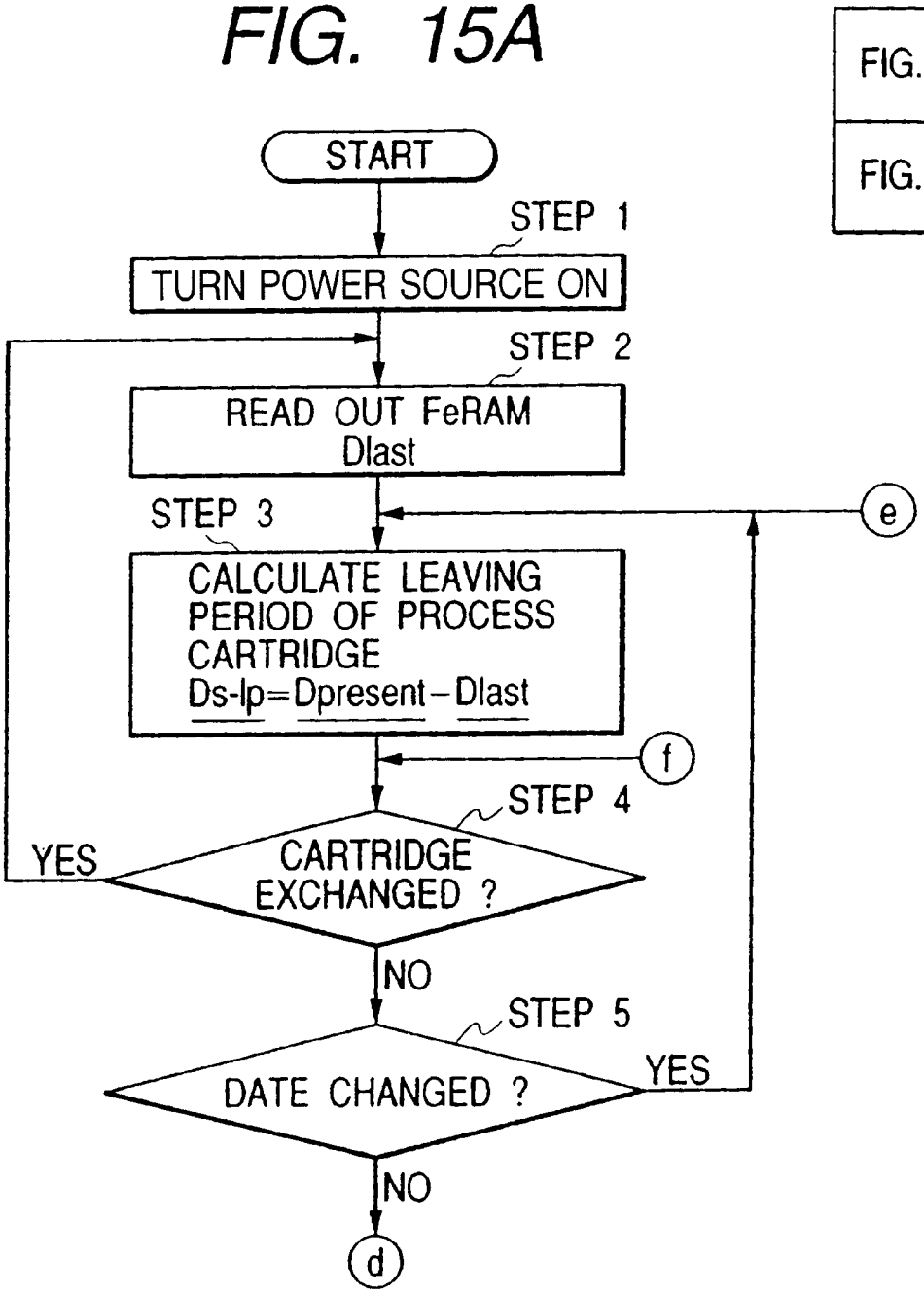
FIG. 15 comprises FIGS. 15A and 15B showing a flow chart for explaining the determination of a period the cartridge is left standing and an action of resetting after the cartridge is left standing the cartridge of the embodiment 6 according to the present invention.
Figure 15B:
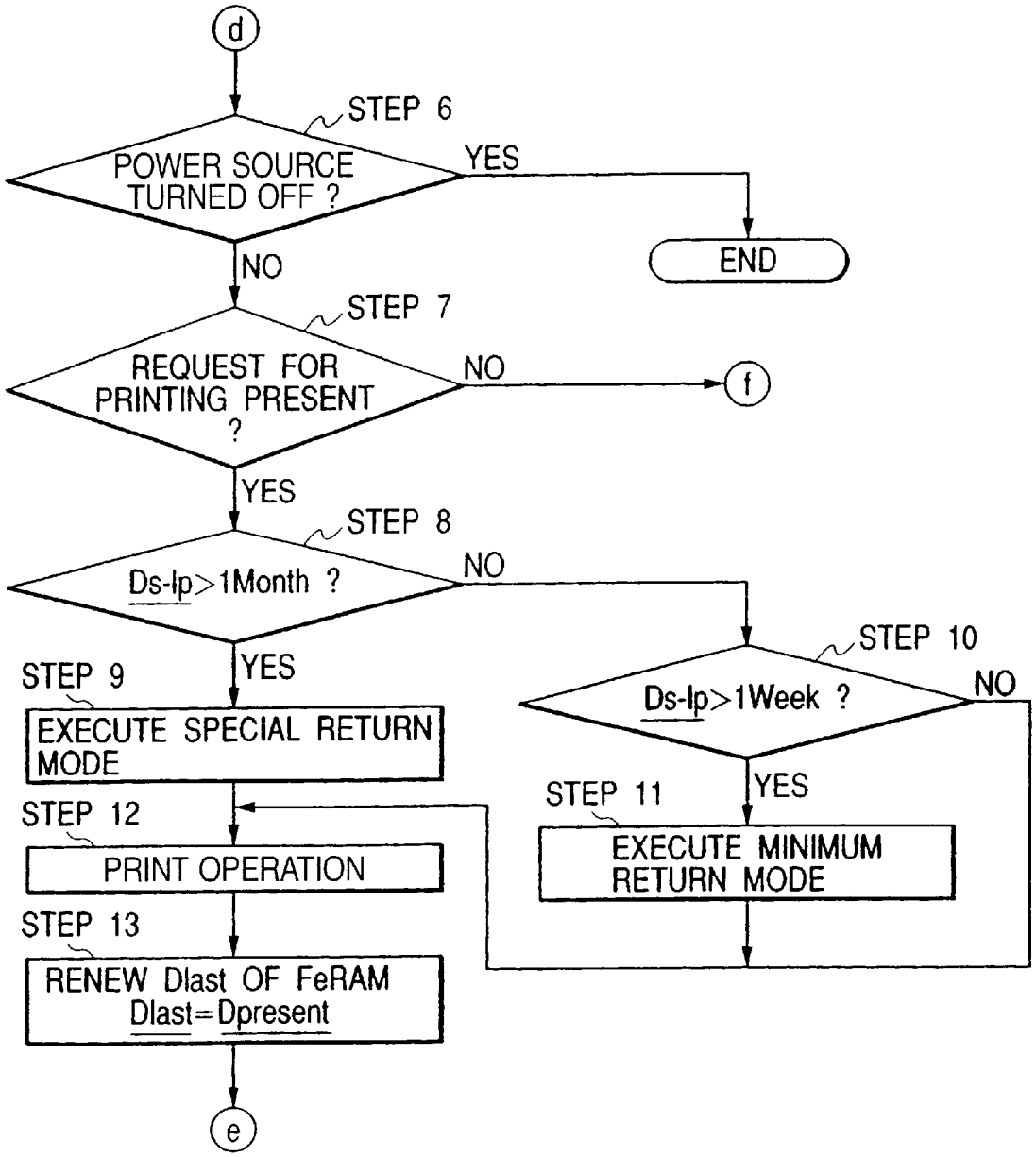

Now, with reference to FIGS. 15A and 15B, the decision of the leaving period of the process cartridge B using the FeRAM 20 and the reset operation after the cartridge is left will be further described. These operations will be shown in a flowchart in FIGS. 15A and 15B.

According to the embodiment 6, when the user turns on the power of the image forming apparatus A on which the process cartridge B is mounted (step 1), or when the user takes out a new process cartridge B from a packaging member to mount it on the image forming apparatus main body 100 (step 4) while the power supply is turned on as described below (step 4), the image forming apparatus A uses the reader/writer 21 to read information stored in the FeRAM20 of the process cartridge B (step 2).

Then, the information read out by the reader/writer 21 is sent to the calculating means 22 provided in the image forming apparatus main body 100. The image forming apparatus A calculates the number of days (Ds-1p) by means of the calculating means 22 by during which the process cartridge B is left, in other words, the operation is stopped, by using the following equation:

$$Ds\text{-}1p = D\text{present} - D\text{last}$$

on the basis of the read last date (Dlast) of use of the process cartridge B and a present date (Dpresent) (step 3).

Subsequently, while the power is turned on, the image forming apparatus A of the present embodiment respectively monitors whether or not the process cartridge B is replaced by another cartridge (step 4) and whether or not the date changes (step 5) until an image forming operation request is sent from the user (step 7) or until the power is turned off (step 6). When the process cartridge B is replaced by another cartridge, a procedure returns to the step (step 2) for reading the information in the FeRAM 20. When the date changes, the procedure returns to the calculating step (step 3) of the calculating means 22 using the present date to calculate again the number of days (Ds-1p) during which the process cartridge B is left. In step 4, it can be decided whether or not the process cartridge B is replaced by another cartridge by, for instance, detecting the opening or closing of the door 16 of the image forming apparatus main body 100 as an insert hole of the process cartridge B.

When the control portion 23 receives a request for forming an image from the user (step 7), the control portion 23 compares the calculated number of days(Ds-1p) during which the process cartridge B is left with a plurality number of reference days for selecting the reset operation after the cartridge is left, which are predetermined, and, for instance, stored in the storing portion of the image forming apparatus main body 100 to select the reset operation after the cartridge is left, before entering an image forming operation.

In the embodiment 6, as a plurality number of reference days for selecting the reset operation, two types of one week and one month are set, which are respectively compared with the number of days (Ds-1p) during which the process cartridge B is left in steps 10 and 8 as shown in FIGS. 15A and 15B.

Specifically, according to the embodiment 6, when it is decided that the number of days (Ds-1p) during which the process cartridge B is left exceeds one month in step 8, a reset operation of "Special return mode" with the contents described later in detail is executed (step 9), and then, the procedure moves to an image forming operation (step 12) .

Further, even in the case where it is decided that the number of days (Ds-1p) during which the process cartridge B is left is within one month in step 8, if it is decided that the number of days (Ds-1p) during which the process cartridge B is left exceeds one week in the subsequent step 10, a reset operation of "Minimum return mode" is performed with the contents described specifically below, and then, the procedure moves to an image forming operation (step 12) .

When it is decided that the number of days (Ds-1p) during which the process cartridge B is left is within one week in accordance with the decision of the step 10, a reset operation after the cartridge is left is not especially carried out to shift to the image forming operation (step 12) .

After the image forming operation is finished, the reader/writer 21 writes the present date (Dpresent) in the last date (Dlast) of use of the process cartridge B stored in the FeRAM 20 of the process cartridge B to update the information of the last date (Dpresent) of use of the process cartridge B.

These operations are carried out upon turning on [a] power, [exchange] exchanging of the process cartridge B, and [update] updating of date as mentioned above.

Now, the returning (reset) operation performed after the cartridge is left will be described in more detail.

Even when the cartridge B or the components of the process cartridge B are left after the start of use thereof, the quality of an image [is] does not necessarily [deteriorated] deteriorate. The type of deterioration is as follows:

As described above, the process cartridge B comprises the photosensitive drum 1, the charging roller 2 abutting on the photosensitive drum 1 under pressure, the cleaning blade 7*a*, the developing roller 5*a*, the developer housing vessel 4 connected to the developing roller 5*a*, and the waste developer vessel 7*b* connected to the cleaning blade 7*a* which are integrally formed.

Since the charging roller 2 is pressed to and abuts on the photosensitive drum 1, the charging roller may be possibly deformed especially when it is left in a high temperature and high humidity environment, and then, the deformation may not be restored for a while even by opening the abutting part with rotation and, a slight charging failure may be generated in that part and transverse stripes corresponding to the rotating periods of the charging roller 2 may be generated in a halftone image. For overcoming this phenomenon, the charging roller 2 is idly run while voltage is applied to the charging roller 2 so that the deformation can be reduced before the image forming operation. At this time, when AC bias is applied to voltage applied to the charging roller at this time, the charging roller 2 is vibrated to effectively restore the deformation.

Further, since the cleaning blade 7*a* is also pressed to and abuts on the photosensitive drum 1, when the cleaning blade 7*a* is left in a high temperature and high humidity environment similarly to the charging roller 2, small dents are generated on the photosensitive drum 1. When the cleaning blade 7*a* passes again the dents on the photosensitive drum 1 upon rotation of the photosensitive drum 1, a deviation is generated in the rotation of the photosensitive drum 1. The deviation in rotation is caused to appear as the blur of an image upon writing the image by a laser and transferring it. Further, even before the dents are formed on the photosensitive drum 1, when the developer removed from the photosensitive drum 1 remains and is left between the cleaning blade 7*a* and the photosensitive drum 1, the developer sticks to the photosensitive drum 1. Thus, when that part similarly passes the cleaning blade 7*a*, a deviation in rotation is generated. This deviation in rotation can be substantially eliminated so as to have no effect by rotating the photosensitive drum 1 for some time. At this time, the photosensitive drum 1 is rotated while a developing operation by the developer is performed, and the deviation in rotation can be more effectively cancelled.

Further, since the developing roller 5*a* is left while the surface of the developing roller 5*a* is coated with the developer, a part of the developer exposed outside the developer housing vessel 4 is apt to be subjected to the influence of an external environment more than a part of the developer inside the developer housing vessel 4. When the developer is left in a high temperature and high humidity environment, the developer absorbs moisture to lower its resistance and hardly have an electric charge. Therefore, the developer in a part located outside the developer housing vessel 4 causes the density of a formed image to be lowered. On the other hand, when the developer is left in a low temperature and low humidity environment, the developer becomes dry and its resistance is raised so that the developer has, conversely, excessive electric charge. Therefore, it is difficult to develop an image. Also in this case, the developer in a part located outside the developer housing vessel 4 causes the density of a formed image to be lowered. In these cases, if the developer in the part located outside the developer housing vessel 4 is consumed, the partial deterioration of density can be cancelled. Further, when toner in the developer housing vessel 4 is left for a longer period, the developer is liable to aggregate, so that there may arise a phenomenon in which the density of the formed image is lowered. In this case, this phenomenon can be improved to some degree by rotating the agitating means 5 in the developer housing vessel 4 before the image is formed, so that the developer is sufficiently [got loose] loosened.

The above described deterioration of the image quality by leaving the process cartridge B or the components of the process cartridge B is generated owing to leaving them for a relatively short period, such as the deterioration of density due to the change of the developer, and owing to leaving them for a relatively long period such as the deformation of the charging roller 2, minute dents of the photosensitive drum 1 due to the cleaning blade 7*a*, the adhesion of the developer, etc., occur.

Therefore, according to the embodiment 6, as a reset operation after the process cartridge B or the components of the process cartridge B are left as they are, are set two kinds of modes including a reset operation "Minimum return mode" relative to the deterioration of image quality, which is generated due to a neglect for a relatively short period and a reset operation "Special return mode" relative to the deterioration of image quality, which is generated due to a neglect for a relatively long period. Two kinds of the number of reference days respectively selected thereto are set to one week and one month.

In the present embodiment, the contents of specific operations are determined as described below.

"Minimum Return Mode"

A solid image of the length of two circumferences of the developing roller 5*a* is developed.

"Special Return Mode"

The photosensitive drum 1, the developing roller 5*a* and the agitating means 15 in the developer housing vessel 4 are rotated for 30 seconds and a solid transverse stripe image, the total amount of development of which corresponds to the two circumferences of the developing roller 5*a* is intermittently developed during the rotation and AC bias is applied to the charging roller 2.

According to the present invention, the leaving period of the process cartridge B can be discriminated regardless of turning on/off of the power source and loading/unloading of the process cartridge B relative to the image forming apparatus main body 100, and it can be decided whether or not the reset operation is required after the neglect of the process cartridge depending on the leaving period, the contents of the operation can be decided, and the reset operation can be executed with a suitable amount and at a suitable timing after the cartridge is left. Therefore, the process cartridge B is not exhausted by carrying out an unnecessary reset operation as in the prior art, so that the user can always obtain a desirable image and can sufficiently use the process cartridge by a quantity [enough] sufficient to form an original image.

In the storing means, not only the last date of use of the cartridge as in the present embodiment, but also the reference number of days for selecting the reset operation after the cartridge is neglected, the operating time of the selected reset operation or information concerning the number of times, etc., can be stored. Thus, the difference of the amount of developer housed in the cartridge due to, for instance, a little change in design, the difference of employed parts or the like, can be met.

Further, according to the present invention, the contents of the reset operation after the cartridge is left are not limited to the contents described in the present embodiment, and any reset operation by which the deterioration of an image generated owing to the neglect of the cartridge can be avoided can obtain the same effects as those of the present invention. Further, it should be noted that the reference number of selected days and period of the reset operation after the cartridge is left are not limited to the contents of the embodiment 6 and the number may be increased as required and the period may be properly selected from among the leaving periods during which it can be estimated that the image quality [is] has deteriorated.

Embodiment 7

An image forming apparatus of the embodiment 7 is basically equal to the image forming apparatus of the embodiment 6. In the embodiment 7, an [image quality deterioration avoiding] image-quality-deterioration-avoiding operation upon leaving a cartridge by which the deterioration of image quality is avoided after the cartridge is left will be described in addition to a reset operation after the cartridge is left as it is. Further, in the embodiment 7, the [leaving period] leaving-period discriminating system of cartridge components is formed in accordance with the present invention. In the storing means 20 of a process cartridge B, the last date (Ddlast) on which a photosensitive drum 1 is rotated as the final date of use of the cartridge components and the last date (Dtlast) on which an developing operation is performed by a developer are stored. In the embodiment 7, members having the same functions and configurations as those of the image forming apparatus and the process cartridge B of the first embodiment are denoted by the same reference numerals and a detailed explanation is omitted.

Figure 16:
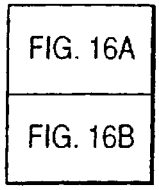
FIG. 16 comprises FIGS. 16A and 16B showing a flow chart for explaining the determination of a period the cartridge is left standing, the action to avoid lowering of image quality when the cartridge is left standing, and the action of resetting after the cartridge is left standing of the embodiment 7 according to the present invention.
Figure 16A:
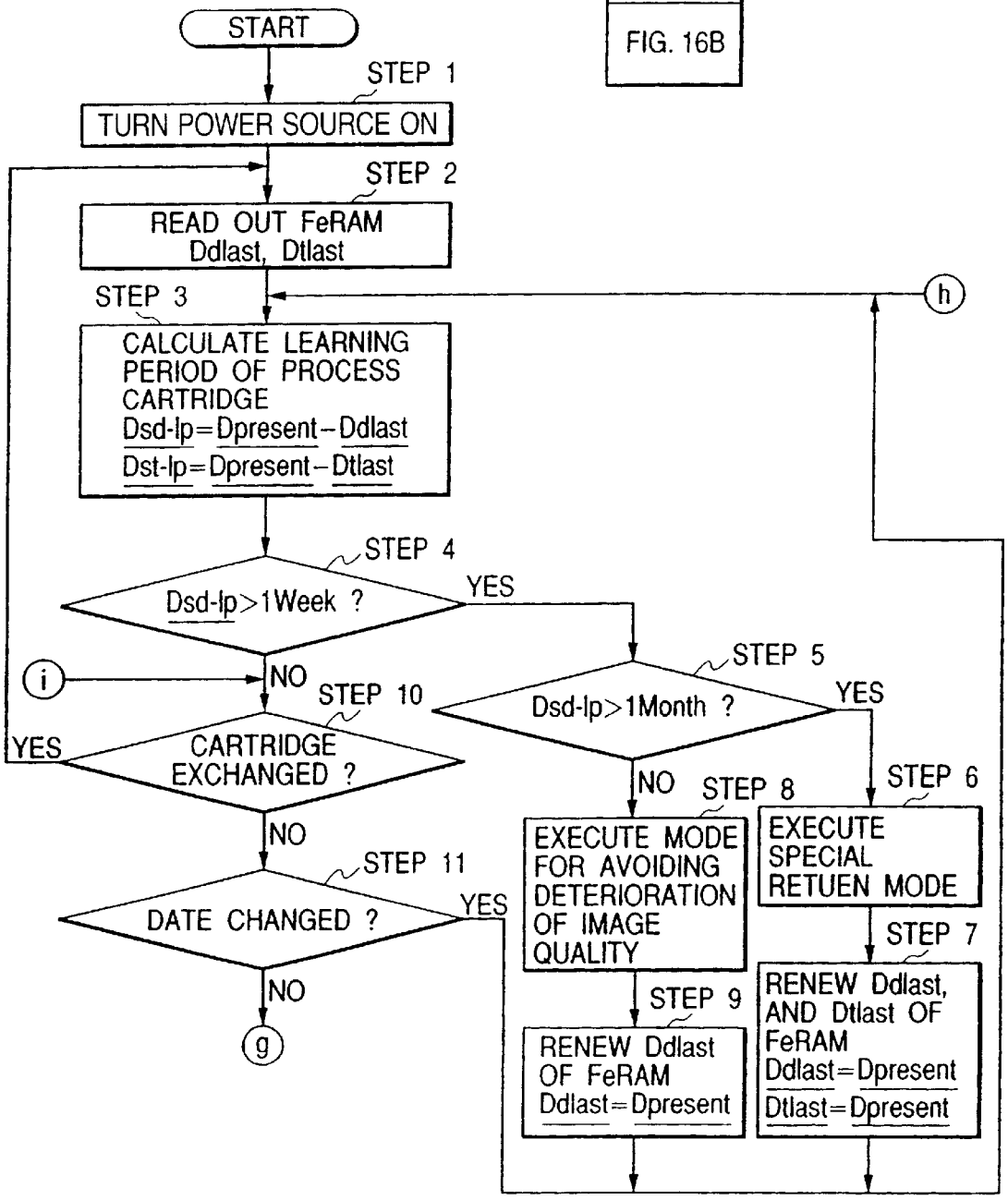
Figure 16B:
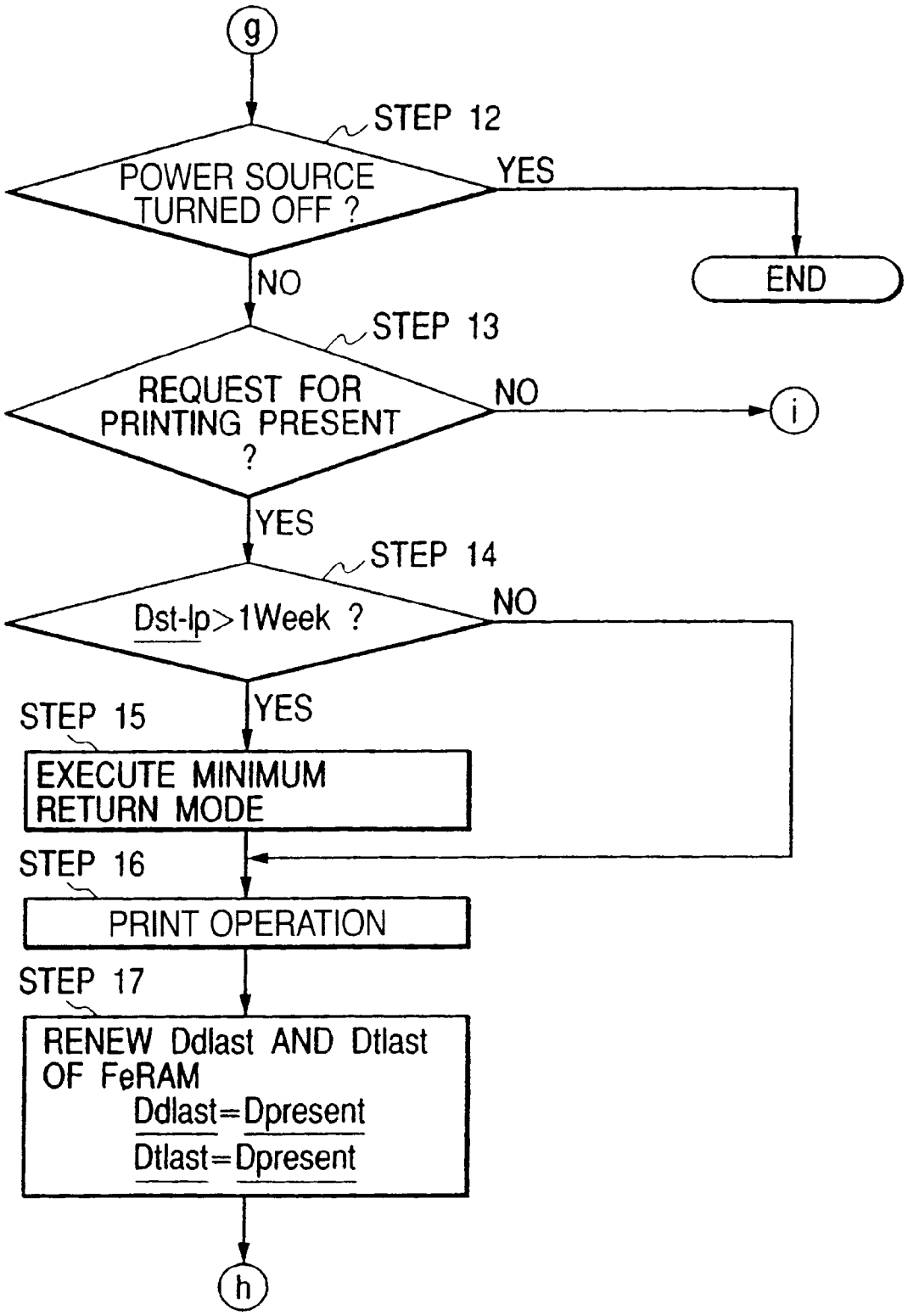

Referring to FIGS. 16A and 16B, the decision of the leaving period of the process cartridge B using an FeRAM 20 and a reset operation after the cartridge is left in the embodiment 7 will be described. These operations are shown in a flowchart in FIGS. 16A and 16B.

According to the embodiment 7, when a user turns on the power source of the image forming apparatus A on which the process cartridge B is mounted (step 1) or when the user takes out a new process cartridge B from a packaging member and mounts it on an image forming apparatus main body 100 while the power source is turned on as mentioned below (step 10), the image forming apparatus A reads out information stored in the FeRAM 20 of the process cartridge B by using a reader/writer 21 (step 2).

Then, the information read by the reader/writer 21 is sent to calculating means 22 provided in the image forming apparatus main body 100. The image forming apparatus A calculates the number of days during which the photosensitive drum 1 and the developer of the process cartridge B are left, in other words, an operation is stopped (respectively, Dsd1p, Dst-1p) by using the calculating means 22 on the basis of the read last date (Ddlast) on which the photosensitive drum 1 is rotated, the last date (Dtlast) on which the developing operation is carried out by the developer and a present date (Dpresent), in accordance with following equations (step 3).

$$Dsd\text{-}1p = D\text{present} - Dd\text{last}$$

$$Dst\text{-}1p = D\text{present} - Dt\text{last}$$

Then, a controlling portion 23 compares the calculated number of days (Dsd-1p) during which the photosensitive drum 1 is left with a plurality of reference number of days for determining whether or not the [image quality deterioration avoiding] image-quality-deterioration-avoiding operation upon neglect of the cartridge is necessary, which are predetermined and stored in, for example, the storing portion of the image forming apparatus main body 100 to determine whether or not the [image quality deterioration avoiding] image-quality-deterioration-avoiding operation upon neglect of the cartridge is necessary.

In the embodiment 7, as a plurality of reference number of days for selecting the [image quality deterioration avoiding] image-quality-deterioration-avoiding operation upon neglect of the cartridge, are set two kinds of one week and one month, which are equal to the reference number of days for selecting the reset operation after the cartridge is left as described in the embodiment 6. Each of them is compared with a number of days (Dsd-1p) during which the photosensitive drum 1 is left in step 4 and step 5.

That is, according to the embodiment 7, when it is decided that the number of days (Dsd-1p) during which the photosensitive drum 1 is left exceeds one week in step 4 and further exceeds one month in step 5, an operation of "Special return mode" the same as the reset operation after the cartridge is left as described in the first embodiment is immediately executed (step 6), because a situation where the process cartridge B is left, which may possibly cause the image quality to be deteriorated to some degree is prevented [to proceed more] from proceeding further. Then, after the operation of "Special return mode" is executed, the image forming apparatus A writes the present date (Dpresent) in the last date (Ddlast) on which the photosensitive drum 1 is rotated and the last date (Dtlast) on which the developing operation is performed by the developer, which are stored in the FeRAM 20 of the process cartridge B to update the information in the FeRAM 20.

Further, in step 5, when it is decided that the number of days (Dsd-1p) during which the photosensitive drum 1 is left is within one month, and therefore however, exceeds one week, an operation of "image quality deterioration avoiding mode" is executed (step 8). This operation is performed so that the photosensitive drum 1 is slightly rotated to shift positions where a charging roller 2 and a cleaning blade 7*a* abut on the photosensitive drum 1. Thus, the pressing and abutting parts are released while the deformation of the charging roller 2 and the damage of the photosensitive drum 1 due to the cleaning blade 7*a* do not comparatively proceed, so that the above described deterioration of the image quality resulting therefrom can be prevented.

Then, after the operation [of] "image quality deterioration avoiding mode" is performed (step 8), the image forming apparatus A writes the present date (Dpresent) in the last date (Ddlast) on which the photosensitive drum 1 is rotated and which is stored in the FeRAM 20 of the process cartridge B by the reader/writer 21 to update the information in the FeRAM 20.

In the description of step 4, when it is decided that the number of days (Dsd-1p) during which the photosensitive drum 1 is left is within one week, the operation for avoiding the deterioration of image quality upon neglect of the cartridge is not especially carried out.

Subsequently, the image forming apparatus A of the present embodiment respectively monitors, while a power source is turned on, whether or not the process cartridge B is replaced by another cartridge (step 10) and whether or not the date changes (step 11) until the apparatus receives a request for an image forming operation from a user (step 16) or until the power source is turned off (step 12) . When the process cartridge B is replaced by another cartridge, the procedure returns to the step (step 2) for reading out the information in the FeRAM 20. When the date changes, the procedure returns to the calculating step (step 3) of the calculating means 22 using the present date to calculate again the number of days (respectively Dsd-1p, Dst-1p)

during which the photosensitive drum 1 and the developer are respectively left. In step 4, it can be decided whether or not the process cartridge B is replaced by another cartridge by detecting, for instance, the opening and closing of the door 16 of the image forming apparatus main body 100 as the insert hole of the process cartridge B.

Further, when the controlling portion 23 receives a request for forming an image from the user (step 13), the controlling portion 13 compares the calculated number of days (Dst-1p) during which the developer is left with the reference number of days for selecting the reset operation after the developer is left, which is predetermined and stored in, for instance, the storing means of the image forming apparatus main body 100 (step 14) to select the reset operation after the developer is left, before the entry of an image forming operation. In the present embodiment, [as] the reference number of days for selecting the reset operation after the developer is left, is set one week.

That is, according to the present invention, when it is decided that the number of days (Dst-1p) during which the developer is left exceeds one week in step 14, the operation of "Minimum return mode", which is the same as the reset operation after the cartridge is left ,and which is described in the embodiment 6, is carried out to move to an image forming operation (step 16). When the number of days (Dst-1p) during which the developer is left is within one week in accordance with the decision in step 14, the reset operation after the cartridge is left is not especially performed to shift to the image forming operation (step 16).

After the image forming operation is completed, the image forming apparatus A writes the present date (Dpresent) in the last date (Ddlast) on which the photosensitive drum 1 is rotated and the last date (Dtlast) on which the developing operation is carried out by the developer, which are stored in the FeRAM 20 of the process cartridge B by the reader/writer 21 to update the information in the FeRAM 20.

These operations are carried out upon turning on the power source, at the time of exchanging the process cartridge B and updating the date, as described above.

As mentioned above, according to the present invention, the leaving period of the components of the process cartridge B can be discriminated regardless of turning on/off of the power source of the image forming apparatus A, and loading/unloading of the process cartridge B relative to the image forming apparatus main body 100, and it can be decided whether or not the [image quality deterioration avoiding] image-quality-deterioration-avoiding operation upon neglect of the process cartridge and the reset operation after the cartridge is left are necessary depending on the leaving period, and the contents of the reset operation can be decided and the [image quality deterioration avoiding] image-quality-deterioration-avoiding operation upon neglect of the cartridge and the reset operation after the cartridge is left can be executed at an appropriate timing. Therefore, the process cartridge B is not exhausted by performing an unnecessary reset operation as in the prior art, the user can always obtain a desirable image and an operation for preventing the deterioration of image quality can be minimized as much as possible. Accordingly, the process cartridge B can [be] sufficiently employ employed by a quantity [enough] sufficient to form an essential image.

In the storing means 20 of the process cartridge B, not only the last date on which the photosensitive drum 1 and the developer are employed, as the last date on which the cartridge components are used as described above in the present embodiment, but also the last date on which are used the cartridge components integrated with the cartridge, whose conditions change when they are left, such as charging means, developer feeding means, a developer housing vessel, a cleaning blade, a waste developer vessel, etc. is stored. Thus, the effects of the present invention can be attained. Further, in the storing means 20 similarly as the embodiment 6, can be also stored information concerning the [image quality deterioration avoiding] image-quality-deterioration-avoiding operation upon neglect of the cartridge, the reference number of days for selecting the reset operation after the cartridge is left, the operating time of the selected operation, the number of times, etc. Thus, the difference of a developer amount and the difference of employed parts, or the like may be met.

Further, according to the present invention, it should be noted that the contents of the [image quality deterioration avoiding] image-quality-deterioration-avoiding operation upon neglect of the cartridge and the reset operation after the cartridge is left are not limited to those of the embodiment 7, but any operation capable of improving the deterioration of the image quality generated owing to the neglect of the cartridge can realize the effects of the present invention. Further, it should be recognized that the [image quality deterioration avoiding] image-quality-deterioration-avoiding operation upon neglect of the cartridge and the reference number of days and period for selecting the reset operation after the cartridge is left are not limited to the contents of the present embodiment, and the number of days may be increased if necessary or may be properly selected depending on the leaving period in which it is estimated that the deterioration of image quality is generated.

Here, in the embodiments 6 and 7, although the cartridge detachably attached to the image forming apparatus main body 100 is the process cartridge B comprising the photosensitive drum 1, the charging means 2 as the process means acting on the photosensitive drum 1, the developing means 5 and the cleaning means 7*a*, the developer housing vessel 4 and the waste developer vessel 7*b*, which are integrally formed, needless to say, the cartridge detachably attached to the image forming apparatus main body 100 to which the present invention is applicable is not limited thereto, and the present invention may be applied to the developing apparatus (developing cartridge) C formed as a cartridge and the photosensitive drum cartridge D as shown in FIGS. 6 and 7 to achieve the same operation and effects.

Further, in the respective embodiments, as the storing means for storing the last date on which the process cartridge B is employed, or the last date on which the photosensitive drum 1 and the developer are used, the FeRAM 20 as a non-contact type non-volatile memory is employed. Therefore, it is not necessary to provide a power source in the process cartridge B side and the information can be advantageously read and written in the information forming apparatus main body 100 side under a non-contact state. However, it should be noted that the storing means is not limited thereto in the present invention, and any storing means capable of storing information may be employed without a special limitation. Thus, for example, a combination of the EEPROM or the volatile memory with a backup battery may be utilized.

Embodiment 8

Figure 17:
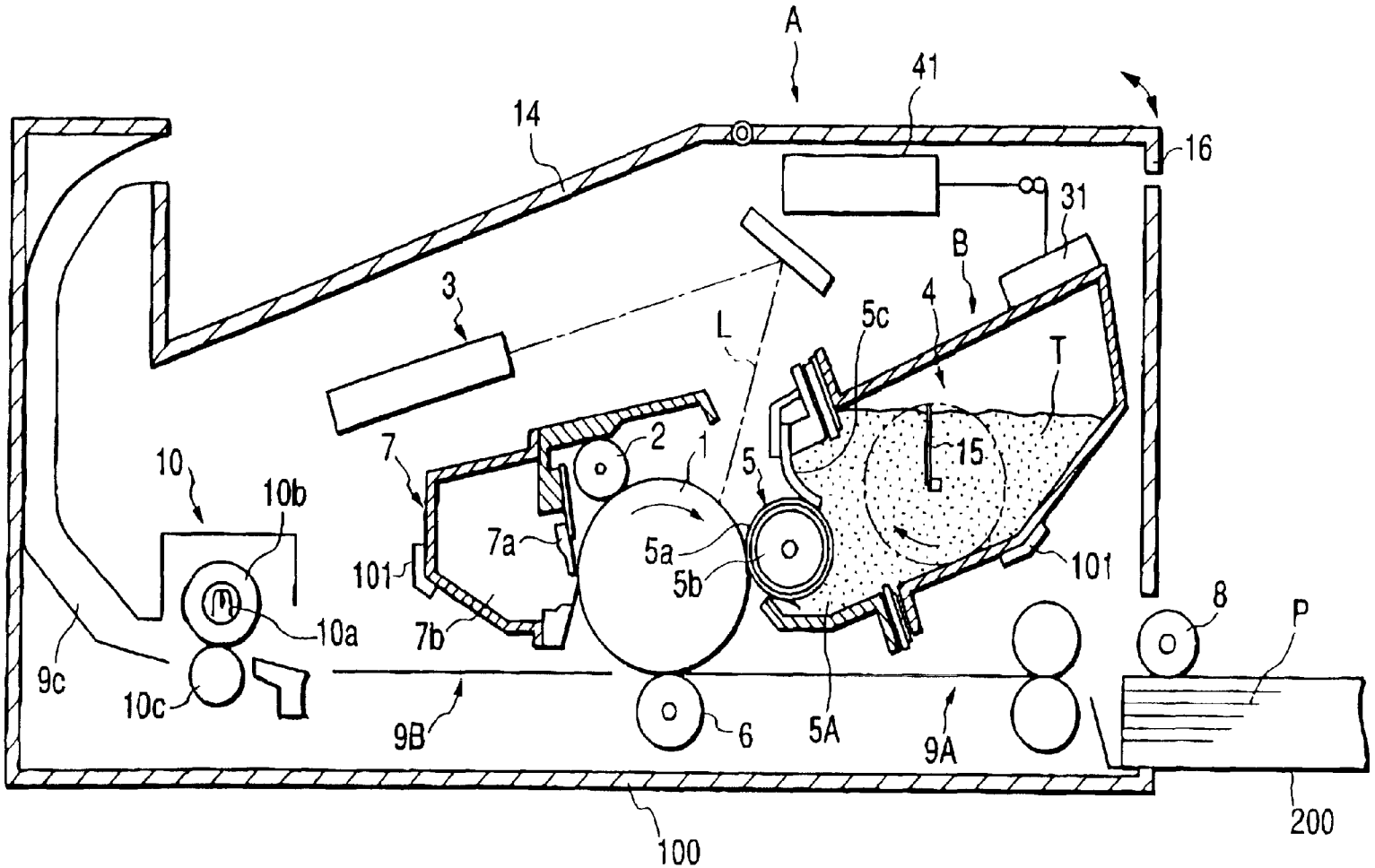
FIG. 17 is a sectional view of an example of a process cartridge and an image forming apparatus of embodiments 8 and 9 according to the present invention.

Now, an embodiment 8 of the present invention will be described below. Initially, referring to FIGS. 17 and 18, an embodiment 8 of an electrophotographic image forming apparatus to which a process cartridge configured according to the present invention is detachably attachable will be described below. In the embodiment 8, the electrophotographic image forming apparatus is specified as an electrophotographic laser beam printer A and is adapted to receive image information from a host computer and form an image on a recording medium, such as a recording sheet, an OHP sheet, a cloth, etc. in accordance with an electrophotographic image forming processes.

The laser printer A has a drum shaped electrophotographic photosensitive body, in other words, a photosensitive drum 1. The photosensitive drum 1 is charged by a charging roller 2 as charging means, and then, is irradiated with a laser beam L corresponding to image information from a laser scanner 3 so that a latent image corresponding to the image information is formed on the photosensitive drum 1. The latent image is developed by developing means 5 to obtain a visible image, namely, a toner image.

Namely, the developing means 5 has a developing chamber 5A provided with a developing roller 5*a* serving as a developer carrier. A developer T in a developer housing vessel 4 formed as a developer housing part adjacent to the developing chamber 5A is supplied to the developing roller 5*a* of the developing chamber 5A. In the developer housing vessel 4, is provided agitating means 15 rotating in the direction shown by an arrow mark in FIG. 17. The agitating means 15 rotates so that the developer T is supplied to the developing roller 5*a* while it is loosened. In the embodiment 8, as the developer T, toner including an insulating magnetic component is employed. The developing roller 5*a* is integrated with a fixed magnet 5*b*. The developing roller 5*a* is rotated to carry the developer. Thus, a frictionally charged electric charge is applied to the developing roller by a developing blade 5*c* as a developer layer thickness regulating member so that [the] a developing layer with prescribed thickness is formed thereon and is supplied to the developing area of the photosensitive drum 1. The developer supplied to the developing area is transferred to the latent image on the photosensitive drum 1 to form a toner image. The developing roller 5*a* is connected to a developing bias circuit and developing bias voltage with dc voltage superimposed on ac voltage is usually applied to the developing roller.

On the other hand, a recording medium P set on a sheet feeding cassette 200 is conveyed to a transferring position through a pick-up roller 8 and conveying means 9A in synchronization with the formation of the toner image. At the transferring position, a transferring roller 6 as transferring means is arranged to apply voltage to the recording medium to transfer the toner image on the photosensitive drum 1 to the recording medium P.

The recording medium P to which the toner image is transferred is conveyed to fixing means 10 by conveying means 9B. The fixing means 10 is provided with a fixing roller 10*b* integrated with a heater 10*a* and a driving roller 10*c* to apply heat and pressure to the recording medium P passing therethrough and fix the transferred toner image onto the recording medium P.

The recording medium P is discharged to a discharging tray 14 by conveying means 9C. The discharging tray 14 is provided on the upper surface of the image forming apparatus main body 100 of the laser beam printer A.

The photosensitive drum 1 after the toner image is transferred to the recording medium P by the transferring roller 6 is employed for a next image forming process, after the developer remaining on the photosensitive drum 1 is removed by cleaning means 7. The cleaning means 7 scrapes out the residual developer on the photosensitive drum 1 by an elastic cleaning blade 7*a* abutting on the photosensitive drum 1 and collects the residual developer to a waste developer vessel 7*b*.

Figure 18:
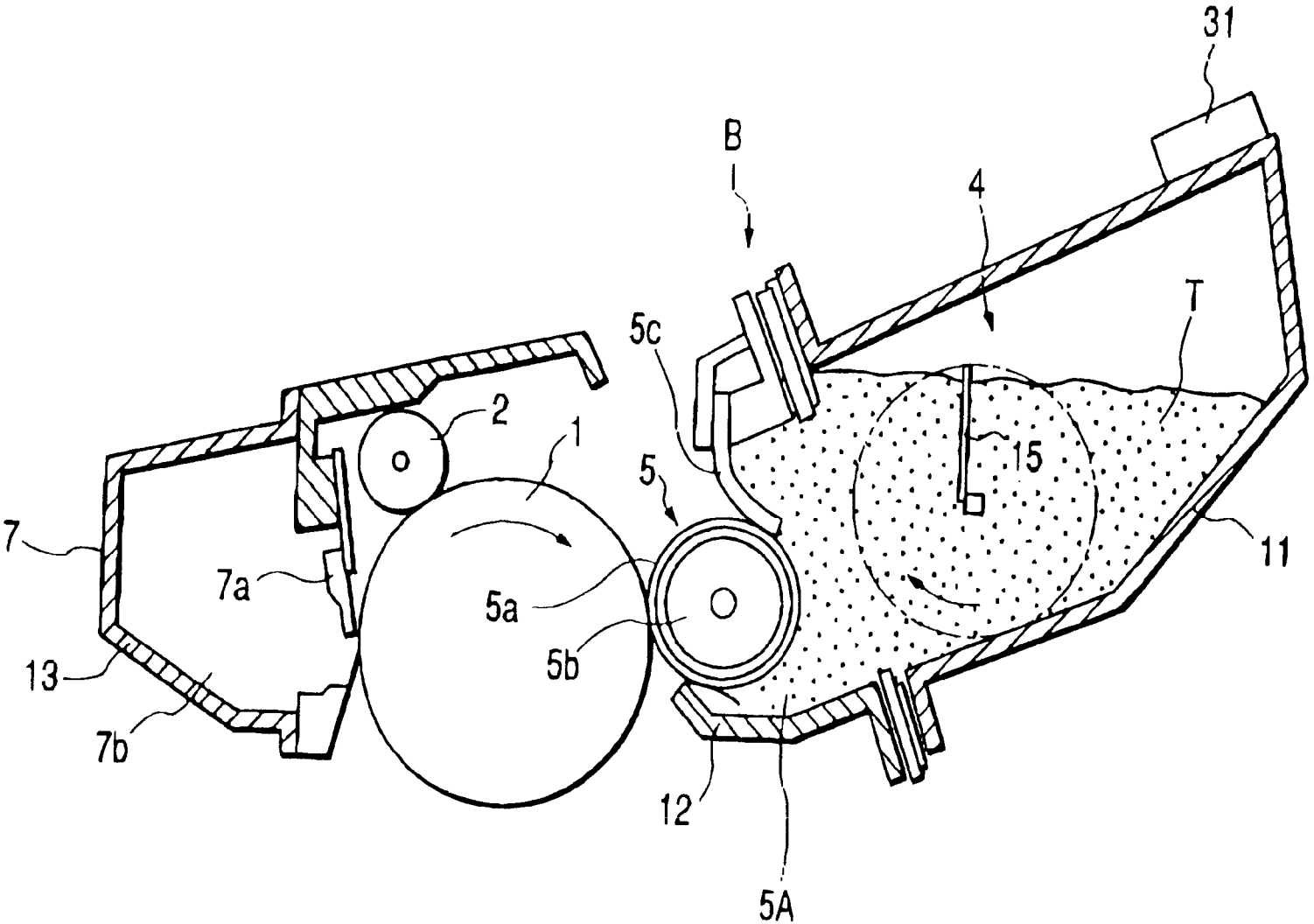
FIG. 18 is an enlarged sectional view of the process cartridge in FIG. 17.

On the other hand, according to the embodiment 8, a process cartridge B comprises, as shown in FIG. 18, a developing frame body 11 having the developer housing vessel (developer housing part) 4 for housing the developer and the agitating means 15 and a developing frame body 12 for holding the developing means 5 such as the developing roller 5*a* and the developing blade 5*c* or the like which are integrally welded to form a developing unit. Further, to the developing unit, is integrally connected a cleaning frame body 13 to which the photosensitive drum 1, the cleaning means 7 such as the cleaning blade 7*a* and the waste developer vessel 7*b* and the charging roller 2 are integrally attached to constitute a cartridge.

This process cartridge B is detachably attached to cartridge mounting means 101 (see FIG. 17) provided in the image forming apparatus main body 100 by the user.

Now, an individual identification method for cartridge according to the present invention will be described below.

According to the present invention, the process cartridge B is provided with storing means 31. While the process cartridge B is mounted on the image forming apparatus main body 100, the contents of the storing means 31 can be read and written by the image forming apparatus main body 100.

According to the embodiment 8, as the storing means 31 provided in the process cartridge B, a readable/writable non-volatile memory (call it simply a "memory," hereinafter) is employed. In this memory 31, are stored the manufacturing date of the process cartridge B and the serial number of the process cartridge manufactured on this date.

Figure 19:
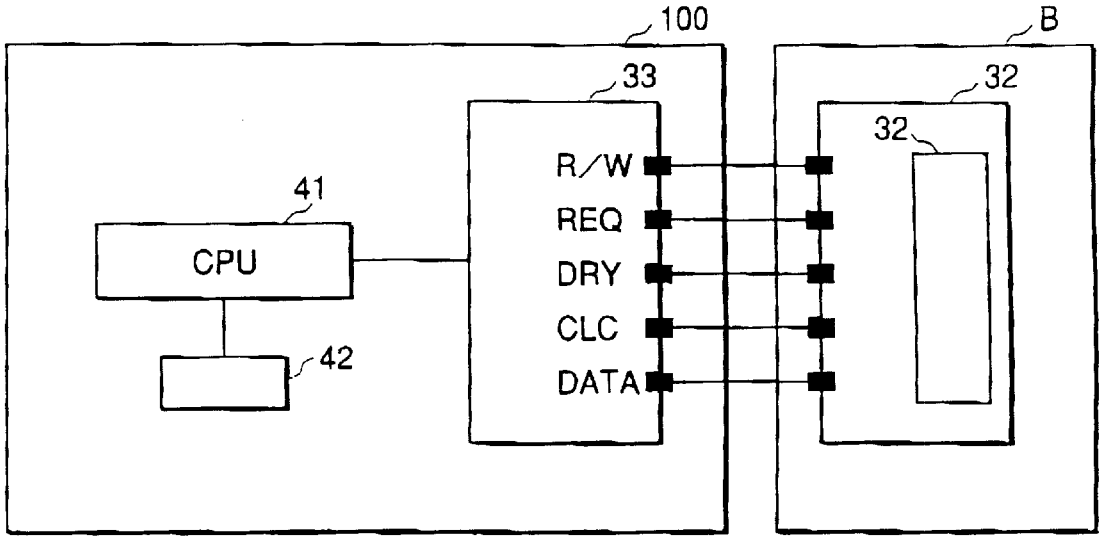
FIG. 19 is a view of an outlined relation to explain the relationship between memory means installed in the process cartridge and the main body of the image forming apparatus of the embodiments 8 and 9 according to the present invention.

Further, referring to FIG. 19, the process cartridge B comprises a memory 31 in which the manufacturing date of the process cartridge B and the serial number of the process cartridge B manufactured on the manufacturing date are stored as cartridge individual discriminating (identifying) information (cartridge identifying information) and a cartridge side reading/writing controlling part 32 for controlling the reading/writing of the information relative to the memory 31. When the process cartridge B is mounted on the image forming apparatus main body 100, the cartridge side reading/writing controlling part 32 and a reading/writing controlling part 33 in the image forming apparatus main body 100 side are connected to each other by signal lines R/W, REQ, DRY, CLC and DATA. As described above, as the information reading /writing means relative to the memory 31, the reading/writing controlling part 33 in the image forming apparatus main body 100 side and the reading/writing controlling part 32 in the cartridge side are provided.

Further, in the image forming apparatus main body 100, a CPU (central processing unit) 41 for generally controlling the operation of the image forming apparatus A is provided. The CPU 41 is electrically connected to the reading/ writing controlling part 33 in the image forming apparatus main body 100 side so that the information read from the memory 31 of the process cartridge B can be inputted thereto.

When the power source of the image forming apparatus A is turned on or a door 16 (see FIG. 17) serving as the insert hole of the process cartridge B is opened/closed, the CPU 41 decides that the process cartridge B [has a] is possibility different from that set to the image forming apparatus main body 100 up to that time, in other words, the cartridge B may be possibly replaced by another cartridge, and reads out the manufacturing date and the serial number stored in the memory 31 of the process cartridge B. In the present embodiment, the CPU 41 provided in the image forming apparatus A functions as identifying means to identify the process cartridges B individually from these two information.

That is, according to the embodiment 8 of the present invention, the CPU 41 provided in the image forming apparatus main body 100 is electrically connected to a storing part 42 provided in the image forming apparatus main body 100. The storing part 42 can store the cartridge identifying information read from the memory 31 of the process cartridge B, that is to say, the manufacturing date of the process cartridge B and the serial number of the process cartridge manufactured on that day in this embodiment therein.

Then, when the CPU 41 detects that the power source of the image forming apparatus A is turned on, or the door 16 is opened/closed, the CPU 41 reads out the cartridge identifying information stored in the memory 31 of the process cartridge B and compares it with the cartridge identifying information held in the storing part 42 in the image forming apparatus main body side.

At this time, when the CPU 41 decides that the cartridge identifying information read from the memory 31 of the process cartridge B does not correspond to the cartridge identifying information already stored in the storing part 42 in the image forming apparatus main body 100 side, the CPU 41 decides that the process cartridge B mounted on the image forming apparatus main body 100 is a newly mounted cartridge, and writes the cartridge identifying information of the new cartridge in the storing part 42 of the image forming apparatus main body 100 side. In the present embodiment, the storing part 42 is composed of a non-volatile memory in which the written cartridge identifying information is held.

On the other hand, when the cartridge identifying information read from the memory 31 of the process cartridge B corresponds to the cartridge identifying information already stored in the storing part 42, the CPU 41 decides that the process cartridge B is equal to a process cartridge B which has been already stored in the storing part. In such a way, the process cartridge B can be assuredly identified on the basis of the manufacturing date of the process cartridge B and the serial number of the process cartridge B manufactured on that day, which are stored in the memory 31 of the process cartridge B.

As described above, as the cartridge individual identifying information, the manufacturing date of the process cartridge B and the serial number of the process cartridge B manufactured on the manufacturing date are stored, in other words, the cartridge is further specified by manufacturing date information as information except for the serial numbers, so that the capacity of cartridge identifying information to be stored in the memory 31 can be decreased.

Now, an example of the operation of the image forming apparatus A using the cartridge identifying information stored in the memory 31 of the process cartridge B in accordance with the present invention will be described below.

The image forming apparatus main body 100 reads the contents stored in the memory 31 of the process cartridge B and the CPU 41 is adapted to decide the contents and execute a proper processing.

Initially, according to the present invention, the individually mounted process cartridges B are identified by using the cartridge identifying information stored in the memory 31, and hence an operation after a jam processing can be simplified as disclosed in, for example, Japanese Patent Application Laid-Open No. 10-105021.

More specifically, the image forming apparatus A of the present embodiment adjusts a developing bias as an image density adjusting parameter peculiar to each process cartridge B in order to obtain the stability of density of an image. Namely, a prescribed patch latent image is formed on the photosensitive drum 1, and then, the patch latent image is developed. A visible patch image thus obtained is measured by a density sensor (not shown). The CPU 41 performs an image adjusting process for determining an optimum developing bias on the basis of the density of the patch image.

According to the present invention, the individual identification of the process cartridge B mounted on the image forming apparatus main body 100 is carried out as described above so that it can be decided whether the process cartridge B mounted on the apparatus is a newly mounted cartridge or a cartridge mounted again on the apparatus. Only when the new process cartridge B is mounted on the image forming apparatus main body, the CPU 41 executes the image adjusting process. Accordingly, in the case where the process cartridge B is temporarily detached from the image forming apparatus main body 100 and attached again thereto, because of, for instance, the jam processing or the like, the image adjusting process is not necessary, so that the image adjusting process can be omitted to shift rapidly to an image forming operation.

Further, according to the present invention, since the process cartridge B can be individually identified by employing the cartridge identifying information stored in the memory 31 of the process cartridge B, the process cartridge B attached to the image forming apparatus main body 100 is recognized, and then, prescribed data accumulated in the image forming apparatus main body 100 side can be surely written in the memory 31 of the prescribed process cartridge B. At this time, since the cartridge identifying information is stored in the memory with small storage capacity in accordance with the present invention, the memory 31 with small storage capacity is effectively employed to store the data in the memory 31.

According to the present embodiment, can be stored in the memory 31 of the process cartridge B, for instance, the number of printing sheets or the counted value (pixel count) of the number of pixels of a formed image.

Figure 20:
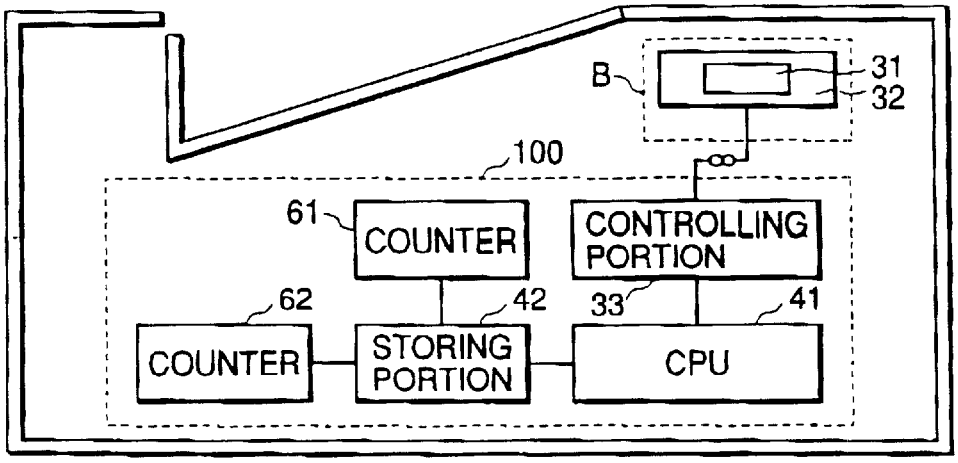
FIG. 20 is an outlined schematic diagram for explaining an apparatus to detect a used amount of the cartridge, preferably working in the embodiments 8 and 9 according to the present invention.

Namely, as shown in FIG. 20, the image forming apparatus A of the present embodiment includes a cartridge using amount detector for detecting the using amount of the cartridge B. In this embodiment, a printing sheet number counter 61 for counting the number of printed recording media P is provided as means for detecting the degree of exhausted state of the photosensitive drum 1. Further, a pixel counter 62 for counting the number of pixels of a printed image is provided as means for detecting the amount of consumption of the developer. The CPU 41 can detect the degree of the exhausted state of the photosensitive drum 1 from the number of printing sheets by using a conversion table. Further, if the number of counted pixels is multiplied by the amount of developer consumed for one pixel, the using amount of the developer can be calculated.

According to the present embodiment, the printing sheet number counter 61 successively adds and stores the number of printed recording media P in the storing part 42 provided in the image forming apparatus main body 100 every time the image is formed. Further, when an image signal sent from the host computer is developed to bit map data, the pixel counter 62 successively adds and stores the number of pixels of a formed image in the storing part 42 provided in the image forming apparatus main body 100. In the storing part 42 of the image forming apparatus main body 100 side, the using amount information (number of printing sheets, pixel count) of the process cartridge B is successively stored in association with the identifying information of the individual process cartridges B similarly stored in the storing part 42.

Then, the data of the number of printing sheets and the number of pixel count stored in the storing part 42 in the image forming apparatus main body 100 side are simultaneously written all together for a unit of prescribed data in the memory 31 of the process cartridge B at a prescribed timing, after the individual identification of the process cartridge B mounted on the image forming apparatus main body 100 is performed as mentioned above. These data are written in the memory 31 mounted on the process cartridge B, so that even when a plurality of cartridges are exchanged and used, the using amount of each cartridge can be stored in the cartridge itself.

As described above, according to the present invention, the data added successively is temporarily stored in the storing part 42 in the image forming apparatus 100, then, it is decided that the process cartridge B the same as that mounted on the image forming apparatus upon storage of the data is currently mounted on the image forming apparatus main body 100, and after that, the added data can be written in the memory 31 of the process cartridge B. Therefore, a possibility that the data stored in the storing part 42 of the image forming apparatus main body 100 is written in the memory 31 of a different process cartridge B can be eliminated. Accordingly, only correct data can be stored in the memory 31 of the proper process cartridge B.

Further, when the data stored once in the image forming apparatus main body 100 reaches a prescribed amount, the data is written in the memory 31 of the process cartridge B, so that the amount of the data to be written in the memory 31 can be reduced. For example, when the number of printing sheets reaches the count of 1000, the number is written in the memory 31 of the process cartridge B as [Bas] one unit, so that the capacity to be written in the memory 31 can be reduced to $1/1000$.

Still further, since the data is temporarily stored in the image forming apparatus main body 100 side as described above, and simultaneously written all together in the memory 31 of the process cartridge B after the individual process cartridges B are recognized, the number of times of writings can be decreased. In other words, it is not necessary to frequently write the data in the memory 31 of the process cartridge B. Accordingly, the life of the memory 31 can be lengthened and a probability of damage of the data can be reduced.

Still further, since it is not necessary to frequently write the data in the memory 31 of the process cartridge B, the CPU 41 does not need to carry out a job other than a processing concerning the image forming process during an image forming operation. Thus, the primary capability of the image forming apparatus A can be exhibited without lowering [any] the throughput.

As described above, for example, since the using amount information of the process cartridge B is stored in the memory 31 of the process cartridge B, in the case where a plurality of process cartridges B are replaced by other cartridges and used, various kinds of functions can be realized, for improving the usability of the user, such as informing the user of the present using amount of the cartridge by employing the using amount information in the image forming apparatus main body side 100. Further, according to the present invention, the capacity of the cartridge identifying information stored in the memory 31 of the process cartridge B can be [suppressed] low. Accordingly, the memory 31 with small capacity can be effectively utilized for a variety of these functions.

It should be understood, according to the present invention, that the data temporarily stored in the image forming apparatus main body side and then written in the storing means of the cartridge is not limited to the above described number of printing sheets and pixel count values. Such data is not limited to the data of using amount of the cartridge. However, for instance, with regard to the using amount information of the cartridge, there may be exemplified methods, as well as the methods for detecting the using amount of an electrophotographic photosensitive body, such as a method for counting the rotating speed of the photosensitive drum, a method for measuring an electric current passing through the photosensitive drum, a method for counting the rotating time of the photosensitive drum or the applying time of charging bias or the like to estimate the degree of the exhausted state of the photosensitive drum by a conversion formula. Further, there are exemplified methods, as methods for detecting the degree of consumption of the developer, as well as the above methods, such as a torque detecting method for detecting the torque of means for agitating the developer in the developer vessel, an electrostatic capacity detecting system for measuring the electrostatic capacity of a flat antenna base composed of an electrode pattern provided with a pair of conductive parts formed in parallel with a prescribed space provided therebetween and detecting the amount of developer by using a change in the electrostatic capacity due to the contact area of the flat antenna and the developer.

Further, according to the present invention, since the manufacturing date of the process cartridge B and the serial number of the process cartridge B manufactured on that day are stored in the memory of the process cartridge B as the cartridge identifying information, the cartridge can be individually identified and the manufacturing date of the process cartridge B can be understood at the same time by the image forming apparatus main body 100 side. Thus, it can be judged whether or not the number of days till the time limit of use for the cartridge mounted on the image forming apparatus main body 100 is small on the basis of the manufacturing date of the process cartridge B and, for instance, the usable period of the cartridge previously stored in the storing part 42 of the image forming apparatus main body 100 side. Then, when it is decided that the time limit for use of the cartridge comes near, a display can be represented on a display part (not shown) provided in the image forming apparatus main body 100 or on the screen of the host computer (not shown) connected to the image forming apparatus main body 100 so as to be capable of communicating therewith, in order to inform the user that the time limit for use of the cartridge draws near. Besides, this information can be recorded on the recording medium P and outputted.

As described above, according to the present invention, since the cartridge identifying information includes the manufacturing date information of the cartridge, the manufacturing date information does not need to be especially stored in addition to the cartridge identifying information. Therefore, while the using range of the memory 31 is a minimum, the manufacturing date can be identified, the individual cartridges can be identified and the memory 31 can be effectively utilized.

Further, according to the present invention, since the information for individually identifying the cartridges is stored in the memory 31 of the process cartridge B, the cartridges can be individually identified by the image forming apparatus main body and the small capacity of the memory 31 can be effectively employed for various kinds of functions.

Embodiment 9

An image forming apparatus according to a embodiment 9 of the present invention is basically identical with the image forming apparatus of the embodiment 8. They are different from each other only in respect of cartridge identifying information stored in a memory 31 provided in a process cartridge B. Therefore, members with the same configurations and functions as those of the embodiment 8 are denoted by the same reference numerals and a detailed explanation thereof will be omitted.

According to the embodiment 9, the manufacturing date of the process cartridge B, manufacturing line information and the serial number of the process cartridge B manufactured in the line on that day are stored as the cartridge identifying information in the readable/writable non-volatile memory 31 as storing means, which is provided in the process cartridge B.

Thus, the image forming apparatus main body 100 is configured so as to identify the individual process cartridges B in accordance with the manufacturing date, the manufacturing line information and the serial number of the process cartridge B manufactured in the line on that date which are stored in the memory 31 of the process cartridge B, as in the embodiment 8.

In such a way, even if the individual identification of the cartridge is performed in accordance with the manufacturing date, the manufacturing line information and the serial number of the cartridge manufactured in the line on that date, operational effects similar to those of the embodiment 8 can be achieved. In other words, the cartridge is further specified by the manufacturing date information and the line information for manufacturing the cartridge which are information other than the serial number of the cartridge, so that the capacity of the cartridge identifying information stored in the storing means of the cartridge can be decreased and a small storage capacity can be effectively used for various kinds of purposes.

Still further, as in the present embodiment, not only the manufacturing date of the cartridge and the serial number thereof on the manufacturing date, but also the manufacturing line is stored in the memory 31 of the process cartridge B, and therefore, even the manufacturing line of the individual cartridge can be also specified. Therefore, for instance, even in the case where [a] trouble is generated in the cartridge, various types of analysis including the manufacturing line can be readily advantageously conducted. Here, according to the present invention, the line information stored in the storing means of the cartridge may include information for specifying, for instance, the manufacturing plant and area of the cartridges.

In the above described embodiments, although the cartridge detachably attached to the image forming apparatus main body 100 is the process cartridge B comprising the photosensitive drum 1, the charging means 2 as the process means acting on the photosensitive drum 1, the developing means 5 and the cleaning means 7*a*, the developer housing vessel 4 and the waste developer vessel 7*b* which are integrally formed, it should be noted that the cartridge detachably attached to the image forming apparatus main body 100 to which the present invention is applicable is not limited thereto. A cartridge adapted to be detachably attached to the image forming apparatus and replaced by another cartridge, such as a developing apparatus C formed as a cartridge (developing cartridge), a photosensitive drum cartridge D, shown in FIGS. 6 and 7 etc. may be provided with a memory 31 [in which] storing the cartridge identifying information in accordance with the present invention as described in the above embodiments, so that similar operational effects to those of the respective embodiments can be attained.

Further, as the storing means for storing the information for individually identifying the process cartridges H, any means capable of storing information as described above can be employed without a special limitation. For instance, there may be employed an EEPROM, a ferroelectric non-volatile memory (FeRAM) as a non-contact type non-volatile memory and a combination of a volatile memory with a backup battery, etc. In the FeRAM, a power source does not need to be provided in the cartridge side and information can be advantageously read and written in the image forming apparatus main body side under a non-contact state.

What is claimed is:

1. An image forming apparatus, comprising:

image forming means for forming an image on a recording material, at least one component element of said image forming means being formed in a unit detachably attachable to a main body of said apparatus; and calculating means for calculating an expiration date in accordance with a reference date for calculation of the expiration date and a predetermined uptime starting from the reference date of said unit; and output means for outputting information of the expiration date.

2. An image forming apparatus according to claim 1, wherein said unit has a memory and said memory stores the information of the expiration date.

3. An image forming apparatus according to claim 1, wherein said calculating means further calculates a number of days until the expiration date of said unit according to the reference date for calculation of the expiration date, and the predetermined uptime from the reference date of said unit, and a present date.

4. An image forming apparatus according to claim 3, further comprising a display, wherein said display displays at least any one of the expiration date, the number of days until the expiration date, and the reference date, and a warning of days until the expiration date, the reference date, and a warning that the expiration date passed.

5. An image forming apparatus according to claim 3, wherein said apparatus can communicate with an electronic instrument having a display and said display displays at least any one of the expiration date, the day number until the expiration date, and the reference date, warning of the expiration date passed.

6. An image forming apparatus according to claim 1, wherein the reference date is a manufacturing date of said unit.

7. An image forming apparatus according to claim 1, wherein the reference date is a date of starting use of said unit.

8. An image forming apparatus according to claim 1, further comprising a display, wherein the information of the expiration date outputted from said output means is displayed on said display.

9. An image forming apparatus according to claim 1, wherein said apparatus can communicate with an electronic instrument having a display and the information of the expiration date outputted from said output means is displayed on a display.

10. An image forming apparatus comprising:

image forming means for forming an image on a recording material, at least one component element of said image forming means being formed in a unit and detachably attachable to a main body of said apparatus;

comparing means for comparing a first expiration date relating to a manufacturing date of said unit with a second expiration date relating to a date of starting use of said unit; and output means for outputting information relating to the expiration date.

11. An image forming apparatus according to claim 10, wherein said output means outputs a day, which is close to the expiration date, between the first expiration date and the second the expiration date.

12. A unit detachably attachable to an image forming apparatus having image forming means for forming an image on a recording material, comprising:

at least one component element of said image forming means; and a memory, wherein said memory stores a date, which is the reference of said unit, and an uptime from the date.

13. A unit according to claim 12 wherein the reference date is a manufacturing date of said unit.

14. A unit according to claim 12 wherein the reference date is a date of starting use of said unit.

15. A unit according to claim 12, wherein said component element of said image forming means mounted on said unit is at least any one of an image bearing body, charging means for charging said image bearing body, developing means for developing a latent image formed on said image bearing body, and cleaning means for cleaning said image bearing body.

16. An image forming apparatus, comprising:

image forming means for forming an image on a recording material, at least one component element of said image forming means being formed in a unit detachably attachable to a main body of said apparatus;

calculating means for calculating an unused period of said unit; and controlling means for controlling a returning action of said image forming means in accordance with the unused period.

17. An image forming apparatus according to claim 16, wherein when the unused period is longer than a reference period, said controlling means sets a returning action to be longer in comparison with when the unused period is shorter reference period.

18. An image forming apparatus according to claim 16, wherein said controlling means sets different returning action in accordance with the unused period.

19. An image forming apparatus according to claim 16, wherein said returning action is operated in a period after input of a printing request in said apparatus and before start of an image formation operation.

20. An image forming apparatus according to claim 16, wherein said calculating means calculates the unused period in accordance with a last date of use and a present date of said unit.

21. An image forming apparatus, comprising:

image forming means for forming an image on a recording material, at least one component element of said image forming means being formed in a unit detachably attachable to a said main body of said apparatus;

calculating means for calculating an unused period of said image forming means mounted on said unit; and wherein on said unit at least two elements of said image forming means are mounted, and said calculating means calculates the unused period of respective elements mounted on said unit, and controlling means for controlling a returning action of said image forming means in accordance with the unused period;

wherein said controlling means controls the returning action before an input of a printing request in accordance with the unused period of a first element and controls the returning action after the input of the printing request in accordance with the unused period of a second element and until an image formation operation is started.

22. A unit detachably attachable to an image forming apparatus having image forming means for forming an image on a recording material, comprising:

at least one component element of said image forming means, and a memory, wherein said memory stores a last date of use of said unit and a reference unused period of said unit and a returning action time of said image forming means.

23. A unit detachably attachable to an image forming apparatus having image forming means for forming an image on a recording material, comprising:

at least one component element of said image forming means, and a memory, wherein said memory stores a last date of use of said unit and stores a reference unused period of said unit and a number associated with a returning action of said image forming means.

24. A unit according to any one of 22 or 23 wherein said component element of said image forming means mounted on said unit is at least any one an the image bearing body, charging means for charging said image bearing body, developing means for developing a latent image formed on said image bearing body, and cleaning means for cleaning said image bearing body.

* * * * *

UNITED STATES PATENT AND TRADEMARK OFFICE

CERTIFICATE OF CORRECTION

PATENT NO. : 6,546,212 B1
APPLICATION NO. : 09/689735
DATED : April 8, 2003
INVENTOR(S) : Ogata et al.

It is certified that error appears in the above-identified patent and that said Letters Patent is hereby corrected as shown below:

SHEET 19

"RETUEN" should read --RETURN--.

COLUMN 1

Line 20, "by" should read --by forming--;
Line 21, "formed" should be deleted; and "an" should be deleted;
Line 22, "electrophotographically" should read --electrophotographic--;
Line 23, "body," should read --body, supplying--; and "is supplied" should be deleted;
Line 25, "the image is transferred" should read --transferring the image--;
Line 28, "electrophotographi-" should read --electrophotographic--;
Line 29, "cally" should be deleted;
Line 31, "electrophotographically" should read --electrophotographic--;
Line 35, "electrophotographically" should read --electrophotographic--;
Line 38, "process cartridge" should read --process-cartridge--;
Line 41, "process" should read --process- --;
Line 49, "degree, i.e., life," should read --degree--;
Line 59, "electrophotographically" should read --electrophotographic--;
Line 67, "within" should read --before--; and "obtained," should read --obtained, and shortly--.

COLUMN 2

Line 1, "cartridge." should read --cartridge the expiration date after manufacture of the cartridge is set.--; and "by" should read --by a--;
Line 12, "removed" should read --removed,--;
Line 23, "or the" should read --or in the--;
Line 26, "after" should read --after the--; and "the" (third occurrence) should be deleted;

Signed and Sealed this
Fourth Day of September, 2012

David J. Kappos

David J. Kappos
*Director of the United States Patent and Trademark Office*

Line 33, “start of the” should read --the start of--;
Line 60, “are” should read --are the following--;
Line 65, “printed,” should read --printed;--; and
Line 67, “drum,” should read --drum;--.

COLUMN 3

Line 2, “drum,” should read --drum;--;
Line 6, “by” should read --by a--;
Line 12, “used,” should read --used;--;
Line 15, “section,” should read --section;--;
Line 18, “is” should read --are--; and “with” should be deleted;
Line 20, “a” should read --an--;
Line 21, “with” should be deleted;
Line 24, “developer” should read --developer,--;
Line 26, “to” should read --to the--;
Line 51, “allow” should read --allows--; and
Line 52, “unused” should read --its unused--.

COLUMN 4

Line 3, “idle” should read --performing idle--;
Line 9, “e.g.” should read --(e.g.--;
Line 11, “door” should read --door,--;
Line 12, “cartridge,” should read --cartridge,)--;
Line 17, “number” should read --the number--;
Line 21, “to be” should read --so that the cartridge is--;
Line 22, “of the cartridge” should be deleted; and “that” should be deleted;
Line 33, “adjusting” (second occurrence) should be deleted;
Line 42, “for” should read --due to--;
Line 47, “individuals of” should read --individual cartridges--;
Line 48, “the cartridge” should be deleted; and “to decide” should read --so that it can be decided--; and
Line 58, “method” should read --method has been proposed--.

COLUMN 5

Line 25, “is” should read --are--; and
Line 53, “the” (first occurrence) should read --an--.

COLUMN 6

Line 31, “and” should read --and being--; and “said” should read --the--; and
Line 59, “means,” should read --means; and--.

COLUMN 7

Line 1, “said” should read --the--;
Line 11, “and” should read --and being--; and “said” should read --the--; and
Line 46, “and” should read --and being--.

COLUMN 8

Line 2, “and” should read --and being--; and
Line 35, “and” should read --and being--.

COLUMN 10

Line 56, “said” should read --the--.

COLUMN 11

Line 9, “an” should be deleted.

COLUMN 12

Line 38, “11 comprises” should read --11, which comprises--; and “11B showing” should read --11B, shows--;
Line 42, “12 comprises” should read --12, which comprises--; and “12B showing” should read --12B, shows--;
Line 46, “13 comprises” should read --13, which comprises--; and “13B showing” should read --13B, shows--;
Line 54, “15 comprises” should read --15, which comprises--; and “15B showing” should read --15B, shows--;
Line 57, “the cartridge” should be deleted; and
Line 59, “16 comprises” should read --16, which comprises--; and “16B showing” should read --16B, shows--.

COLUMN 13

Line 17, “apparatus” should read --apparatus,--;
Line 29, “OHP” should read --an OHP--;
Line 37, “with” should read --to--;
Line 41, “have” should read --having--;
Line 42, “5A” (second occurrence) should read --5a--;
Line 43, “T” should read --T,--;
Line 45, “5A” should read --5A,--;
Line 51, “relaxation.” should read --rotation.--;
Line 57, “member” should read --member,--;
Line 58, “thickness” should read --thickness,--;

Line 60, “developer,” should read --developer--; and “region,” should read --region--; and
Line 65, “alternate” should read --alternating--.

COLUMN 14

Line 6, “P” should read --P,--;
Line 7, “image is” should read --image, are--;
Line 8, “comprise” should read --which comprises--;
Line 10, “and” should be deleted;
Line 21, “process. ¶” should read --process.--;
Line 22, “(scratch)” should read --(scratches)--;
Line 24, “get” should read --come--;
Line 33, “etc.” should read --etc.,--;
Line 56, “ferroelectricity” should read --ferroelectric--; and
Line 62, “from and” should be deleted.

COLUMN 15

Line 2, “source” should be deleted;
Line 31, “in” should read --with--;
Line 38, “on” should read --of--; and
Line 41, “is” should read --are--.

COLUMN 16

Line 33, “compare” should read --compares--;
Line 38, “3,” should read --4,--;
Line 39, “showing” should read --indicating--;
Line 47, “100 for example” should read --100, for example,--;
Line 51, “etc.” should read --etc.,--;
Line 55, “showing” should read --indicating--;
Line 58, “indicating” should read --warning--;
Line 59, “past” should read --passed--;
Line 63, “this” should read --This--; and “past” should read --passed--;
Line 65, “etc.” should read --etc.,--; and
Line 66, “apparatus” should read --operation--.

COLUMN 17

Line 2, “onto” should read --on--;
Line 4, “showing” should read --indicating--;
Line 6, “a” should read --the--;
Line 7, “showing” should read --indicating--;
Line 8, “past” should read --passed,--;
Line 9, “is” should read --are--;

Line 12, “onto” should read --on--;
Line 13, “indicat-” should read --warn--;
Line 15, “onto” should read --on--;
Line 17, “onto” should read --on--;
Line 18, “150” should read --150,--;
Line 30, “on,” should read --turned on,--;
Line 36, “are” should read --is--;
Line 63, “when” should read --in spite of the fact that--; and
Line 65, “past” should read --passed--.

COLUMN 18

Line 1, “with” should read --with a--;
Line 9, “5” should read --5,--;
Line 10, “4” should read --4,--;
Line 16, “being” should read --exhibiting--; and
Line 41, “a date” should read --dates--.

COLUMN 19

Line 13, “pat” should read --turned--;
Line 18, “in” should read --according to--;
Line 25, “information can be notified to users,” should read --users can be notified of the information--;
Line 35, “is different” should read --differs--;
Line 36, “in the date to become” should read --because it uses a different date as--;
Line 59, “21” should read --21,--;
Line 61, “100” should read --100,--.

COLUMN 20

Line 6, “expired” should read --expired,--;
Line 9, “use” should read --use,--;
Line 25, “on,” should read --turned on,--; and
Line 65, “is” should be deleted.

COLUMN 21

Line 4, “Ds-limit-Dstart+Ms-limit” should read --Ds-limit=Dstart+Ms-limit--;
Line 7, “(Dpresent)” should read --(Dpresent), the calculating means 22--;
Line 33, “showing” should read --indicating--;
Line 36, “indicating” should read --warning--;
Line 37, “past” should read --passed--;
Line 41, “past” should read --passed--;
Line 43, “etc.” should read --etc.,--;

Line 44, “apparatus” should read --operation--;
Line 47, “onto” should read --on--;
Line 49, “showing” should read --indicating--;
Line 52, “showing” should read --indicating--;
Line 53, “past” should read --passed--;
Line 54, “is” should read --are--;
Line 58, “indicating” should read --warning--; and
Line 59, “onto” should read --on--.

COLUMN 22

Line 12, “put” should read --turned--;
Line 13, “(step 10),” should read --(step 12),--;
Line 14, “put” should read --turned--;
Line 20, “such a” should read --the--;
Line 21, “of” (second occurrence) should read --of producing--;
Line 23, “past” should read --passed--;
Line 26, “image forming” should read --an image forming operation--;
Line 31, “C” should read --C,--;
Line 36, “existence” should read --the existence--;
Line 41, “that” should read --so that--;
Line 44, “show-” should read --indicat- --;
Line 49, “days” should read --dates--; and
Line 63, “cartridge” should read --cartridges--.

COLUMN 23

Line 15, “days” should read --dates--;
Line 22, “enough and therefore” should read --enough, and therefore,--;
Line 24, “means” should read --means performing this function,--;
Line 27, “days” should read --dates--;
Line 28, “days” should read --dates--;
Line 52, “months” should read --months,--;
Line 53, “manufactured” should read --manufactured,--;
Line 54, “months” should read --months,--;
Line 55, “started” should read --started,--.

COLUMN 24

Line 9, “another” should read --another mode of the--;
Line 17, “such an” should read --the--;
Line 35, “are” should read --is--; and
Line 53, “onto” should read --on--; and “a OHP” should read --an OHP--; and
Line 54, “etc.” should read --etc.,--.

COLUMN 25

Line 13, “5c” should read --5c.--;
Line 15, “thickness” should read --thickness,--;
Line 17, “developer,” should read --developer--; and “region,” should read --region--;
Line 22, “alternate” should read --alternating--;
Line 29, “P” should read --P,--;
Line 30, “image is” should read --image, are--;
Line 31, “comprise” should read --comprises--;
Line 36, “ejected” should read --moved--;
Line 40, “1” should read --1,--;
Line 41, “6” should read --6,--;
Line 42, “a” should be deleted;
Line 43, “a” should read --the--; and
Line 56, “etc.” should read --etc.,--.

COLUMN 26

Line 4, “perceiving” should read --detecting--;
Line 14, “(now” should read --(not--; and
Line 57, “the following” should read --following a--.

COLUMN 27

Line 23, “ferroelectricity” should read --ferroelectric--;
Line 28, “on” should read --of--;
Line 58, “device” should read --device,--;
Line 61, “device” should read --device,--; and
Line 63, “is” should read --are--.

COLUMN 28

Line 1, “(%)” should read --(%),--;
Line 11, “life” should read --the life--;
Line 12, “showing” should read --indicating--;
Line 15, “each information is notified to the user.” should read --the user is notified of each information.--;
Line 40, “remains” should read --remains turned--;
Line 62, “started” should read --started,--; and “20” should read --20,--.

COLUMN 29

Line 10, “stored” should read --that is stored--;
Line 16, “as” should read --as a--;
Line 17, “user” should read --a user--;

Line 26, “life” should read --the life--;
Line 27, “life” should read --the life--;
Line 50, “life” should read --the life--;
Line 51, “(Dsd-warming)” should read --(Dsd-warning)--;
Line 53, “life” should read --the life--;
Line 63, “with” should read --by--; and
Line 64, “and multiplying” should read --multiplied by--.

COLUMN 30

Line 15, “of” should read --with respect to--;
Line 16, “and multiplying” should read --multiplied by--; and “the” (second occurrence) should be deleted;
Line 28, “(Dsd-warming)” should read --(Dsd-warning)--;
Line 35, “with” should be deleted;
Line 36, “subtraction of” should read --subtracting--;
Line 38, “above” should read --result by the--;
Line 49, “(d/2)” should read --(d1)--; and “life” should read --the life--;
Line 50, “life” should read --the life--;
Line 54, “(Dsd-warming)” should read --(Dsd-warning)--; and
Line 60, “Dd-end-Dpresent” should read --Dd-end=Dpresent--.

COLUMN 31

Line 2, “(%))[.];” should read --(%));--;
Line 3, “[a]” should be deleted; and
Line 4, “(%))[.];” should read --(%));--;
Line 5, “[a]” should be deleted;
Line 8, “left[.];” should read --left;--;
Line 9, “[a]” (both occurrences) should be deleted;
Line 13, “[regard information of]” should be deleted;
Line 14, “[party that has shown]” should be deleted; and “[that is, passes]” should be deleted;
Line 15, “cartridge” should be deleted;
Line 17, “user” should read --the user--;
Line 19, “[a]” should be deleted;
Line 26, “judgment” should read --the judgment--;
Line 28, “cartridge” should read --a cartridge--;
Line 31, “life,” should read --the life of the cartridges,--;
Line 35, “[is]” should be deleted;
Line 36, “[passed] ended,” should read --passed,--;
Line 37, “user” should read --a user--;
Line 40, “[above described] above-” should read --above described--;
Line 41, “described” should be deleted;
Line 53, “[the]” (second occurrence) should be deleted;
Line 54, “[past the] ended” should read --passed--;
Line 55, “[above described] above-described” should read --above described--;

Line 56, “user the” should read --a user--;
Line 57, “except” should read --except for--;
Line 61, “notify” should read --notify the user of--; and
Line 62, “characteristic for a user,” should read --characteristic,--; and “[suggest to]” should be deleted.

COLUMN 32

Line 2, “[past] ended” should read --passed the end of--;
Line 6, ““the” should read --“The--;
Line 11, “onto” should read --on--;
Line 17, “onto” should read --on--;
Line 19, “onto” should read --on--;
Line 20, “an” should read --a piece of--;
Line 24, “motions” should read --operations--;
Line 25, “[put]” should be deleted;
Line 31, “[put]” should be deleted; and “[motions]” should be deleted;
Line 39, “are” should read --is--;
Line 41, “[put]” should be deleted;
Line 42, “[put]” should be deleted;
Line 44, “[motions]” should be deleted;
Line 45, “[put]” should be deleted;
Line 54, “[a]” should be deleted; and “in” should read --of--;--;
Line 58, “use[.];” should read --use;--;
Line 59, “ready[.];” should read --ready;--;
Line 67, “[cannot help being]” should be deleted; and “[outputting]” should be deleted.

COLUMN 33

Line 1, “[that]” should be deleted;
Line 2, “[has reached its]” should be deleted;
Line 6, “[;]” should be deleted;
Line 15, “[put]” should be deleted; and “[,]” should be deleted;
Line 16, “[,]” should be deleted;
Line 17, “perceived, [that is,]” should read --detected,--;
Line 18, “of” should read --of the--;
Line 19, “etc.” should read --etc.,--; and “[of]” should be deleted;
Line 22, “[above described] abovedescribed” should read --above described--;
Line 23, “the” (first occurrence) should be deleted;
Line 24, “[put]” should be deleted;
Line 28, “[such as] operating by determining” should read --such as--;
Line 33, “[served to] be [an advantage]” should read --be--;
Line 57, “developer” should read --the developer--;
Line 58, “[perceived]” should be deleted;
Line 60, “[perceived]” should be deleted;

Line 65, “[a]” should be deleted;
Line 66, “[a]” should be deleted; and
Line 67, “life” should read --the life--.

COLUMN 34

Line 1, “[a]” should be deleted; and “life” should read --the life--;
Line 3, “[motions]” should be deleted;
Line 9, “[understandable]” should be deleted;
Line 13, “[puts]” should be deleted;
Line 19, “put” should read --turned--;
Line 25, “[in]” should be deleted;
Line 40, “20” should read --20,--;
Line 58, “[a]” should be deleted; and
Line 59, “[a]” should be deleted.

COLUMN 35

Line 1, “[a]” should be deleted;
Line 2, “[.]” should deleted;
Line 3, “[a]” should be deleted;
Line 4, “[.]” should be deleted;
Line 5, “[a]” should be deleted;
Line 6, “[a]” should be deleted;
Line 8, “[.]” should be deleted;
Line 9, “[a]” should be deleted;
Line 14, “[of]” should be deleted;
Line 19, “[the] both [parties]” should read --both--;
Line 20, “[regard]” should be deleted; and “[party]” should be deleted;
Line 21, “comes” should read --the present invention comes--;
Line 24, “is almost the same in [the]” should read --yields almost the same results for--;
Line 25, “[parties of] the using amount of the developer and [of] the” should read --using--;
Line 26, “using amount of the developer,” should read --amounts,--;
Line 30, “[a]” should be deleted;
Line 31, “[.]” should be deleted;
Line 32, “[a]” should be deleted;
Line 33, “[.]” should be deleted;
Line 34, “[a]” should be deleted;
Line 35, “[a]” should be deleted;
Line 37, “[.]” should be deleted;
Line 38, “[a]” should be deleted;
Line 44, “given” should read --determined--;
Line 50, “with” should read --by--; and “and multiplying” should read --multiplied by--;
Line 51, “[were]” should read --were--;
Line 52, “was” should be deleted;

Line 55, “[that]” should be deleted;
Line 65, “of the [above described]” should read --with respect to the above described--; and
Line 66, “above-described” should be deleted; and “given” should read --determined--.

COLUMN 36

Line 2, “dividing” should read --dividing the result by--;
Line 4, “and multiplying” should read --multiplied by--;
Line 7, “with” should read --this percentage to be--;
Line 8, “[a]” should read --the--;
Line 9, “[above described] above-described” should read --above described--;
Line 21, “[a]” should read --a--;
Line 23, “an even event” should read --the event--; and “and” should be deleted;
Line 24, “with subtraction of” should read --subtracting--;
Line 39, “[above described] above-described” should read --above described--;
Line 40, “given” should read --determined--;
Line 42, “[a]” should be deleted; and “(Dst-warming)” should read --(Dst-warning)--;
Line 44, “[above described] above-described” should read --above described--;
Line 51, “With” should read --With a--; and “[above described] above-” should read --above described--;
Line 52, “described” should be deleted;
Line 53, “is” should read --is the--;
Line 56, “[a]” should be deleted;
Line 57, “[.]” should be deleted;
Line 58, “[a]” should be deleted;
Line 59, “[.]” should be deleted;
Line 60, “[a]” should be deleted;
Line 61, “[a]” should be deleted;
Line 64, “[.]” should be deleted; and
Line 65, “[a]” should be deleted.

COLUMN 37

Line 4, “[party]” should be deleted; and “[,]” should be deleted;
Line 5, “passes the end of its life earlier,” should read --the value that indicates the earliest passing of the end of the life of a cartridge component,--;
Line 9, “[, a]” should be deleted;
Line 14, “Ds-Sl-Dlast-Dstart.” should read --Ds-Sl=Dlast-Dstart.--;
Line 16, “with judgment in step 6” should read --in step 6 where--;
Line 27, “and showing” should read --indicating--;
Line 31, “[above described] above-described” should read --above described--;
Line 44, “[past the] ended” should read --passed the end of--;
Line 47, “except” should read --except for--;
Line 50, “notify” should read --notify the user of--;
Line 52, “[suggest to]” should read --suggesting that the user--;

Line 58, “[past] ended” should read --passed the end of--;
Line 62, ““[the] The” should read --“The--; and
Line 67, “onto” should read --on--.

COLUMN 38

Line 6, “onto” should read --on--;
Line 8, “onto” should read --on--;
Line 9, “[an]” should read --a--;
Line 11, “etc.” should read --etc.,--;
Line 14, “[motions]” should be deleted;
Line 15, “[put]” should be deleted;
Line 21, “[put]” should be deleted; and “[motions]” should be deleted;
Line 23, “readout” should read --read-out--;
Line 28, “are” should read --is--;
Line 30, “[put]” should be deleted;
Line 31, “[put]” should be deleted;
Line 33, “[motions]” should be deleted;
Line 34, “[put]” should be deleted;
Line 36, “[motion]” should be deleted;
Line 46, “[a]” should be deleted; and “in” should read --of--;
Line 50, “[.]” should be deleted;
Line 51, “[.]” should be deleted;
Line 59, “[cannot help being]” should be deleted;
Line 60, “[outputting]” should be deleted;
Line 61, “spite” should read --spite of the fact--; and “[has] having” should read --has--;
Line 62, “[its end]” should be deleted; and
Line 66, “[is]” should be deleted.

COLUMN 39

Line 3, “[collects]” should be deleted;
Line 9, “[a]” should be deleted;
Line 15, “[Thereby]” should be deleted; and “acknowledge” should read --learn--;
Line 21, “[timing,]” should be deleted;
Line 24, “[preconditioned by]” should be deleted;
Line 25, “it reaches” should be deleted;
Line 27, “this” should read --a--;
Line 28, “life” should read --its life--;
Line 32, “Thereby” should be deleted;
Line 34, “calculation” should read --a calculation--;
Line 36, “much” should read --much of--;
Line 37, “may” should read --many--;
Line 45, “[of]” should be deleted;
Line 47, “[into]” should read --in--;

Line 50, “[put]” should be deleted;
Line 52, “[perceived]” should be deleted;
Line 58, “likewise” should read --like--;
Line 60, “[served to]” should be deleted; and “[an” should be deleted; and
Line 61, “advantage]” should read --sufficiently--.

COLUMN 40

Line 2, “[,]” should read --,--;
Line 6, “[a]” should be deleted;
Line 13, “[a]” should be deleted;
Line 15, “[a]” should be deleted;
Line 16, “B [is],” should read --B,--; and “[being]” should be deleted;
Line 17, “[referred]” should be deleted; and “[a]” should be deleted;
Line 18, “[a]” should be deleted;
Line 22, “[a]” should be deleted;
Line 24, “[perceived]” should be deleted;
Line 26, “[perceived]” should be deleted;
Line 30, “[a]” should be deleted;
Line 31, “[a]” should be deleted;
Line 32, “[a]” should be deleted;
Line 34, “[a]” should be deleted;
Line 37, “[motions]” should be deleted;
Line 44, “[puts]” should be deleted;
Line 50, “[put]” should be deleted;
Line 54, “[a]” should be deleted;
Line 59, “[a]” should be deleted; and
Line 64, “[a]” should be deleted.

COLUMN 41

Line 4, “[a]” should be deleted;
Line 5, “[a]” should be deleted;
Line 6, “[a]” should be deleted;
Line 15, “[a]” should be deleted;
Line 16, “[.]” should be deleted;
Line 17, “[a]” should be deleted;
Line 18, “[.]” should be deleted;
Line 19, “[a]” should be deleted;
Line 20, “[a]” should be deleted;
Line 22, “[.]” should be deleted;
Line 23, “[a]” should be deleted;
Line 27, “[of]” should be deleted;
Line 32, “[the] both [parties]” should read --both values--;
Line 33, “[regard]” should be deleted; and “[party]” should be deleted;

Line 37, “[is]” should be deleted; and “[in” should be deleted;
Line 38, “the]” should be deleted; and “[parties of the] using [amount] amounts” should read --using amounts--;
Lines 39 and 40 should be deleted;
Line 41, “[,] will be calculated” should read --here the calculating means will perform its calculation--;
Line 43, “[a]” should be deleted;
Line 44, “[.]” should be deleted;
Line 45, “[a]” should be deleted;
Line 46, “[.]” should be deleted;
Line 48, “[a]” should be deleted;
Line 49, “[a]” should be deleted;
Line 51, “[.]” should be deleted;
Line 52, “[a]” should be deleted;
Line 57, “[above described] above-” should read --above described--;
Line 58, “described” should be deleted; and “[given]” should be deleted;
Line 59, “with [a]” should read --by--;
Line 61, “and multiplying” should read --multiplied by--;
Line 63, “[a]” should be deleted;
Line 65, “kind” should read --the kind--;
Line 66, “image” should read --the image--; “for” should read --so that for--; and “that” should be deleted.

COLUMN 42

Line 7, ““[a] the” should read --“the--;
Line 9, “of” should read --with respect to--; and “[above” should read --above described--;
Line 10, “described] above-described” should be deleted;
Line 11, “independently” should read --independently,--; and “[above” should read --above described--;
Line 12, “described] above-described” should be deleted; and “[a]” should be deleted;
Line 14, “with” should read --by--;
Line 15, “and multiplying” should read --multiplied by--;
Line 18, “setting with” should read --the setting of--;
Line 19, “[a]” should be deleted;
Line 26, “”[a] the” should read --“the--;
Line 27, “[a]” should be deleted;
Line 30, “[above described] above-described “ should read --above described--;
Line 31, “[given]” should read --determined--;
Line 33, “[being]” should be deleted;
Line 35, “80% is” should read --80%, which is--;
Line 36, “for [an even]” should read --in--;
Line 37, “with subtraction of” should read --subtracting--;
Line 39, “dividing” should read --and dividing--;
Line 40, “and moreover multiplying” should read --multiplied by--;

Line 52, “[above described] above-described” should read --above described--;
Line 53, “given” should read --determined--;
Line 55, “[a]” should be deleted; and “(Dst-warming)” should read --(Dst-warning)--;
Line 56, “[a]” should be deleted;
Line 60, “[above described] above-described” should read --above described--;
Line 61, “[a]” should be deleted;
Line 64, “life” should read --end of the life--; and “[an]” should be deleted; and
Line 66, “[a]” (both occurrences) should be deleted.

COLUMN 43

Line 1, “toward [a]” should read --to the--;
Line 3, “[a]” should be deleted;
Line 11, “[above described] above-” should read --above--;
Line 15, “[above described] abovedescribed” should read --above described--;
Line 17, “[a]” should be deleted;
Line 18, “[.]” should be deleted;
Line 19, “[a]” should be deleted;
Line 20, “[.]” should be deleted;
Line 22, “[a]” should be deleted;
Line 23, “[a]” should be deleted;
Line 24, “(Dsd-warming)” should read --(Dsd-warning)--;
Line 25, “[.]” should be deleted;
Line 26, “[a]” should be deleted; and “life” should read --the life--;
Line 27, “life” should read --the life--;
Line 30, “[regard] determine” should read --regard the larger using amount--;
Line 31, “of the [party] element that has shown a larger” should be deleted;
Line 32, “using amount,” should be deleted; and “[passes] ends” should read --the user amount information indicating that its associated cartridge element passes the end of--;
Line 34, “[above described] above-” should read --above--;
Line 45, “life” should read --the life--;
Line 47, “showing” should read --indicating--;
Line 51, “[above described] above-described” should read --above described--;
Line 58, “[will]” should be deleted; and “‘D-warming’,” should read --‘D-warning’,”--;
Line 61, “life” should read --the life of the cartridge--;
Line 64, “past the” should read --passed the end of its--; and “[above described] above-described” should read --above described--; and
Line 66, “except” should read --except for--.

COLUMN 44

Line 5, “[suggest]” should be deleted;
Line 9, “etc.” should read --etc.,--;
Line 11, “past” should read --passed--;
Line 15, “”[the] The” should read --“The--;

Line 19, “[above described] above-” should read --above--;
Line 35, “[exchange]” should be deleted; and
Line 36, “[renew]” should be deleted.

COLUMN 45

Line 5, “[irrespective of the]” should be deleted;
Line 6, “holiday [of the user].” should read --holiday.--;
Line 18, “[the]” should be deleted;
Line 31, “[word]” should be deleted;
Line 32, “[recycle]” should be deleted;
Line 33, “[the]” should be deleted;
Line 41, “[an]” should be deleted; and “[of]” should be deleted; and
Line 45, “a tender” should read --good--.

COLUMN 46

Line 2, “[the]” should be deleted;
Line 3, “[of]” should be deleted; and
Line 66, “[the]” should be deleted.

COLUMN 47

Line 5, “life” should read --the life--; and
Line 47, “[,]” should be deleted.

COLUMN 48

Line 36, “[on]” should be deleted;
Line 61, “[cartridge” should read --cartridge--;
Line 62, “period]” should read --period--; and
Line 67, “it” should be deleted.

COLUMN 49

Line 6, “[is]” should be deleted;
Line 15, “[under]” should be deleted;
Line 35, “motion” should read --operation--; and
Line 36, “[it]” should be deleted.

COLUMN 50

Line 8, “a” should read --the--;
Line 17, “hole” should read --opening--;
Line 28, “of” should read --of reference days,--;

Line 29, “month” should read --month,--;
Line 59, “[a]” should be deleted;
Line 60, “[exchange]” should be deleted;
Line 61, “[update]” should be deleted; and “date” should read --the date--;
Line 66, “[is]” should be deleted; and “[deteriorated]” should be deleted; and
Line 67, “follows:” should read --follows.--.

COLUMN 51

Line 6, “blade 7a” should read --blade 7a,--; and
Line 31, “the” should read --a--.

COLUMN 52

Line 5, “[got loose]” should be deleted;
Line 9, “such as” should read --which can cause--;
Line 11, “period such as” should read --period, which can cause--;
Line 14, “etc., occur.” should read --etc.--;
Line 23, “Two” should read --The two--;
Line 36, “5a” should read --5a,--; and
Line 52, “[enough]” should be deleted.

COLUMN 53

Line 1, “avoided” should read --avoided,--;
Line 3, “period” should read --the period--;
Line 6, “deterioration avoided” should be deleted;
Line 8, “[is]” should be deleted;
Line 12, “[image quality” should be deleted;
Line 18, “[leaving period]” should be deleted;
Line 63, “[image quality deterio-” should be deleted; and
Line 64, “ration avoiding]” should be deleted.

COLUMN 54

Line 1, “[image quality deterioration” should be deleted;
Line 2, “avoiding]” should be deleted;
Line 4, “”asa” should read --two kinds of the--;
Line 5, “[image quality deterioration” should be deleted;
Line 6, “avoiding]” should be deleted;
Line 7, “two kinds of” should read --and these are--;
Line 21, “be deteriorated” should read --deteriorate--;
Line 22, “[to proceed more] from proceeding further.” should read --from further proceeding.--;

Line 32, “therefore” should be deleted; and
Line 43, “[of]” should be deleted.

COLUMN 55

Line 6, “hole” should read --opening--;
Line 16, “[as]” should be deleted;
Line 18, “set” should read --set to be--;
Line 23, “left ,and” should read --left, and--;
Line 24, “move” should read --proceed--;
Line 47, “[image quality deterioration” should be deleted;
Line 48, “avoiding]” should be deleted;
Line 52, “[image quality deterioration avoiding]” should be deleted;
Line 61, “[be]” should be deleted; “employ” should be deleted; and
Line 62, “[enough” should be deleted.

COLUMN 56

Line 4, “etc.” should read --etc.,--;
Line 8, “[image quality deterioration avoiding]” should be deleted;
Line 13, “difference of a” should read --requirements arising from a difference in the--; and “of” (second occurrence) should read --in--;
Line 16, “contents” should read --details--; and “[image quality deterioration” should be deleted;
Line 17, “avoiding]” should be deleted;
Line 23, “[image quality” should be deleted;
Line 24, “deterioration avoiding]” should be deleted; and
Line 28, “contents” should read --details--.

COLUMN 57

Line 32, “[the]” should be deleted;
Line 38, “and” should read --and a--; “voltage” should read --voltage,--; “dc” should read --a dc--; and
Line 39, “ac voltage” should read --an ac voltage,--.

COLUMN 58

Line 57, “hole” should read --opening--;
Line 58, “[has a]” should be deleted; and “possibility” should read --possibly--; and
Line 66, “two” should read --two pieces of--.

COLUMN 59

Line 67, “density” should read --the density--.

COLUMN 60

Line 34, “can” should read --there can--.

COLUMN 61

Line 31, “[Bas]” should be deleted; and
Line 50, “[any]” should be deleted.

COLUMN 62

Line 3, “of” (first occurrence) should read --of the--; and
Line 43, “comes near” should read --approaches--.

COLUMN 63

Line 5, “in respect of” should read --with respect to--;
Line 34, “cartridge” should read --storing means storing the cartridge--; and “stored” should read --in--;
Line 35, “”in the storing means of” should be deleted;
Line 44, “[a]” should be deleted; and
Line 66, “[in which]” should read --storing--.

COLUMN 64

Line 8, “type” should read --type,--;
Line 45, “day number” should read --number of days--;
Line 46, “and” should be deleted; and “warning of” should read --and a warning that--.

COLUMN 65

Line 9, “the” should be deleted;
Line 18, “claim 12” should read --claim 12,--;
Line 20, “claim 12” should read --claim 12,--;
Line 42, “shorter” should read --shorter than the--; and
Line 46, “action” should read --actions--.

COLUMN 66

Line 46, “22 or 23” should read --22 or 23,--; and
Line 48, “one” should read --one of--; and “the” should be deleted.